US007666083B2

(12) United States Patent
Baerlocher et al.

(10) Patent No.: US 7,666,083 B2
(45) Date of Patent: Feb. 23, 2010

(54) GAMING DEVICE HAVING A FREE SPIN GAME INCLUDING AN ACCUMULATED MODIFIER

(75) Inventors: Anthony J. Baerlocher, Reno, NV (US); Paulina Rodgers, Reno, NV (US); Maresa L. Martin, Reno, NV (US); Karen M. Cregan, Kirrawee (AU); Michael MacVittie, Las Vegas, NV (US); Ryan W. Cuddy, Reno, NV (US)

(73) Assignee: IGT, Reno, NV (US)

( * ) Notice: Subject to any disclaimer, the term of this patent is extended or adjusted under 35 U.S.C. 154(b) by 624 days.

(21) Appl. No.: 11/216,323

(22) Filed: Aug. 31, 2005

(65) Prior Publication Data

US 2006/0068884 A1 Mar. 30, 2006

Related U.S. Application Data

(63) Continuation-in-part of application No. 10/953,812, filed on Sep. 29, 2004, now Pat. No. 7,094,148, which is a continuation-in-part of application No. 10/661,443, filed on Sep. 12, 2003, now Pat. No. 7,074,127, which is a continuation-in-part of application No. 10/241,255, filed on Sep. 11, 2002, now Pat. No. 7,056,213.

(51) Int. Cl.
*A63F 9/24* (2006.01)

(52) U.S. Cl. ..... 463/18; 463/19; 463/20; 463/21

(58) Field of Classification Search ..... None
See application file for complete search history.

(56) References Cited

U.S. PATENT DOCUMENTS 2,545,644 A 3/1951 Benton et al.

(Continued)

FOREIGN PATENT DOCUMENTS

AU 564342 8/1987

(Continued)

OTHER PUBLICATIONS

3-Way Action Poker Brochure and Article written by written by IGT, published in 2002.

(Continued)

*Primary Examiner*—Corbett Coburn
*Assistant Examiner*—Omkar Deodhar
(74) *Attorney, Agent, or Firm*—K&L Gates LLP

(57) ABSTRACT

A gaming device including a plurality of reels, where in an unlimited free spin mode, the gaming device causes at least one of the reels to lock or remain stationary when a locking symbol appears on that reel. At least one of the symbols on the reels is associated with each of the unlocked reels. The gaming device enables a player to pick at least one of the symbols associated with the unlocked reels to determine a modifier. The gaming device activates at least one of the unlocked reels for a number of additional free spins. Each time the selected symbol occurs on at least one of the reels, the gaming device changes or increments the value of the modifier. When there are no additional free spins remaining, the gaming device modifies any awards obtained by the player in the additional free spins by the modifier to provide the player with a modified award.

48 Claims, 30 Drawing Sheets

U.S. PATENT DOCUMENTS

| | | | | |
|---|---|---|---|---|
| 4,198,052 | A | | 4/1980 | Gauselmann |
| 4,258,838 | A | | 3/1981 | Rockola et al. |
| 4,410,178 | A | | 10/1983 | Partridge |
| 4,448,419 | A | | 5/1984 | Telnaes |
| 4,513,970 | A | | 4/1985 | Opresco et al. |
| 4,560,161 | A | | 12/1985 | Hamano |
| 4,582,324 | A | | 4/1986 | Koza et al. |
| 4,586,713 | A | | 5/1986 | Abu-Shumays et al. |
| 4,618,150 | A | | 10/1986 | Kimura |
| 4,624,459 | A | | 11/1986 | Kaufman |
| 4,695,053 | A | | 9/1987 | Vazquez, Jr. et al. |
| 4,706,956 | A | | 11/1987 | Abu-Shumays et al. |
| 4,756,531 | A | | 7/1988 | DiRe et al. |
| 4,805,907 | A | | 2/1989 | Haiwara |
| 4,817,952 | A | | 4/1989 | Biro et al. |
| 4,836,553 | A | | 6/1989 | Suttle et al. |
| 4,838,552 | A | | 6/1989 | Hagiwara |
| 4,844,467 | A | | 7/1989 | Gyenge et al. |
| 4,861,041 | A | | 8/1989 | Jones et al. |
| 4,871,171 | A | | 10/1989 | Rivero |
| 4,874,173 | A | | 10/1989 | Hagiwara |
| 4,889,340 | A | | 12/1989 | Greene |
| 4,991,848 | A | | 2/1991 | Greenwood et al. |
| 5,019,973 | A | | 5/1991 | Wilcox et al. |
| 5,033,744 | A | | 7/1991 | Bridgeman et al. |
| 5,085,436 | A | | 2/1992 | Bennett |
| 5,092,598 | A | | 3/1992 | Kamille |
| 5,098,107 | A | | 3/1992 | Boylan et al. |
| 5,102,134 | A | | 4/1992 | Smyth |
| 5,102,137 | A | | 4/1992 | Ekiert |
| 5,167,413 | A | | 12/1992 | Fulton |
| 5,178,390 | A | | 1/1993 | Okada |
| 5,205,555 | A | | 4/1993 | Hamano |
| 5,209,479 | A | | 5/1993 | Nagao et al. |
| 5,211,399 | A | | 5/1993 | Howard |
| 5,249,800 | A | | 10/1993 | Hilgendorf et al. |
| 5,259,616 | A | | 11/1993 | Bergmann |
| 5,288,077 | A | | 2/1994 | Jones |
| 5,288,081 | A | | 2/1994 | Breeding |
| 5,308,065 | A | | 5/1994 | Bridgeman et al. |
| 5,332,228 | A | | 7/1994 | Schultz |
| 5,342,047 | A | | 8/1994 | Heidel et al. |
| 5,342,049 | A | | 8/1994 | Wichinsky et al. |
| 5,362,052 | A | | 11/1994 | Kubatsch |
| 5,364,100 | A | | 11/1994 | Ludlow et al. |
| 5,364,105 | A | | 11/1994 | Jones |
| 5,377,973 | A | | 1/1995 | Jones et al. |
| 5,393,057 | A | | 2/1995 | Marnell, II |
| 5,393,061 | A | | 2/1995 | Manship et al. |
| 5,395,111 | A | | 3/1995 | Inoue |
| 5,407,200 | A | | 4/1995 | Zalabak |
| 5,423,539 | A | | 6/1995 | Nagao |
| 5,429,507 | A | | 7/1995 | Kaplan |
| 5,431,407 | A | | 7/1995 | Hofberg et al. |
| 5,431,408 | A | | 7/1995 | Adams |
| 5,437,462 | A | | 8/1995 | Breeding |
| 5,449,173 | A | | 9/1995 | Thomas et al. |
| 5,452,899 | A | | 9/1995 | Skratulia et al. |
| 5,456,465 | A | | 10/1995 | Durham |
| 5,490,670 | A | | 2/1996 | Hobert |
| 5,494,287 | A | | 2/1996 | Manz |
| 5,511,781 | A | | 4/1996 | Wood et al. |
| 5,524,888 | A | | 6/1996 | Heidel |
| 5,529,309 | A | | 6/1996 | Bartlett |
| 5,531,440 | A | | 7/1996 | Dabrowski et al. |
| 5,531,441 | A | | 7/1996 | Dabrowski et al. |
| 5,536,016 | A | | 7/1996 | Thompson |
| 5,542,669 | A | | 8/1996 | Charron et al. |
| 5,560,603 | A | | 10/1996 | Seelig et al. |
| 5,569,084 | A | | 10/1996 | Nicastro et al. |
| 5,577,731 | A | | 11/1996 | Jones |
| 5,584,485 | A | | 12/1996 | Jones et al. |
| 5,607,162 | A | | 3/1997 | Boylan et al. |
| 5,611,535 | A | | 3/1997 | Tiberio |
| 5,626,341 | A | | 5/1997 | Jones et al. |
| 5,642,882 | A | | 7/1997 | Guerzini |
| 5,642,884 | A | | 7/1997 | Pitcher |
| 5,647,798 | A | * | 7/1997 | Falciglia ..... 463/19 |
| 5,655,965 | A | | 8/1997 | Takemoto et al. |
| 5,660,391 | A | | 8/1997 | Klasee |
| 5,660,393 | A | | 8/1997 | Dreger |
| 5,664,781 | A | | 9/1997 | Feola |
| 5,711,525 | A | | 1/1998 | Breeding |
| D392,340 | S | | 3/1998 | DeSimone |
| 5,722,891 | A | | 3/1998 | Inoue |
| 5,732,948 | A | | 3/1998 | Yoseloff |
| 5,743,524 | A | | 4/1998 | Nannicola |
| 5,752,881 | A | | 5/1998 | Inoue |
| 5,766,074 | A | | 6/1998 | Cannon et al. |
| 5,769,716 | A | | 6/1998 | Saffari et al. |
| 5,772,506 | A | | 6/1998 | Marks et al. |
| 5,772,509 | A | | 6/1998 | Weiss |
| 5,775,692 | A | * | 7/1998 | Watts et al. ..... 273/143 R |
| 5,788,573 | A | | 8/1998 | Baerlocher et al. |
| 5,794,964 | A | | 8/1998 | Jones et al. |
| 5,795,225 | A | | 8/1998 | Jones et al. |
| 5,807,172 | A | | 9/1998 | Piechowiak |
| 5,810,361 | A | | 9/1998 | Kadlic |
| 5,823,873 | A | | 10/1998 | Moody |
| 5,823,874 | A | | 10/1998 | Adams |
| 5,833,536 | A | | 11/1998 | Davids et al. |
| 5,833,537 | A | | 11/1998 | Barrie |
| 5,848,932 | A | | 12/1998 | Adams |
| 5,851,148 | A | | 12/1998 | Brune et al. |
| 5,855,514 | A | | 1/1999 | Kamille |
| 5,863,041 | A | | 1/1999 | Boylan et al. |
| 5,873,781 | A | | 2/1999 | Keane |
| 5,882,261 | A | | 3/1999 | Adams |
| 5,885,157 | A | | 3/1999 | Harada et al. |
| 5,890,962 | A | | 4/1999 | Takemoto |
| 5,911,418 | A | | 6/1999 | Adams |
| 5,918,880 | A | | 7/1999 | Voigt, IV et al. |
| 5,919,088 | A | | 7/1999 | Weiss |
| 5,927,714 | A | | 7/1999 | Kaplan |
| 5,934,672 | A | | 8/1999 | Sines et al. |
| 5,935,002 | A | | 8/1999 | Falciglia |
| 5,947,820 | A | | 9/1999 | Morro et al. |
| 5,951,397 | A | | 9/1999 | Dickinson |
| 5,964,463 | A | | 10/1999 | Moore, Jr. |
| 5,967,894 | A | | 10/1999 | Kinoshita et al. |
| 5,971,849 | A | | 10/1999 | Falciglia |
| 5,980,384 | A | | 11/1999 | Barrie |
| 5,984,781 | A | | 11/1999 | Sunaga |
| 5,988,638 | A | | 11/1999 | Rodesch et al. |
| 5,996,997 | A | | 12/1999 | Kamille |
| 5,997,400 | A | | 12/1999 | Seelig et al. |
| 5,997,401 | A | | 12/1999 | Crawford |
| 6,003,867 | A | | 12/1999 | Rodesch et al. |
| 6,004,207 | A | | 12/1999 | Wilson, Jr. et al. |
| 6,012,982 | A | | 1/2000 | Piechowiak et al. |
| 6,015,346 | A | | 1/2000 | Bennett |
| 6,019,369 | A | | 2/2000 | Nakagawa et al. |
| 6,033,307 | A | | 3/2000 | Vancura |
| 6,056,642 | A | | 5/2000 | Bennett |
| 6,059,289 | A | | 5/2000 | Vancura |
| 6,059,658 | A | | 5/2000 | Mangano et al. |
| 6,062,978 | A | | 5/2000 | Martino et al. |
| 6,062,980 | A | | 5/2000 | Luciano |
| 6,086,066 | A | | 7/2000 | Takeuchi et al. |
| 6,089,976 | A | | 7/2000 | Schneider et al. |
| 6,089,977 | A | | 7/2000 | Bennett |
| 6,089,978 | A | | 7/2000 | Adams |
| 6,093,102 | A | | 7/2000 | Bennett |
| 6,095,921 | A | | 8/2000 | Walker et al. |

6,102,400 A 8/2000 Scott et al.
6,102,798 A 8/2000 Bennett
6,117,009 A 9/2000 Yaseloff
6,120,031 A 9/2000 Adams
6,120,377 A 9/2000 McGinnis, Sr. et al.
6,120,378 A 9/2000 Moody et al.
6,126,541 A 10/2000 Fuchs
6,126,542 A 10/2000 Fier
6,135,885 A 10/2000 Lermusiaux
6,142,873 A 11/2000 Weiss et al.
6,142,874 A 11/2000 Kodachi et al.
6,142,875 A 11/2000 Kodachi et al.
6,146,273 A 11/2000 Olsen
6,149,156 A 11/2000 Feola
6,149,521 A 11/2000 Sanduski
6,155,925 A 12/2000 Giobbi et al.
6,159,095 A 12/2000 Frohm et al.
6,159,096 A 12/2000 Yoseloff
6,159,097 A 12/2000 Gura
6,159,098 A 12/2000 Slomiany et al.
6,162,121 A 12/2000 Morro et al.
6,168,520 B1 1/2001 Baerlocher et al.
6,168,523 B1 1/2001 Piechowiak et al.
6,173,955 B1 1/2001 Perrie et al.
6,174,233 B1 1/2001 Sunaga et al.
6,174,235 B1 1/2001 Walker et al.
6,179,711 B1 1/2001 Yoseloff
6,186,894 B1 2/2001 Mayeroff
6,190,254 B1 2/2001 Bennett
6,190,255 B1 2/2001 Thomas et al.
6,200,217 B1 3/2001 Osawa
6,203,409 B1 3/2001 Kennedy et al.
6,203,428 B1 3/2001 Giobbi et al.
6,203,429 B1 3/2001 Demar et al.
6,210,279 B1 4/2001 Dickinson
6,213,875 B1 4/2001 Suzuki
6,213,876 B1 4/2001 Moore, Jr.
6,220,959 B1 4/2001 Holmes, Jr. et al.
6,224,483 B1 5/2001 Mayeroff
6,224,484 B1 5/2001 Okuda et al.
6,227,970 B1 5/2001 Shimizu et al.
6,231,442 B1 5/2001 Mayeroff
6,231,445 B1 5/2001 Acres
6,234,897 B1 5/2001 Frohm et al.
6,238,287 B1 5/2001 Komori et al.
6,238,288 B1 5/2001 Walker et al.
6,241,607 B1 6/2001 Payne et al.
6,251,013 B1 6/2001 Bennett
D445,841 S 7/2001 Sabo
6,261,177 B1 7/2001 Bennett
6,270,408 B1 8/2001 Sakamoto et al.
6,270,409 B1 8/2001 Shuster
6,270,411 B1 8/2001 Gura et al.
6,270,412 B1 8/2001 Crawford et al.
6,287,194 B1 9/2001 Okada et al.
6,290,600 B1 9/2001 Glasson
6,296,568 B1 10/2001 Tracy
6,299,165 B1 10/2001 Nagano
6,299,170 B1 10/2001 Yoseloff
6,302,398 B1 10/2001 Vecchio
6,302,790 B1 10/2001 Brossard
6,305,686 B1 10/2001 Perrie et al.
6,309,300 B1 10/2001 Glavich
6,311,976 B1 11/2001 Yoseloff et al.
6,312,334 B1 11/2001 Yoseloff
6,315,660 B1 11/2001 DeMar et al.
6,315,663 B1 11/2001 Sakamoto
6,315,664 B1 11/2001 Baerlocher et al.
6,319,124 B1 11/2001 Baerlocher et al.
6,322,078 B1 11/2001 Adams
6,322,309 B1 11/2001 Thomas et al.
6,328,649 B1 12/2001 Randall et al.
6,334,814 B1 1/2002 Adams
6,336,860 B1 1/2002 Webb
6,336,863 B1 1/2002 Baerlocher et al.
6,340,158 B2 1/2002 Pierce et al.
6,346,043 B1 2/2002 Colin et al.
6,347,996 B1 2/2002 Gilmore et al.
6,358,144 B1 3/2002 Kaddlic et al.
6,358,147 B1 3/2002 Jaffe et al.
6,364,766 B1 4/2002 Anderson et al.
6,364,768 B1 4/2002 Acres et al.
6,375,187 B1 4/2002 Baerlocher
6,375,570 B1 4/2002 Poole
6,394,902 B1 5/2002 Glavich et al.
D458,311 S 6/2002 Seelig et al.
6,398,218 B1 6/2002 Vancura
6,398,644 B1 6/2002 Perrie et al.
6,406,369 B1 6/2002 Baerlocher et al.
6,413,160 B1 7/2002 Vancura
6,413,161 B1 7/2002 Baerlocher et al.
6,413,162 B1 7/2002 Baerlocher et al.
6,416,408 B2 7/2002 Tracy et al.
6,419,579 B1 7/2002 Bennett
6,425,824 B1 7/2002 Baerlocher et al.
6,435,511 B1 8/2002 Vancura et al.
6,439,943 B1 8/2002 Aoki et al.
6,439,993 B1 8/2002 O'Halloran
6,439,995 B1 8/2002 Hughs-Baird et al.
D463,504 S 9/2002 Stephan
6,443,452 B1 9/2002 Brune
6,443,837 B1 9/2002 Jaffe et al.
6,454,266 B1 9/2002 Breeding et al.
6,454,651 B1 9/2002 Yoseloff
6,461,241 B1 10/2002 Webb et al.
6,464,582 B1 10/2002 Baerlocher et al.
6,468,156 B1 10/2002 Hughs-Baird et al.
6,471,208 B2 10/2002 Yoseloff et al.
6,481,713 B2 11/2002 Perrie et al.
6,491,584 B2 12/2002 Graham et al.
6,494,454 B2 12/2002 Adams
6,494,785 B1 12/2002 Gerrard et al.
6,506,114 B1 1/2003 Estes et al.
6,506,118 B1 1/2003 Baerlocher et al.
6,511,375 B1 1/2003 Kaminkow
6,514,141 B1 2/2003 Kaminkow et al.
6,537,150 B1 3/2003 Luciano et al.
6,537,152 B2 3/2003 Seelig et al.
6,551,187 B1 4/2003 Jaffe
6,554,703 B1 4/2003 Bussick et al.
6,558,253 B1 5/2003 DeSimone et al.
6,558,254 B2 5/2003 Baelocher et al.
6,561,904 B2 5/2003 Locke et al.
6,565,436 B1 5/2003 Baerlocher
6,569,015 B1 5/2003 Baerlocher et al.
6,569,016 B1 5/2003 Baerlocher
6,572,471 B1 6/2003 Bennett
6,572,473 B1 6/2003 Baerlocher
6,575,830 B2 6/2003 Baerlocher et al.
6,585,591 B1 7/2003 Baerlocher et al.
6,589,114 B2 7/2003 Rose
6,592,457 B1 7/2003 Frohm et al.
6,595,854 B2 7/2003 Hughs-Baird et al.
6,599,185 B1 7/2003 Kaminkow et al.
6,599,192 B1 7/2003 Baerlocher et al.
6,602,137 B2 8/2003 Kaminkow et al.
6,604,740 B1 8/2003 Singer et al.
6,605,002 B2 8/2003 Baerlocher
6,607,437 B2 8/2003 Casey et al.
6,607,438 B2 8/2003 Baerlocher et al.
6,609,974 B2 8/2003 Mead et al.
6,616,142 B2 9/2003 Adams
6,632,139 B1 10/2003 Baerlocher
6,632,140 B2 * 10/2003 Berman et al. ..... 463/18
6,632,141 B2 10/2003 Webb et al.
6,634,941 B2 10/2003 Olive

| | | | | |
|---|---|---|---|---|
| 6,634,943 | B1 | 10/2003 | Baerlocher | |
| 6,638,164 | B2 | 10/2003 | Randall et al. | |
| 6,641,477 | B1 | 11/2003 | Diez, II | |
| 6,644,664 | B2 | 11/2003 | Muir et al. | |
| 6,676,512 | B2 | 1/2004 | Fong et al. | |
| 6,712,694 | B1 | 3/2004 | Nordman | |
| 6,719,630 | B1 | 4/2004 | Seelig et al. | |
| 6,733,389 | B2 | 5/2004 | Webb et al. | |
| 6,746,329 | B1 | 6/2004 | Duhamel | |
| 6,805,349 | B2 | 10/2004 | Baerlocher et al. | |
| 6,869,360 | B2 | 3/2005 | Marks et al. | |
| 6,905,406 | B2 | 6/2005 | Kaminkow et al. | |
| 6,913,532 | B2 | 7/2005 | Baerlocher et al. | |
| 6,921,335 | B2 | 7/2005 | Rodgers et al. | |
| 6,932,700 | B2 | 8/2005 | Bennett et al. | |
| 7,056,213 | B2 * | 6/2006 | Ching et al. | 463/20 |
| 7,066,814 | B2 | 6/2006 | Glavich et al. | |
| 7,074,127 | B2 * | 7/2006 | Cuddy et al. | 463/20 |
| 7,094,148 | B2 * | 8/2006 | Baerlocher et al. | 463/20 |
| 7,137,888 | B2 | 11/2006 | Glavich et al. | |
| 7,169,042 | B2 | 1/2007 | Muir et al. | |
| 7,235,011 | B2 | 6/2007 | Randall et al. | |
| 7,258,611 | B2 | 8/2007 | Bigelow, Jr. et al. | |
| 7,322,887 | B2 | 1/2008 | Belgar et al. | |
| 7,331,862 | B2 | 2/2008 | Rodgers et al. | |
| 7,331,866 | B2 | 2/2008 | Rodgers et al. | |
| 7,331,867 | B2 | 2/2008 | Baerlocher et al. | |
| 7,399,225 | B2 | 7/2008 | Kaminkow | |
| 2001/0009865 | A1 | 7/2001 | Demar et al. | |
| 2002/0010017 | A1 | 1/2002 | Bennett | |
| 2002/0025844 | A1 | 2/2002 | Casey et al. | |
| 2002/0045475 | A1 | 4/2002 | Glavich et al. | |
| 2002/0072402 | A1 | 6/2002 | Baerlocher | |
| 2002/0094857 | A1 | 7/2002 | Meyer | |
| 2002/0142822 | A1 | 10/2002 | Baerlocher et al. | |
| 2002/0151350 | A1 | 10/2002 | Baerlocher et al. | |
| 2002/0155883 | A1 | 10/2002 | Baerlocher | |
| 2003/0013514 | A1 | 1/2003 | Cregan et al. | |
| 2003/0040355 | A1 | 2/2003 | Baerlocher | |
| 2003/0045344 | A1 | 3/2003 | Webb et al. | |
| 2003/0045348 | A1 | 3/2003 | Palmer et al. | |
| 2003/0054875 | A1 | 3/2003 | Marks et al. | |
| 2003/0060272 | A1 | 3/2003 | Glavich et al. | |
| 2003/0064795 | A1 | 4/2003 | Baerlocher et al. | |
| 2003/0069062 | A1 | 4/2003 | Shimizu | |
| 2003/0073483 | A1 | 4/2003 | Glavich et al. | |
| 2003/0162585 | A1 | 8/2003 | Bigelow et al. | |
| 2003/0203753 | A1 | 10/2003 | Muir et al. | |
| 2004/0002372 | A1 | 1/2004 | Rodgers et al. | |
| 2004/0009803 | A1 | 1/2004 | Bennett et al. | |
| 2004/0038731 | A1 | 2/2004 | Englman | |
| 2004/0053666 | A1 | 3/2004 | Vancura | |
| 2004/0053669 | A1 | 3/2004 | Gerrard et al. | |
| 2004/0053672 | A1 | 3/2004 | Baerlocher | |
| 2004/0072612 | A1 | 4/2004 | Rodgers et al. | |
| 2004/0137982 | A1 | 7/2004 | Cuddy et al. | |
| 2004/0147306 | A1 | 7/2004 | Randall et al. | |
| 2004/0266516 | A1 | 12/2004 | Thomas | |
| 2004/0266517 | A1 | 12/2004 | Bleich et al. | |
| 2005/0049035 | A1 | 3/2005 | Baerlocher et al. | |
| 2005/0070354 | A1 | 3/2005 | Baerlocher et al. | |
| 2005/0104298 | A1 | 5/2005 | Butcher et al. | |
| 2006/0246989 | A1 | 11/2006 | Glavich et al. | |

FOREIGN PATENT DOCUMENTS

| | | | |
|---|---|---|---|
| AU | 564355 | | 10/1987 |
| AU | B-13331/88 | | 9/1988 |
| AU | 1997 16432 | B2 | 9/1997 |
| AU | 1997 17601 | B2 | 9/1997 |
| AU | 1996 50327 | A | 10/1997 |
| AU | 1998 63553 | A | 10/1998 |
| AU | 1999 17318 | A1 | 9/1999 |
| AU | 778685 | | 4/2005 |
| DE | 3700861 | A1 | 7/1988 |
| DE | 4014477 | A1 | 7/1991 |
| EP | 0 410 789 | A2 | 7/1990 |
| EP | 0 410 789 | A3 | 7/1990 |
| EP | 0 688 002 | A1 | 12/1995 |
| EP | 0 798 676 | A1 | 10/1997 |
| EP | 0 874 337 | A1 | 10/1998 |
| EP | 0 926 645 | A2 | 6/1999 |
| EP | 0 944 030 | A2 | 9/1999 |
| EP | 0 945 837 | A2 | 9/1999 |
| EP | 0 981 119 | A2 | 2/2000 |
| EP | 0 984 408 | A2 | 3/2000 |
| EP | 0 984 409 | A2 | 8/2000 |
| EP | 1 513 117 | A2 | 3/2005 |
| GB | 2 072 395 | A | 9/1981 |
| GB | 2 083 936 | A | 3/1982 |
| GB | 2 092 797 | | 8/1982 |
| GB | 2 144 644 | A | 3/1985 |
| GB | 2 201 821 | A | 9/1988 |
| GB | 2 202 984 | A | 10/1988 |
| GB | 2 253 300 | A | 2/1992 |
| GB | 2 322 217 | A | 8/1998 |
| GB | 2 328 311 | A | 2/1999 |
| WO | WO 93 03464 | | 2/1993 |
| WO | WO 97 32285 | | 9/1997 |
| WO | WO 00 12186 | | 3/2000 |
| WO | WO 00 32286 | | 6/2000 |
| WO | WO 00 66235 | | 11/2000 |
| WO | WO 00 76606 | A1 | 12/2000 |
| WO | WO 01 26019 | A1 | 4/2001 |
| WO | WO 2004 025584 | A2 | 3/2004 |

OTHER PUBLICATIONS

Addams Family Advertisement and Article written by IGT, Strictly Slots, published in 2000.

Agassi, Article by Strictly Slots written by Aristocrat Leisure Industries, published in Aug. 2005.

American Thunder Screen Shots written by IGT, published in 1998.

Bally Slot Machines Electro-Mechanicals 1964-1980 Book, Revised 3rd Edition [In Part] written by Marshall Fey.

Big Bang Piggy Bankin Advertisement written by WMS Gaming, Inc., published prior to 2000, on or before Dec. thereof.

Black Swan Paytable Display written by IGT, published prior to 2001.

Bonus Times written by Bally Gaming, published in 2000.

Boot Scootin Article in Strictly Slots written by Aristocrat Leisure Industries, PTY Ltd., published prior to Mar. 2004.

Break the Spell Advertisement written by Atronic Casino Technology, Ltd., published in 1999.

Break the Spell Article written by Strictly Slots/Atronic Casino Technology, Ltd., published in Sep. 2000.

Break the Spell Atronic Web Page, published in Jan. 2001.

Bunco Night Advertisement, International Game Technology, 2002, on or before Dec. thereof.

By George Advertisement, International Game Technology, 2002, on or before Dec. thereof.

Cash Box Advertisement & Article written by Anchor Games, Strictly Slots, published in 2000, on or before Dec. thereof.

Cash Chameleon Article written by Strictly Slots/Aristocrat Leisure Industries, PTY Ltd., published in Apr. 2001.

Cash Crop Brochure written by Arist O Crat Leisure Industries, published in 1997.

Catch a Wave Advertisement written by IGT, published in Dec. 2000.

Chutes & Ladders Game Instructions written by Hasbro-Milton Bradley, published in 1999, on or before Dec. thereof.

Cleopatra Article in Strictly Slots written by IGT, published in Sep. 2002.

Cossack Dance Advertisement written by Olympic Video Gaming, published prior to 2002.

Cuckoo Aristocrat Brochure written by Aristocrat, published in Feb. 1998.

Dating Game, IGT Slot Line Brochure, written by IGT, published in 2003.
Dating Game Article in Strictly Slots written by IGT, published in Aug. 2004.
Days Off, Article in Strictly Slots written by Konami, published in Feb. 2005.
Deep Blue Dollars, Article in Strictly Slots written by Atronic Casino Technology, Ltd., published in Jun. 2004.
Dice Games Article describing Poker Dice, published prior to 2001, on or before Dec. thereof.
Dolphin Treasure Advertisement written by Aristocrat Leisure Industries Pty., Ltd., published in 1996.
Double Diamond Line Advertisement written by Bally Gaming Systems, published in 2000.
Double Diamond Pennies Advertisement written by IGT, published in 2004.
DoubleBucks Brochure written by IGT (not dated).
Dream Maker, Advertisement written by Atronic Casino Technology, Ltd., published in 2003.
Enchanted Forest™ Gaming Description from Aristocrat, available in 1994.
Enchanted Unicorn Advertisement written by IGT, published in 2001.
Family Feud Bullseye advertisement, printed from www.igtonline.com/megajackpots/new_games/family_feud_bullseye_slots.html and available in 2001.
Faster Harder More Challenging Q*bert game description [online] [retrieved from the Internet Mar. 12, 2002] written by The Killer List of Videogames, <URL:http://www.klov.com/F/Faster_Harder_More_Challenging_Q*bert.html >.
Field Testing New Slots Article, written by Strictly Slots, published in Jul. 2000.
Fire and Fortune Article in Strictly Slots, Anchor Games, May 2001.
Fishin' Buddies Article published in Strictly Slots/Anchor Games, published in Apr. 2001.
Fox "N" Hound Advertisement written by IGT, published in 2000, on or before Dec. thereof.
Free! 7-Day Trial on Daval's Reel Dice Advertisement written by Gerber & Glass, published in 1936, on or before Dec. thereof.
Fundamentals of Craps Book [In Part], written by Mason Malmuth and Lynne Loomis, published in 1995, on or before Dec. thereof.
Good Times Brochure written by IGT, published in 1999, on or before Dec. thereof.
Gotlieb Emulator Project written by Lee Taylor, [online] [retrieved from the Internet Mar. 12, 2002] <URL: http://www.defender.demon.co.uk/qbert.html>.
Happy Camper Advertisement written by IGT, published in 2001.
Happy Happy Hippy, Advertisement written by Atronic Casino Technology, Ltd., published in 2000.
Hot Flashes, Advertisement written by IGT, published in 2005.
How to play Q*bert written by Gottlieb Amusement Games, [online] [retrieved from the Internet Mar. 12, 2002] <URL: http://users.rcn.com/e-glide/howto1.jpg> and <URL: http://users.rcn.com/e-glide/howto2.jpg>.
I Love Lucy Advertisement written by IGT, published in 2002, on or before Dec. thereof.
In Between Game Description written by IGT, available prior to 2000, on or before Dec. thereof.
Introducing the "Smiling Ape" Machine Advertisement (including Joker's Wild Poker description) written by IGT, published prior to 2001.
Jackpot Party Brochure and Articles written by WMS Gaming, Inc, published in 1988.
Joker's Wild Advertisement written by IGT, published prior to 2001.
Leopard Spots™ (website) written by www.igt.com, printed Mar. 21, 2001.
Levy Patent Abstract written by Derwent Publications Ltd., published in 1991, on or before Dec. thereof.
Little Green Men, Jr. Advertisement written by A.C. Coin and Slot Services Company, published prior to 2002.
Loaded Dice Strictly Slots Article, Konami, Dec. 2000.
Loco Loot Article written by Strictly Slots/Aristocrat Leisure Industries, PTY Ltd., published in May 2002.
Mayan Wheel of Gold article, published by Strictly Slots prior to Sep. 30, 2004.
Mega Multiplier® (website) written by www.wmsgaming.com, printed May 22, 2001.
Mikohn Solutions Article in the World Gaming Congress 2000 Edition, on or before Dec. thereof.
Money Grab (website) written by www.wmsgaming.com, printed May 22, 2001.
Money Mouse Brochure written by Arist O Crat Leisure Industries, published in 1997.
Monopoly Brochures and Articles written by WMS Gaming, Inc. published 1998, on or before Dec. thereof.
Monopoly Party Train Article written by Strictly Slots, published Feb. 2002.
Neon Nights written by IGT, published in 2000, on or before Dec. thereof.
New Kids Article written by Strictly Slots, published in Dec. 2000.
Mountain Money Article written by Strictly Slots/Aristocrat Leisure Industries, PTY Ltd., published in Jun. 2002.
On the House Advertisement written by Olympic Video Gaming, published prior to 2002.
On the Money Article written by Strictly Slots, Casino Data Systems, published in Dec. 2000.
Penguin Pays Advertisement written by Aristocrat Incorporated, published in 1998.
Pick'em Poker Plus Advertisement written by Ball Gaming Systems in 2002.
Polly & Roger Brochure written by VLC, Inc, published in 2000.
Price is Right "Cliff Hangers" Description [online] [retrieved from the Internet Mar. 21, 2001] <URL: www.geocities.com; members.aol.com>.
Price is Right "Showcases" Description [online] [retrieved from the Internet Mar. 16, 2001] <URL: schuminweb.com>.
Q*bert board game instructions written by Parker Brothers, published in 1983, on or before Dec. thereof.
Q*bert game description written by The Killer List of Videogames [online] [retrieved from the Internet Mar. 12, 2001] <URL: http://www.klov.com/Q/Q*bert.html>.
Q*Bert video game advertisement written by Pennsylvania Gameroom Warehouse, [online] [retrieved from the Internet Mar. 12, 2002]<URL:http://www.gameroomwarehouse.com/videogame/qbert.html>.
Q*bert video game cartridge instructions for ATARI 2600 game system written by Parker Brothers, [online] [retrieved from the Internet Feb. 12, 2002] <URL: http://www.hasbro.com/default.asp?x=cc_gameandtoyinstructions>.
Q*bert video game cartridge instructions for ATARI home computer written by Parker Brothers and Arcade/Action Software, [online] [retrieved from the Internet Mar. 12, 2002] <URL: http://www.hasbro.com/default.asp?x=cc_gameandtoyinstructions>.
Q*bert video game cartridge instructions for Colecovision game system written by Parker Brothers, [online] [retrieved from the Internet Mar. 12, 2002] <URL:http://www.hasbro.com/default.asp?x=cc_gameandtoyinstructions>.
Q*bert video game cartridge instructions for Commodore 64 game system written by Parker Brothers and Arcade/Action Software, [online] [retrieved from the Internet Mar. 12, 2002] <URL: http://www.hasbro.com/default.asp?x=cc_gameandtoyinstructions>.
Q*bert video game cartridge instructions for Intellivision game system written by Parker Brothers, [online] [retrieved from the Internet Mar. 12, 2002] <URL: http://www.hasbro.com/default.asp?x=cc_gameandtoyinstructions>.
Q*bert video game cartridge instructions for Texas Instruments 99/4A game system written by Parker Brothers and Arcade/Action Software, [online] [retrieved from the Internet Mar. 12, 2002] <URL: http://www.hasbro.com/default.asp?x=cc_gameandtoyinstructions>.
Q*bert: Classic Video Game Surrealism from the Golden Age of Arcade Games written by e-glide [online] [retrieved from the Internet Mar. 12, 2002] <URL: http://users.rcn.com/e-glide/qbert2.html>.
Q*bert's Qubes game description written by The Killer List of Videogames [online] [retrieved from the Internet Mar. 12, 2002] <URL: http://www.klov.com/Q/Q*bert's_Qubes.html>.

Q-Bert video game advertisement for PlayStation [online] [retrieved from the Internet Mar. 12, 2002] <URL: http://www.amazon.com>.
Red Baron, Article in Strictly Slots written by Aristocrat, published in Feb. 2005.
Reelin-n-Rockin, Advertisement published by Aristocrat, published in 1999.
Reel Magic™ Gaming Machine Description written by IGT, available in 1986.
Richard Petty Advertisement written by IGT, published in 2000, on or before Dec. thereof.
Roll & Win Advertisement written by WMS Gaming, wmsgaming.com, printed Jun. 8, 2001.
Roamin Rhinos™ Video Slots, Gaming Machine Description printed from http://www.igt.com/GamingGroup/Games/game_detail.asp?toggle=ovr&pid=5.113.120&type_id=2374&pl=#cnt, published in 2002.
Slot Machines Article by Marshall Fey, published 1983, 1989, 1991, 1994 and 1997.
Slot Machine Buyer's Handbook, A Consumer's Guide to Slot Machines [In Part] written by David L. Saul and Daniel R. Mead, published 1998, on or before Dec. thereof.
Slot Machines A Pictorial History of the First 100 Years, 5th edition [In Part], written by Marshall Fey, published 1983 to 1997, on or before Dec. thereof.
Slot Machines On Parade [In Part] written by Robert N. Geddes and illustrated by Daniel R. Mead, published 1980, on or before Dec. thereof.
South Park—Dodgeball Advertisement written by IGT, published in 2000, on or before Dec. thereof.
Spam Article written by IGT, published in 2002, on or before Dec. thereof.
Spell Binder Advertisement written by IGT, published in 2000, on or before Dec. thereof.
Spin Till You Win Game Description written by IGT, published in 1996.
Stars, Bars and Bones Game Description written by P&M Coins, Inc. available 1997, on or before Dec. thereof.
Super Cherry Advertisement written by International Game Technology in 2001.
Symbol Feature Description in Australian UFO Gaming Machine written by Barcrest Ltd., published in 1995.
Take Your Pick Advertisement written by IGT/Anchor Gaming, published in 1999, on or before Dec. thereof.
Take Your Pick Article written by Strictly Slots, published in Mar. 2001.
Texas Tea Advertisement written by IGT, published in 2000, on or before Dec. thereof.
The Basics of Winning Video Poker (Chapter VI Deuces Wild & Chapter VII Jokers Wild) written by J. Edward Allen, published in 1990.
The Creation of Q*Bert written by Warren Davis, [online] [retrieved from the Internet Mar. 12, 2002] <URL: http://www.coinop.org/features/qbstory.html>.
The History of Q*Bert written by Jeff Lee, [online] [retrieved from the Internet Mar. 12, 2002] <URL: http://users.aol.com/JPMLee/qbert.htm>.
The Latest Buzz Article written by Bally Gaming Systems, published in Fall 2000.
Top Cat Brochure written by WMS Gaming, Inc., published prior to 2001.
Top Dollar Brochure written by IGT, published in 1998, on or before Dec. thereof.
Treasure Tunnel, Treasure Wheel Brochure written by Sigma Game, Inc., published prior to 2001.
Vision Series™/Good Times™ written by IGT, published in 1999.
Wheel Poker Article written by Strictly Slots (Anchor Games), published in Nov. 2000.
Wild Bear Salmon Run Advertisement written by IGT, published in 2003.
Wild Streak Advertisement written by WMS Gaming, Inc., published in 2001.
Winning Streak Web Site Description written by WMS Gaming Inc. (web site), printed on Mar. 21, 2001.
X Factor Brochure and Website Page written by WMS Gaming, Inc., published in 1998.
Yahtzee Bonus Advertisement, written by M. Kohn Winning Solutions Worldwide, published 1999, on or before Dec. thereof.
Yahtzee Video Game Advertisement, written by Mikohn Winning Solutions Worldwide, published 1999.
Your Real Key to Gaming Success Advertisement (including Roll Over Beethoven and Wild Fortune) written by Olympic Video Gaming, published date unknown.
Williams Jackpot Stampede Deluxe Slot Machine Dotmation game description, written by WMS, printed from http:// www.pinrepair.com/slots/wms/jackstam.htm on Jun. 30, 2009, available in 1998.
Williams Jackpot Stampede Slot Machine game description, written by WMS, printed from http://www.pinrepair.com/slots/wms/jpstamp.htm on Jun. 30, 2009, available in 1995.

* cited by examiner

| SYMBOL COMBINATION | AWARD |
|---|---|
| AAA | 10,000 |
| BBB | 1000 |
| CCC | 500 |
| DDD | 100 |
| EEE | 75 |
| FFF | 50 |
| GGG | 25 |
| HHH | 10 |
| WILD WILD WILD | 10 |
| ◇ ◇ ◇ | 5 |

FIG. 4A

| | PROBABILITY OF A SYMBOL ON | PROBABILITY OF A SYMBOL ON | PROBABILITY OF A SYMBOL ON | PROBABILITY |
|---|---|---|---|---|
| SYMBOL COMBINATION | REEL 1 | REEL 2 | REEL 3 | TOTAL |
| AAA | 1/20 | 1/20 | 1/20 | 1/8000 |
| BBB | 1/20 | 1/20 | 1/20 | 1/8000 |
| CCC | 1/20 | 1/20 | 1/20 | 1/8000 |
| DDD | 1/20 | 1/20 | 1/20 | 1/8000 |
| EEE | 1/20 | 1/20 | 1/20 | 1/8000 |
| FFF | 1/20 | 1/20 | 1/20 | 1/8000 |
| GGG | 1/20 | 1/20 | 1/20 | 1/8000 |
| HHH | 1/20 | 1/20 | 1/20 | 1/8000 |
| WLD WLD WLD | 1/20 | 1/20 | 1/20 | 1/8000 |
| ◇ ◇ ◇ | 1/20 | 1/20 | 1/20 | 1/8000 |
| ▭ ▭ ▭ | 10/20 | 10/20 | 10/20 | 1/8 |

FIG. 4B

| | | PROBABILITY OF A SYMBOL ON | PROBABILITY OF A SYMBOL ON | PROBABILITY OF A SYMBOL ON | PROBABILITY |
|---|---|---|---|---|---|
| SYMBOL | PROBABILITY OF THE TRIGGER SYMBOL | REEL 1 | REEL 2 | REEL 3 | TOTAL |
| A | 1/20 | | 1/9 | | 1/180 |
| B | 1/20 | | 1/9 | | 1/180 |
| C | 1/20 | | 1/9 | | 1/180 |
| D | 1/20 | | 1/9 | | 1/180 |
| E | 1/20 | | 1/9 | | 1/180 |
| F | 1/20 | | 1/9 | | 1/180 |
| G | 1/20 | | 1/9 | | 1/180 |
| H | 1/20 | | 1/9 | | 1/180 |
| WLD | 1/20 | | 1/9 | | 1/180 |

GAMING DEVICE HAVING A FREE SPIN GAME INCLUDING AN ACCUMULATED MODIFIER

PRIORITY CLAIM

This application is a continuation-in-part of and claims the benefit of U.S. patent application Ser. No. 10/953,812, filed on Sep. 29, 2004 now U.S. Pat. No. 7,094,148, which is a continuation-in-part of and claims the benefit of U.S. patent application Ser. No. 10/661,443, filed on Sep. 12, 2003 now U.S. Pat. No. 7,074,127, which is a continuation-in-part of and claims the benefit of U.S. patent application Ser. No. 10/241,255, filed Sep. 11, 2002 now U.S. Pat. No. 7,056,213, the entire contents of which are incorporated herein.

This application is related to the following commonly-owned co-pending patent applications: "GAMING DEVICE HAVING A BONUS GAME WITH MULTIPLE PLAYER SELECTABLE AWARD OPPORTUNITIES," Ser. No. 10/237,207, "GAMING DEVICE WITH CHANGING WILD SYMBOLS," Ser. No. 10/956,303, "GAMING DEVICE HAVING FREE SPIN MODE WITH SYMBOL ELIMINATION," Ser. No. 10/953,818, "GAMING DEVICE HAVING A RE-TRIGGERING SYMBOL BONUS SCHEME WITH A BONUS SYMBOL ACCUMULATOR AND PLAYER SELECTION OF ACCUMULATION TOTAL," Ser. No. 10/952,656, "GAMING DEVICE HAVING WILD INDICATORS," Ser. No. 10/982,096, "GAMING DEVICE WITH WILD ACTIVATION SYMBOLS AND WILD TERMINATION SYMBOLS." Ser. No. 10/966,223, "GAMING DEVICE AND METHOD HAVING FREE ACTIVATION MODE AND FREE ACTIVATION MODE WITH FREE ACTIVATION RE-TRIGGER," Ser. No. 11/217,182, "GAMING DEVICE HAVING A PROBABILITY ENHANCING TRIGGER SYMBOL," Ser. No. 11/419,681, "GAMING DEVICE HAVING A PROBABILITY ENHANCING TRIGGER SYMBOL," Ser. No. 11/419,680, "GAMING DEVICE HAVING A FREE SPIN GAME," Ser. No. 11/459,872, "GAMING DEVICE HAVING A PROBABILITY ENHANCING TRIGGER SYMBOL," Ser. No. 11/456,016, "GAMING DEVICE INCLUDING A GAME HAVING A WILD SYMBOL RELATED AWARD," Ser. No. 11/464,347, and "GAMING DEVICE HAVING A FREE SPIN GAME," Ser. No. 11/465,734.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming device manufacturers strive to make gaming devices that provide as much enjoyment and excitement as possible. Providing a game in which a player has an opportunity to win potentially large awards or credits is one way to enhance player enjoyment and excitement.

Currently, gaming machines or devices provide games wherein a player has one or more opportunities to obtain a winning symbol combination on mechanical or video reels. The winning symbol combination may be along the same payline or on different paylines (known as a scatter pay). By providing gaming devices with more winning symbol combinations, players have more opportunities to receive an award.

In known gaming devices, however, the probability of obtaining the largest award (i.e., the jackpot award) is typically much lower than the probability of obtaining the other awards in a game. Thus, although a player may obtain more awards in a game, these awards are generally the relatively small awards and not the relatively large awards such as the jackpot award.

Many jurisdictions have regulations that prohibit changing the probability of occurrence associated with the reel symbols. This makes it more difficult to create bonus or secondary games with high payouts using the base game reels and reel symbols.

Gaming devices that increase the probability of obtaining the relatively large award and specifically, the jackpot award, are desirable. To increase player enjoyment and excitement, it is desirable to provide new games and gaming devices which increase the likelihood or probability that the player will obtain one or more relatively large awards in a game.

SUMMARY

One embodiment of the present invention is directed to a gaming device including an award mode and a re-initiation mode of a primary game or bonus game where the probability of obtaining an award or an outcome and, specifically, a relatively large award increases when the player enters the award mode or the re-initiation mode of the bonus game.

In one embodiment, the gaming device includes a plurality of reels, each having a plurality of symbols. These symbols include a plurality of award symbols, at least one non-award symbol or null symbol or blank, at least one trigger symbol or symbol combination, and at least one wild symbol. One or more paylines are associated with the reels to indicate symbols or symbol combinations on the reels which are evaluated for winning symbol combinations. The symbols may be any suitable symbols such as letters, numbers, characters or any other suitable images. The award mode also includes a triggering event which, in one embodiment, includes a trigger symbol occurring on the reels. In one embodiment, the triggering event occurs when the trigger symbol is indicated on a designated reel on one of the paylines associated with the reels. In another embodiment, the triggering event occurs when the trigger symbol occurs on any of the paylines.

In a primary game, the gaming device initiates the award mode when the triggering event occurs in the game. In the award mode, the gaming device holds the reel including the trigger symbol stationary while activating or spinning the other reels until those reels indicate a wild symbol on the payline. The gaming device then holds the reels including the wild symbols stationary while reactivating or re-spinning the reel including the trigger symbol. Thus, the award mode effectively reduces the game to a single reel game where only one of the award symbols on the reel indicates a winning symbol combination in the award mode.

In the award mode, the gaming device re-activates or re-spins the reel including the trigger symbol until one of the award symbols is indicated on the payline on that reel. For instance, if a non-award or null symbol, or the trigger symbol is indicated on the payline in the award mode, the gaming device re-spins the reel until one of the award symbols or the wild symbol is indicated on the payline. The null symbols and the trigger symbol do not provide an award to the player in the award mode but, instead, cause the gaming device to re-spin the reels. Therefore, the player is guaranteed to receive one of the award symbols or the wild symbol in the award mode before the award mode ends. Reducing the number of symbols that may be indicated on the payline to end the game, increases the probability that any one of the award symbols will be indicated on the payline. The gaming device then provides the award associated with the indicated award symbol or the indicated award symbol combination to the player. The award is added to the player's total award in a total award display and the bonus mode ends. In another embodiment, the player continues to re-activate the reels in the award mode if the player has spins remaining in the award mode.

The gaming device of one embodiment of the present invention effectively reduces the game to a single reel game or event which increases the probability or chance that a player will obtain an award in the award mode and, specifically, that the player will obtain a relatively large award such as a jackpot award in the award mode. For example, in a three-reel slot game, if each of the reels in the game includes twenty symbols including the trigger symbol, wild symbol, and non-award or null symbols, the probability or chance of obtaining an award symbol combination in that game is (1/20)×(1/20)×(1/20) or 1 in 8000.

In the award mode the game is reduced to a single reel game as described above. Therefore, the probability of obtaining an award symbol (or symbol combination) in the award mode significantly increases. The probability is determined by multiplying the probability of the trigger symbol being indicated in the primary game (i.e., 1 in 20) by the probability of indicating one of the award symbols occurring in the award mode (i.e., 1 in 9). Therefore, the probability of one of the award symbols (or symbol combinations) being indicated in the game (through the award mode) is (1/20)×(1/9), which equals a probability of (1/180). Thus, it is significantly more likely that the player will obtain one of the award symbols and, therefore, a winning award symbol combination in the game through the award mode. This increases the player's excitement and enjoyment of the game because the player has a greater opportunity or probability of obtaining the relatively large award or jackpot award in the award mode.

In one embodiment, a probability of being indicated on the payline is associated with each of the symbols on the reels. In one aspect of this embodiment, the probability associated with the trigger symbol is less than the probability associated with at least one of the award symbols, null symbols and the wild symbol on the reels. In another aspect of this embodiment, the probability associated with the trigger symbol is less than a plurality of the probabilities associated with the award symbols, null symbols and the wild symbol. In a further aspect of this embodiment, the probability associated with the trigger symbol is less than all of the probabilities associated with the award symbols, null symbols and the wild symbol in the game.

Similarly, in another embodiment, the award symbols include one relatively large award and several relative small awards. In this embodiment, a probability of being indicated on the payline is associated with the award symbols such that the probability associated with the award symbol including the relatively large award is less than at least one of the probabilities associated with the award symbols including the relatively small awards being indicated on the payline. In another embodiment, the probability associated with the award symbol including the relatively large award is less than a plurality of the probabilities associated with the award symbols including the relatively small awards. In a further embodiment, the probability associated with the award symbol including the relatively large award is less than all of the probabilities associated with the award symbols including the relatively small awards.

In a further embodiment, the award mode of the present invention includes an award associated with a winning symbol combination including all wild symbols. In this embodiment, if the award mode is initiated and a wild symbol is indicated on the payline associated with the reels, in combination with the other wild symbols indicated on the payline, the gaming device provides the maximum or largest award in the game, such as the jackpot award. In another embodiment, the gaming device provides a predetermined award associated with a winning symbol combination including wild symbols in the game.

It should be appreciated that although the present application primarily discusses a trigger symbol, a combination of symbols (i.e., a trigger symbol combination) could be employed to trigger the award mode. It should also be appreciated that the trigger symbol could function as a wild symbol and one of the other reels could be re-activated.

In an alternative embodiment of the present invention, the probability-enhancing symbol includes a wild symbol which re-initiates or extends a bonus game. When a wild symbol occurs on at least one of a plurality of reels or designated reels, the gaming device locks, fixes, or holds stationary the position of the reel displaying the wild symbol and re-activates only the designated reels. The gaming device proceeds to hold stationary any designated reel displaying a wild symbol. As each reel displaying a wild symbol is held, the probability of obtaining a wild symbol on all of the designated reels is enhanced.

In one embodiment, the gaming device includes a plurality of reels, each having a plurality of symbols. The reels may be mechanical or video reels and include several symbols. In one embodiment, in addition to at least two wild symbols on separate or different reels, the symbols include a plurality of award symbols and at least one non-award symbol or null symbol or blank. The symbols may be any suitable symbols such as letters, numbers, characters or any other suitable images.

One or more paylines are included in the display to indicate symbols or symbol combinations on the reels which are evaluated for winning symbol combinations. It should be appreciated that any suitable number of paylines may be employed in the game.

A plurality of awards are associated with the award symbols or combination of award symbols according to a paytable. If an award symbol or combination of award symbols has an associated award and is indicated on an activated payline, the gaming device provides the associated award or awards in each spin of the reels. In one embodiment, no award is associated with a null symbol.

In one embodiment, the game play includes providing one or more free spins of the reels to the player. A "spins remaining" display indicates the number of spins remaining in a game. The number of free spins may be randomly determined, predetermined, determined by a wager made by a player, or determined according to any suitable method. In each spin, the gaming device determines the award, if any, associated with any indicated award symbols on the reels as discussed above.

The gaming device, in one embodiment, provides the player with a total award in each of the spins where the total award is based on the award and/or modifiers associated with the award symbols indicated in each spin. The total award in each of the spins is added to the player's total award indicated in the total award display. The gaming device or the player continues to spin the reels until there are no spins remaining. The gaming device then provides the player with the total award indicated in the total award display at the end of the game.

In one embodiment, upon a triggering event in a base game or bonus game, the player enters a game-extending or bonus game-extending or re-initiation mode. In one embodiment, the re-initiation mode is triggered when a wild symbol is displayed on one of the designated reels or paylines. In one embodiment, the wild symbol occurs when the wild symbol is indicated on a designated reel on one of the paylines associated with the reels. In another embodiment, the wild symbols occurs on the reels when the wild symbol is indicated on any of the paylines. In a further embodiment, the wild symbol occurs on a designated reel if the wild symbol is generated at any displayed position on the reel. Thereafter, in one embodiment of the re-initiation mode, certain designated reels undergo a predetermined number of spins to determine if the player will continue in the base or bonus game.

In the re-initiation mode, the gaming device holds stationary or fixes the position of the reel(s) which include wild symbols. The gaming device concurrently, either simultaneously or sequentially, activates or spins the other designated reels a predetermined or accumulated number of free spins or until a wild symbol is displayed on the reels or indicated on a payline. Alternatively, the gaming device re-activates or re-spins any of the reels not displaying a wild symbol including, non-designated reels. If wild symbols are generated and displayed on each of the designated reels or paylines within the predetermined number of spins, the gaming device re-initiates the bonus game. In another embodiment, if the player has spins remaining in the re-initiation mode, the gaming device continues to re-activate the non-designated reels in the re-initiation mode to potentially increase the total award.

In one embodiment, the game reduces the number of reels on which a wild symbol must be displayed by locking or holding stationary the reel or reels that display a wild symbol as described above. Reducing the number of reels on which wild symbols must appear in order for the bonus game to be extended increases the probability that any one of the wild symbols will be indicated on the payline or reel. In one embodiment, in which fewer than the total number of reels are designated to display wild symbols to re-initiate the bonus game, the gaming device effectively reduces the game to a double or single-reel game or event. The reduction of the number of reels on which a wild symbol must be displayed increases the probability or chance that a combination of reels displaying wild symbols will occur to re-initiate the bonus game and obtain a larger award.

The probability is determined by multiplying the probability of the wild symbol being indicated on each of the reels or on the same payline of each of the reels in the bonus game. As discussed above, in a three-reel slot game, if each of the reels in the game includes twenty symbols, including one wild symbol, the probability or chance of obtaining a combination of wild symbols on the same paylines of all three reels is $(1/20)\times(1/20)\times(1/20)$ or 1 in 8000 or 0.0125%. The probability of indicating wild symbols on the same payline for two reels is for two reels is $(1/20)\times(1/20)$, which equals a probability of 1 in 400 or 0.25%, and, for one reel, 1 in 20 or 5%. Thus, it is significantly more likely that the player will obtain the combination of wild symbols required to extend the bonus game when the reels are locked upon displaying a wild symbol. This increases the player's excitement and enjoyment of the game because the player has a greater opportunity or probability of obtaining the relatively large award or jackpot award in subsequent play of the bonus game.

In one embodiment, a probability of being indicated on the payline is associated with each of the symbols on the reels. In one aspect of this embodiment, the probability associated with the wild symbols is less than the probability associated with at least one of the award symbols, and null symbols on the reels. In another aspect of this embodiment, the probability associated with the wild symbol is less than a plurality of the probabilities associated with the award symbols and null symbols. In a further aspect of this embodiment, the probability associated with the wild symbol is less than all of the probabilities associated with the award symbols and null symbols.

Similarly, in another embodiment, the award symbols include one relatively large award and several relatively small awards and have a probability of being indicated on the payline associated with the award symbols as discussed above.

In another embodiment, during the re-initiation mode, the gaming device provides a predetermined award associated with a winning symbol combination including wild symbols in the game. The wild symbol in this embodiment represents any symbol necessary to create a winning combination. For example, if a combination of three like symbols adjacent to one another on a payline generate an award, then two like symbols adjacent to a wild symbol will provide a winning combination to the player.

In a further embodiment, the re-initiation mode of the present invention includes an award associated with a winning symbol combination including a wild symbol or a combination including all wild symbols. In this embodiment, if the re-initiation mode is triggered and the wild symbols are indicated on the same payline, the gaming device provides the maximum or largest award in the game, such as the jackpot award.

Upon re-initiation of the bonus game, the gaming device resumes providing the player the award associated with any winning symbol or symbol combination indicated on the reels. It should be appreciated that the player may again be transferred to an award mode as discussed above. Any award provided to the player is added to the player's total award in a total award display, and the bonus mode continues until another wild symbol is generated on a designated reel or payline.

It should be appreciated that the present invention can be achieved with other suitable symbols besides the wild symbol.

Although the present invention is described with respect to a free spins game or a bonus game in certain embodiments, it should be appreciated that the present invention may be employed as a primary game, or bonus game or any other suitable type of game in a wagering gaming device. Additionally, although the present invention is described with respect to a reel type game, it should be appreciated that the present invention may be employed in any suitable non-reel type games such as a video poker game.

It should thus be appreciated that in one embodiment, the present invention provides a gaming device including a primary game operable upon a wager by a player, and a triggering event associated with the primary game. After the triggering event occurs, a generation of one or more symbols occurs without an additional wager by the player. The player is provided any award associated with any of the generated symbols from the generation. This generation and award process is repeated until a designated symbol or symbol combination occurs. In one embodiment, there is a limit to the number of generations. Other embodiments do not include a pre-set limit. After the designated symbol or symbol combination occurs, a subsequent event occurs. The result of the subsequent event is either a non-terminating result or a terminating result. In one embodiment, the terminating result (such as the failure to generate a designated number of symbols such as designated or wild symbols) and the non-terminating result (such as the generation of a designated number of designated or wild symbols). If the non-terminating result occurs, the generation and award process begins again. If the terminating result occurs, the generation and award process does not begin again and the game ends.

In one further embodiment, the gaming device includes a game operable upon a wager by a player, a plurality of reels in the game, a plurality of symbols on the reels, and a triggering event associated with the generation of one or more designated symbols on the reels. After the triggering event occurs, a generation of a plurality of the symbols occurs on the reels without an additional wager by the player. The player is provided any award associated with any winning combinations of generated symbols on the reels from the generation. The generation and award steps are repeated until a designated symbol or symbol combination occurs on the reels. If the designated symbol or symbol combination occurs, a subsequent event occurs, wherein the result of that event is either a terminating result or a non-terminating result are based on the number of designated symbols generated in said event. If the non-terminating result occurs, the generation and award process begins again. If the terminating result occurs, the generation and award process does not begin again.

In a further embodiment, the gaming device includes a game operable upon a wager by a player, a plurality of reels in the game, and a plurality of symbols on the reels which include at least two designated symbols. One of the designated symbols is on each of two different reels. A triggering event is associated with the generation of one or more designated symbols on the reels. After the triggering event, a generation of a plurality of the symbols on the reels occurs without an additional wager by the player. The player is provide any award associated with any winning combinations of generated symbols on the reels from the generation. This generation and award process continues until one of the designated symbols is generated on one of the reels in the generation. If one of the designated symbols is generated on one of the reels in the generation, the position of the reel with the designated symbol is locked for a designated number of further generations of symbols on a designated number of other reels. If a non-terminating event occurs such as a designated number of other designated symbols being generated on the reels in the designated number of further generations, the reel are unlocked and the above generation and award process begins. If a terminating result occurs such as designated number of other wild symbols are not generated on the reels in the designated number of further generations, no further generations of the reels occurs until another wager is made in the game. It should be appreciated that one embodiment includes providing the player any award associated with any winning combinations of generated symbols on the reels from each further generation. In one embodiment, if one of said designated symbols is generated on one of said reels in one of the further generations, that reel is locked, and the designated number of further generations of symbols occurs on a plurality of the reels with designated symbols. In one embodiment, each reel that generates one of the designated symbols is locked for the subsequent further generations of symbols until the designated number of other designated symbols are generated on the reels or the designated number of other designated symbols are not generated on the reels in the designated number of further generations.

In an alternative embodiment of the present invention, the gaming device includes a primary game operable upon a wager. The primary game includes a plurality of reels and a plurality of symbols on the reels. In one embodiment, the symbols include at least one triggering symbol or triggering symbol combination. In another embodiment, the symbols also include at least one wild symbol. In one embodiment, the gaming device includes a free spin mode that is initiated when a triggering symbol or triggering symbol combination occurs on at least one of the reels in the primary game.

In this embodiment, when the free spin mode is initiated, the gaming device provides a player with an unlimited number of free spins without any additional wagers. In each free spin, the reels or symbol generators are activated and generate a plurality of symbols. The generated symbols are evaluated based on a paytable associated with the game. The gaming device provides an award to the player if any winning symbol combination occurs on the reels. The symbols also include at least one locking symbol and at least one coacting-terminating symbol. In one embodiment, unless the locking symbol and the terminating symbol both occur on the reels, they have no function. It should be appreciated that in other embodiments, the locking symbol and terminating symbol may have certain designated functions, even if they appear separately. In one embodiment, the free spin mode includes a free spin mode terminating event or limiting event. The free spin mode terminating event or limiting event is fulfilled upon the occurrence of at least one locking symbol and at least one terminating symbol generated on any of the reels. After the terminating event, the gaming device provides the player with a number of additional free spins or limits the further number of free spins. Any reels containing a locking symbol are held stationary for the number of additional free spins or free spins remaining. In this embodiment, the locking symbol can function as an expanding wild symbol on the reel. For example, on the stationary reels, at least one non-locking symbol may be changed into a locking symbol. In one embodiment, all of the locking symbols are wild for each of the number of additional free spins. In one embodiment, the free spin mode includes a free spin mode re-initiation event which occurs when at least one terminating symbol appears on any of the reels during any of the additional free spins.

It should thus be appreciated that in one embodiment, the gaming device includes a primary game controlled by a processor and operable upon a wager by a player, includes a plurality of reels, and a plurality of symbols on the reels including at least one triggering symbol or triggering symbol combination. The gaming device also includes a free spin mode that is initiated if the triggering symbol or triggering symbol combination occurs on at least one of the reels in the game. The free spin mode includes an unlimited number of free spins without an additional wager by the player. An award is provided to the player when any winning symbol combination occurs on the reels. The symbols include at least one locking symbol and at least one terminating symbol. The free spins mode includes a free spin mode terminating event, which is triggered upon the occurrence of at least one locking symbol and at least one terminating symbol on the reels. After the free spin mode terminating event, one, a plurality or all of the reels which generated the locking symbol are held stationary, one, a plurality or all of the locking symbols are designated wild, and the player is provided with at least one additional free spin.

In one alternative embodiment, the free spins mode includes a free spin mode re-initiation event. The re-initiation event can occur after the terminating event and includes the re-occurrence of at least one terminating symbol during any of the additional free spins. After the re-initiation event has occurred, the gaming device re-initiates the unlimited free spin mode.

In another alternative embodiment, when the unlimited free spin mode is initiated, the gaming device provides a player with an initially unlimited number of free spins or free activations without any additional wagers. In each of these free spins or free activations, a plurality of reels or other symbol generators are activated and generate a plurality of symbols. An award is provided to the player when any winning symbol combination occurs in each free spin or free activation of the reels. The symbols include at least one locking symbol, which is associated with an unlimited free spin mode terminating event. In one embodiment, the unlimited free spin mode terminating event is triggered upon the occurrence of the locking symbol on one of the reels. In other embodiments, the unlimited free spin mode terminating event is triggered by a plurality of locking symbols occurring on the reels, one or more locking symbols occurring on one or more designated reels or any suitable combination of locking symbols on the reels.

After the unlimited free spin mode terminating event occurs on the reels (i.e., the locking symbol is indicated by one of the reels), the gaming device provides a designated number of additional free spins or free activations of the reels to the player. In one embodiment, the designated number of additional free spins or free activations includes at least one additional free spin or free activation of the reels. In another embodiment, the designated number of additional free spins or free activations includes a plurality of additional free spins or free activations of the reels. The gaming device locks or holds the reel indicating the locking symbol stationary for one or more of the additional free spins or free activations of the reels. In one embodiment, a designated number of additional free spins such as five additional free spins of the reels is provided to the player after the unlimited free spin mode terminating event occurs. It should be appreciated that the number of additional free spins or free activations provided to the player may be randomly determined, predetermined, determined based on a wager made by the player or determined based on any suitable determination method.

As described above, the reel indicating the locking symbol (i.e., the designated reel) is held stationary for a designated number of additional free spins or free activations of the reels. In one embodiment, the locking symbol also acts as an expanding wild symbol and changes at least one of the other symbols indicated by the designated reel to locking symbols. At least one and preferably all of the locking symbols act as wild symbols and therefore substitute for at least one of the other symbols on the reels in each of the free spins or free activations. In one embodiment, each of the non-locked reels are activated in each of the additional free spins of the reels. Alternatively, one, a plurality or all of the non-locked reels may be activated in one, a plurality or all of the additional free spins. Also, the non-locked reels may be simultaneously activated, alternately activated or activated in any suitable order for the additional free spins of the reels.

In addition to providing additional free spins or free activations to the player after the unlimited free spin mode terminating event occurs, the gaming device associates a symbol such as one of the symbols displayed on the reels, with each of the unlocked or non-locked reels. It should be appreciated that any suitable number of symbols may be associated with one or more of the non-locked reels. It should also be appreciated that one, a plurality or all of the symbols associated with the reels may be different symbols.

The gaming device enables the player to select one of the symbols associated with the reels to be the designated symbol for a number of the additional free spins or free activations provided to the player. In an alternative embodiment, the gaming device enables the player to select one of the non-locked reels and thereby select the symbol associated with the picked non-locked reel. In one embodiment, the selected symbol is the designated symbol for the remaining number of additional free spins or free activations of the reels. In another embodiment, the selected symbol is the designated symbol for a designated number of the additional free spins less than the total number of additional free spins provided to the player. It should be appreciated that the designated symbol may remain the same symbol for one, a plurality or all of the additional free spins provided to the player.

In one embodiment, the selected symbol or designated symbol determines a modifier such as a multiplier which is provided to the player for the additional free spins of the reels. More specifically, in an embodiment, the gaming device increments the modifier for each occurrence of the selected symbol on one of the non-locked reels such as the reel associated with the selected symbol. In other embodiments, the gaming device increments the modifier for each occurrence of the selected symbol or designated symbol on a plurality or all of the reels. The gaming device may also increment the modifier based on the occurrence of the selected or designated symbol on one or more designated reels. Thus, the player hopes to accumulate as many of the selected or designated symbols as possible in the additional free spins of the reels to obtain the largest possible modifier.

In an embodiment, the gaming device associates an initial value, number or amount with the modifier. As described above, the gaming device increments the initial value or amount by a designated or random amount for each of the selected symbols that appear or occur on the reel associated with the selected symbol (i.e., the designated reel). For example, the gaming device determines that the initial value or amount of the modifier is one. The player selects a heart symbol. The gaming device increments the initial value associated with the modifier by one for each occurrence of the selected symbol (i.e., the heart symbol) on the designated reel in the additional free spins or free activations of the reels. It should be appreciated that the gaming device may increment the modifier by a random amount, a predetermined amount, an amount based on a wager made by the player or any suitable amount or value determined in any suitable manner.

In each of the additional free spins of the reels, the gaming device evaluates all of the symbols displayed by the reels to determine if any winning symbol combinations occurred on the reels. Additionally, the gaming device determines if one or more of the selected symbols are indicated by the designated reel. In one embodiment, the gaming device increments the modifier or multiplier for each occurrence of the selected symbol on the designated reel. When there are no additional free spins remaining, the gaming device uses the total or final modifier to modify any awards obtained by the player in the additional free spins. Thus, the accumulation of the selected symbols enables the player to obtain a relatively large modifier in the game and potentially a relatively large award in the game, which adds excitement and enjoyment for the player.

In another alternative embodiment, at least one accumulated symbol display is associated with one of the non-locked or unlocked reels. The accumulated symbol display displays or indicates the total or accumulated number of the selected symbols occurring on one or more of the reels. For example, the accumulated symbol display associated with the first reel of a set of reels displays the total number of the selected symbols occurring on that reel in the additional free spins of the reels. The accumulated symbol display therefore helps the player to know how many times the selected symbol occurred on a specific reel or reels in the additional free spins.

In a further alternative embodiment, an accumulated symbol display is associated with each of the unlocked or non-locked reels. In this embodiment, the accumulated symbol displays enable a player to see how many times the selected symbol occurred on one, a plurality or each of the reels in the additional free spins of the reels. Thus, the player can compare the numbers displayed by the accumulated symbol displays to analyze their selection. It should be appreciated that any suitable number of accumulated symbol displays may be associated with one, a plurality or all of the reels. It should also be appreciated that the one or more of the accumulated symbol displays may be displayed on the same display device, a separate display device or any combination of display devices.

It is therefore an advantage of the present invention to provide a gaming device that provides an increase probability of obtaining awards in a game.

Another advantage of the present invention is to provide a gaming device that increases the probability of obtaining a relatively large award in a game.

It is a further advantage of the present invention to provide a gaming device that increases the probability of obtaining the jackpot award in a game.

It is a further advantage of the present invention to provide a gaming device that increases the probability of extending the bonus game in a game.

Other objects, features and advantages of the invention will be apparent from the following detailed disclosure, taken in conjunction with the accompanying sheets of drawings, wherein like numerals refer to like parts, elements, components, steps and processes.

BRIEF DESCRIPTION OF THE DRAWINGS

FIG. 4A is probability table illustrating the probability of each of the symbols being indicated on each of the reels in a primary game.

FIG. 4B is probability table illustrating the probability of each of the symbols being indicated on each of the reels in an award mode.

DETAILED DESCRIPTION

Gaming Device and Electronics

Figure 1A:
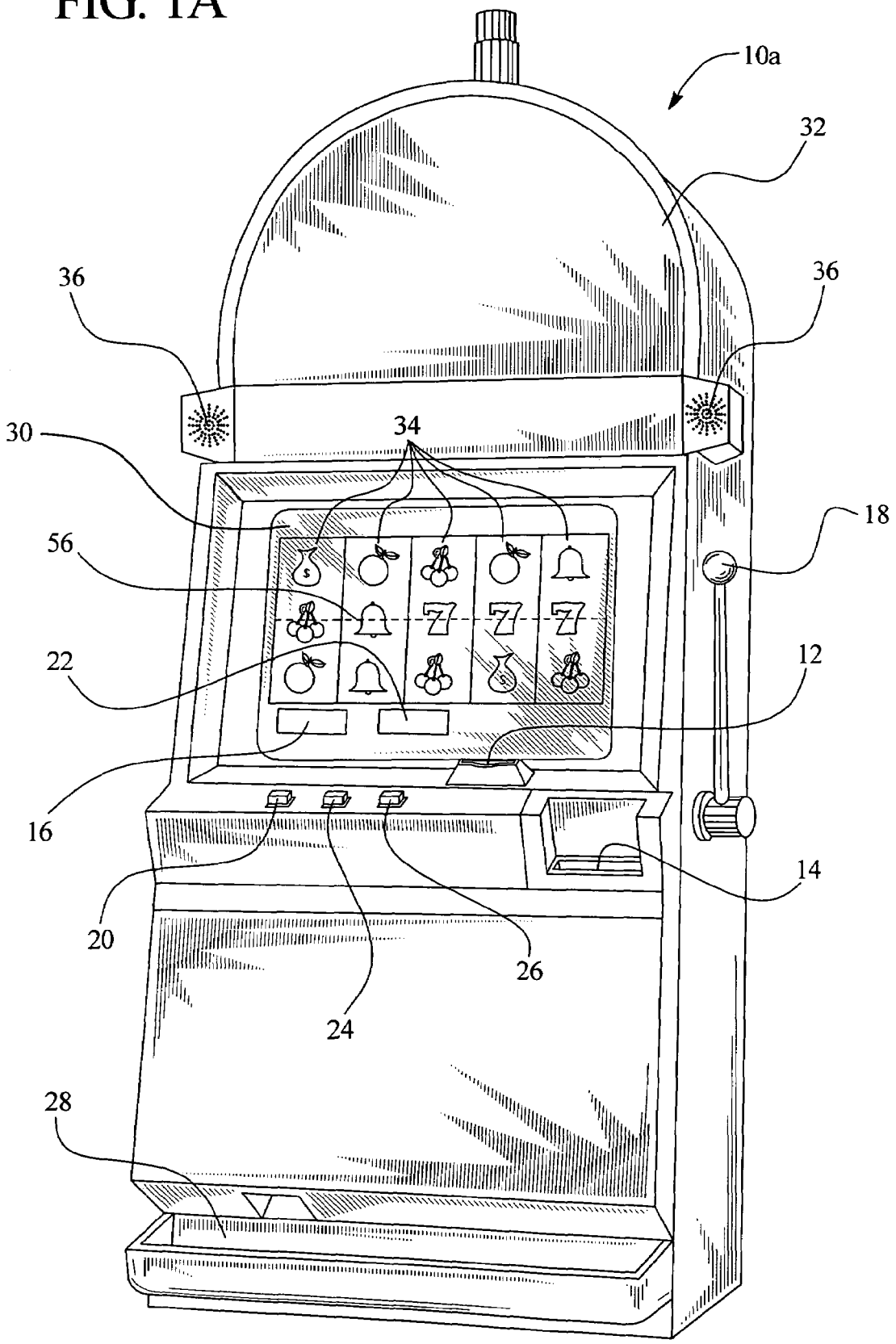
FIG. 1A is a front perspective view of one embodiment of the gaming device of the present invention.
Figure 1B:
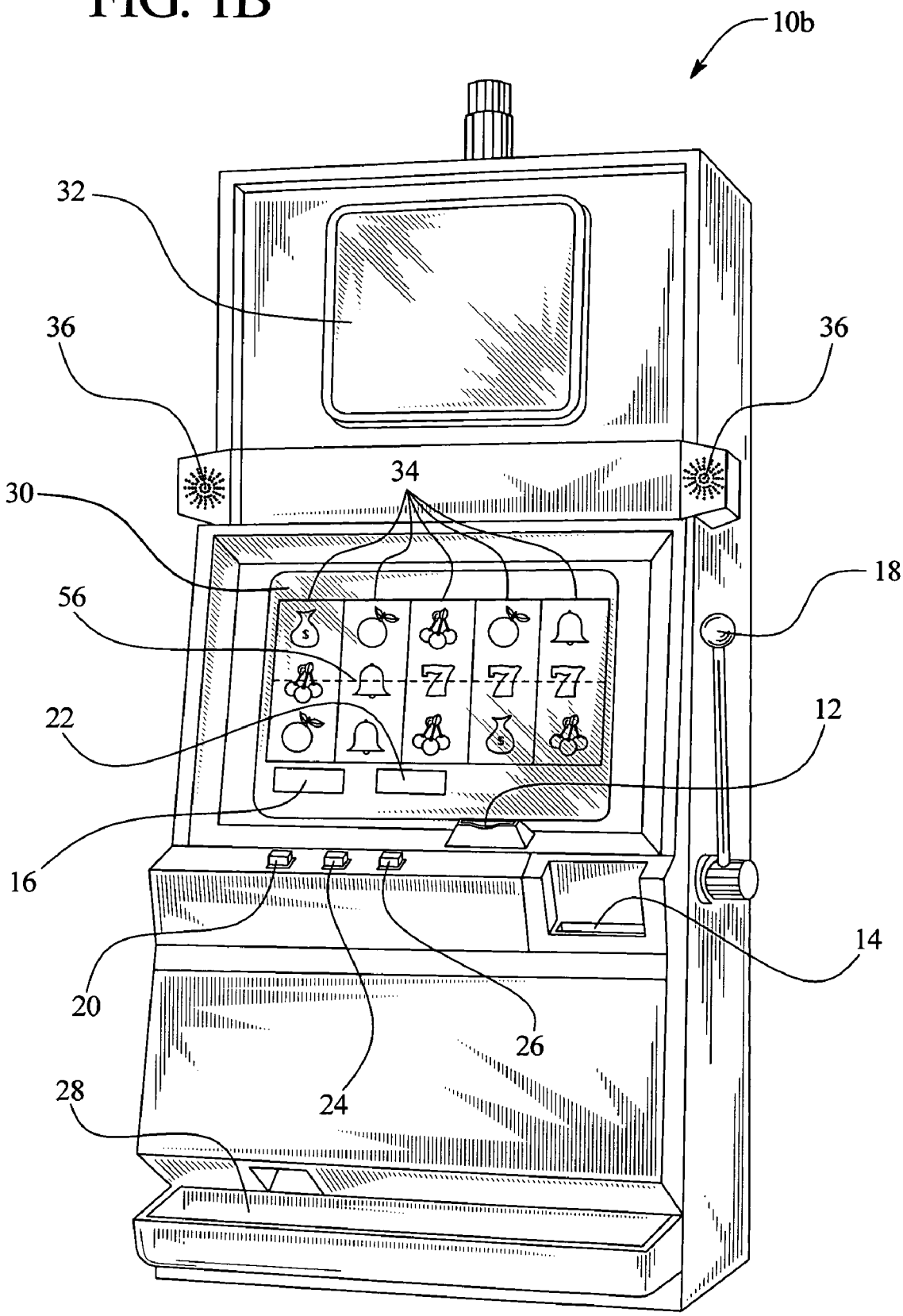
FIG. 1B is a front perspective view of another embodiment of the gaming device of the present invention.

Referring now to the drawings, two embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10. Gaming device 10 in one embodiment has the controls, displays and features of a conventional slot machine. It is constructed so that a player can operate it while standing or sitting, and gaming device 10 is preferably mounted in a cabinet. However, it should be appreciated that gaming device 10 can be constructed as a pub-style table-top game (not shown) which a player can operate preferably while sitting. Furthermore, gaming device 10 can be constructed with varying cabinet and display designs, as illustrated by the designs shown in FIGS. 1A and 1B. Gaming device 10 can also be implemented as a program code stored in a detachable cartridge for operating a hand-held video game device. Also, gaming device 10 can be implemented as a program code stored on a disk or other memory device, which a player can use in a desktop or laptop personal computer or other computerized platform.

Gaming device 10 can incorporate any primary game such as slot, poker, blackjack or keno, and any of the bonus triggering events and bonus games associated with these primary games. The symbols and indicia used on and in gaming device 10 may be in mechanical, electrical, electronic or video form.

As illustrated in FIGS. 1A and 1B, gaming device 10 includes a coin slot 12 and bill acceptor 14 where the player inserts money, coins or tokens. The player can place coins in the coin slot 12 or paper money or ticket vouchers in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player, which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one. Other bet or wager indicators such as a bet max button may also be employed in the gaming device of present invention.

A player may cash out and thereby receive a number of coins corresponding to the number of remaining credits by pushing a cash out button 26. When the player cashes out, the player receives the coins in a coin payout tray 28. The gaming device 10 may employ other payout mechanisms such as credit slips redeemable by a cashier or electronically recordable cards which keep track of the player's credits.

Gaming device 10 also includes one or more display devices. The embodiment shown in FIG. 1A includes a central display device 30, an upper display device 32, and the alternative embodiment shown in FIG. 1B includes a central display device 30 as well as an upper display device 32. Gaming device 10 in one embodiment displays a plurality of reels 34 such as three to five reels 34 in mechanical or video form at one or more of the display devices. A display device can be any viewing surface such as glass, a video monitor or screen, a liquid crystal display or any other display mechanism. If the reels 34 are in video form, the display device for the video reels 34 is preferably a video monitor. Each reel 34 displays a plurality of indicia such as bells, hearts, fruits, numbers, letters, bars or other images which preferably correspond to a theme associated with the gaming device 10. Furthermore, gaming device 10 preferably includes speakers 36 for producing sounds such as music.

Figure 2:
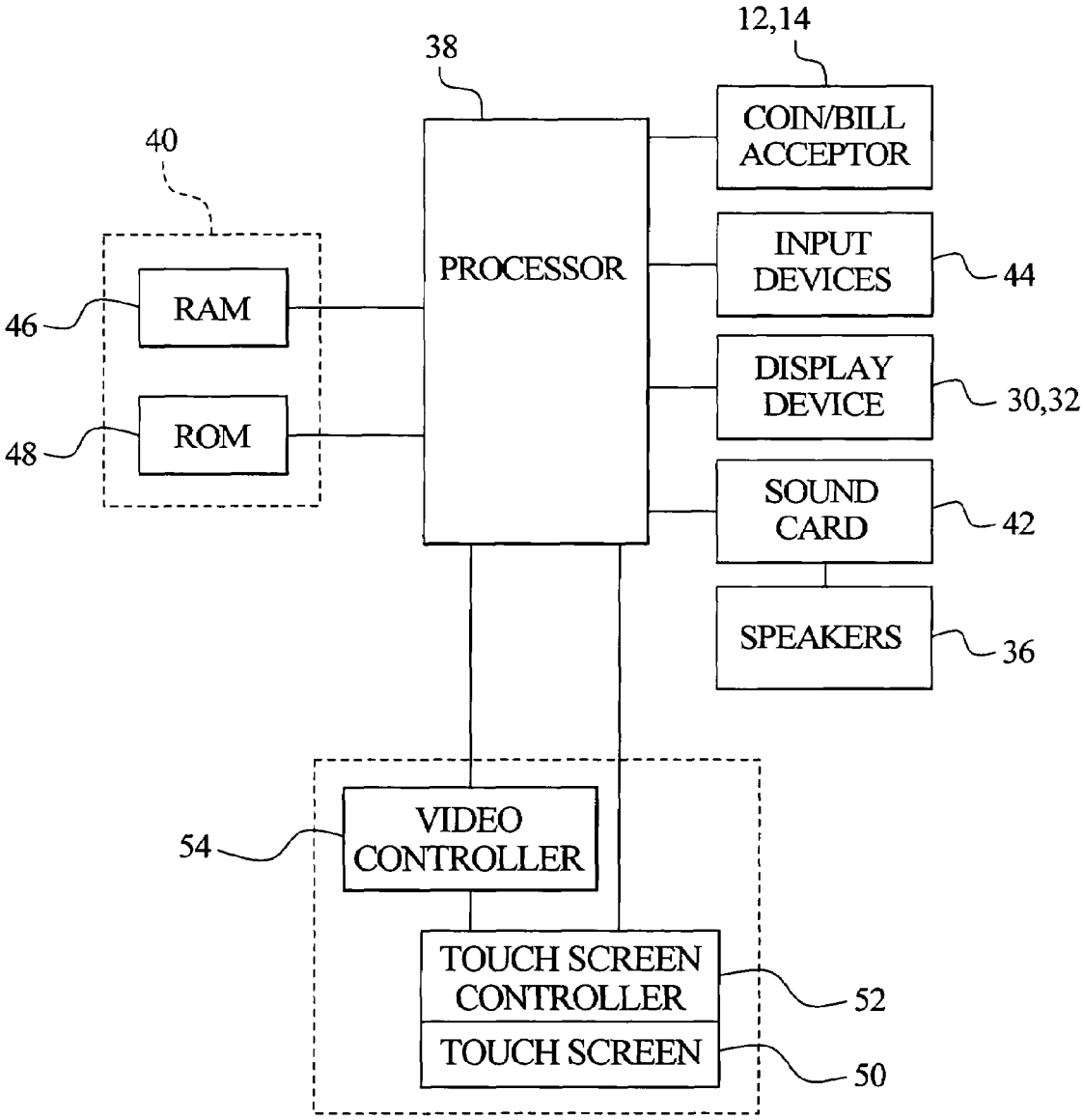
FIG. 2 is a schematic block diagram of the electronic configuration of one embodiment of the gaming device of the present invention.

As illustrated in FIG. 2, the general electronic configuration of gaming device 10 preferably includes: a processor 38; a memory device 40 for storing program code or other data; a central display device 30; an upper display device 32; a sound card 42; a plurality of speakers 36; and one or more input devices 44. The processor 38 is preferably a microprocessor or microcontroller-based platform which is capable of displaying images, symbols and other indicia such as images of people, characters, places, things and faces of cards. One or more secondary processors may also be employed in conjunction with the primary processor to control certain aspects of the game function. The memory device 40 can include random access memory (RAM) 46 for storing event data or other data generated or used during a particular game. The memory device 40 can also include read only memory (ROM) 48 for storing program code which controls the gaming device 10 so that it plays a particular game in accordance with applicable game rules and pay tables.

As illustrated in FIG. 2, the player preferably uses the input devices 44, such as pull arm 18, play button 20, the bet one button 24 and the cash out button 26 to input signals into gaming device 10. In certain instances it is preferable to use a touch screen 50 and an associated touch screen controller 52 instead of a conventional video monitor display device. Touch screen 50 and touch screen controller 52 are connected to a video controller 54 and processor 38. A player can make decisions and input signals into the gaming device 10 by touching touch screen 50 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively or alternatively referred to herein as a "processor"). Furthermore, although the processor 38 and memory device 40 preferably reside on each gaming device 10 unit, it is possible to provide some or all of their functions at a central location such as a network server for communication to a playing station such as over a data network such as a local area network (LAN), wide area network (WAN), Internet connection, microwave link, and the like. The processor 38 and memory device 40 are generally referred to herein as the "computer" or "controller."

With reference to FIGS. 1A, 1B and 2, to operate the gaming device 10, in one embodiment the player must insert the appropriate amount of money or tokens at coin slot 12 or bill acceptor 14 and then pull the arm 18 or push the play button 20. The reels 34 will then begin to spin. Eventually, the reels 34 will come to a stop. As long as the player has credits remaining, the player can spin the reels 34 again. Depending upon where the reels 34 stop, the player may or may not win additional credits.

In addition to winning credits in this manner, in one embodiment gaming device 10 also gives players the opportunity to win credits in a bonus round. This type of gaming device 10 will include a program which will automatically begins a bonus round when the player has achieved a qualifying condition in the game. This qualifying condition can be a particular arrangement of indicia on a display device. The gaming device 10 may use mechanical devices or a video-based central display device 30 to enable the player to play the bonus round. In one embodiment, the qualifying condition is a predetermined combination of indicia appearing on a plurality of reels 34. As illustrated in the five reel slot game shown in FIGS. 1A and 1B, the qualifying condition could be the number seven appearing on three adjacent reels 34 along a payline 56. It should be appreciated that the present invention can include one or more paylines, such as payline 56, wherein the paylines can be horizontal, diagonal or any combination thereof.

Probability Enhancing Trigger Symbol

Referring to FIGS. 1C, 3A, 3B, 4A and 4B, one embodiment of the reels of the present invention is illustrated where three reels are employed in a game. It should be appreciated that any suitable number of reels may be employed in the primary game. In this embodiment, each of the reels 34*a*, 34*b* and 34*c* includes symbols 100, which are represented by letters A, B, C, D, E, F, G and H, non-award or null symbols or blanks 104, at least one trigger symbol 102 and at least one wild symbol 105. It should be appreciated that any suitable number and types of symbols may be employed in a game according to the present invention. Each symbol is positioned at a reel stop position or reel stop on each of the reels. Therefore, one of the symbols such as one of the award symbols, one of the null symbols, the trigger symbol or the wild symbol will be indicated on a payline in the game.

Figures 3A, 3B:
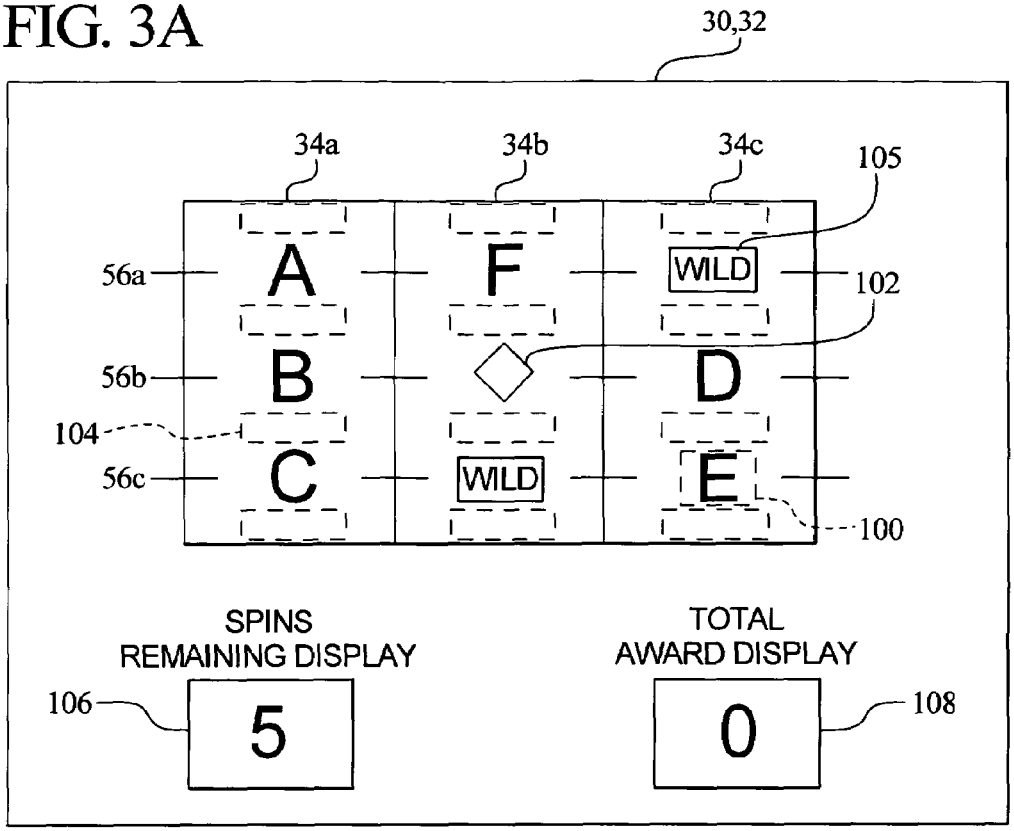
FIG. 3A is an enlarged elevation view of one of the display devices of FIGS. 1A and 1B illustrating one embodiment of the present invention.
FIG. 3B is an award table illustrating the symbol combinations and the awards associated with the symbols combinations of the embodiment of FIG. 3A.

Referring to FIG. 3A, in one embodiment the gaming device displays a plurality of reels and specifically three reels 34*a*, 34*b* and 34*c*. The reels include a plurality of symbols such as the letters A, B, C, D, E, F, G and H. The reels also include at least one trigger symbol, such as a diamond symbol 102. It should be appreciated that one or more of the reels may include at least on trigger symbol. Additionally, each of the reels includes at least one wild symbol 105 and at least one null symbol or blank 104. A probability of being indicated is associated with each of the symbols on the reels. In the primary game, the probability of each of the symbols being indicated on one of the reels is one in twenty (1/20) or 5.0% as shown in the probability table illustrated in FIG. 4A. If a triggering event occurs in the primary game, an award mode is initiated. In the award mode, the primary game is effectively reduced to a one-reel game. In addition, the null symbols 104 or blanks, and the trigger symbol, each re-spin or re-activate the reels. Thus, the effective number of symbols on the reels is reduced from twenty symbols to nine symbols, which further increases the probability that one of the symbols will be indicated on the reels. Several paylines, such as paylines 56*a*, 56*b* and 56*c* are associated with the reels. It should be appreciated that one or more paylines may be associated with the reels. A spins remaining display 106 indicates the number of spins remaining in the game. A total award display indicates the total value of the awards accumulated by the player in the game.

The gaming device provides the player with a number of spins in the game. The number of spins may be randomly determined, predetermined or determined in any suitable manner. The player uses the spins to activate or spin the reels 34*a*, 34*b* and 34*c*. The gaming device provides an award associated with one or more winning symbol combinations indicated on one of the paylines 56*a*, 56*b* or 56*c* associated with the reels. The player continues to spin the reels until the player has no spins remaining as indicated by the spins remaining display 106.

The trigger symbol or diamond symbol 102 increases the probability that the player will obtain one of the awards in the game and specifically increases the probability that the player will obtain the largest award such as the jackpot award in the game. The game preferably includes only one trigger symbol, designated as a diamond symbol 102, on one of the reels 34 in the game. In one embodiment, the middle reel 34*b*, includes the trigger symbol or diamond symbol 102. If the diamond symbol 102 is indicated on one of the paylines 56*a*, 56*b* or 56*c*, the gaming device initiates an award mode. In the award mode, the gaming device freezes or holds the reel 34*b* including the trigger symbol 102 stationary while the gaming device activates or spins the remaining reels or outside reels 34*a* and 34*c*, which are adjacent to the middle reel 34*b*. The gaming device activates or spins these reels until a wild symbol 105 is indicated on the same payline as the trigger symbol or diamond symbol 102.

Once the wild symbols 105 are indicated on reels 34*a* and 34*c* and on the same payline as the trigger symbol 102, the gaming device holds or keeps these reels stationary. The symbols on payline 56*b* are wild symbol 105*a* on reel 34*a*, trigger symbol or diamond symbol 102 on reel 34*b* and wild symbol 105*b* on reel 34*c*. The gaming device now re-spins or re-activates reel 34*b* until an award symbol 100 such as one of the letters is indicated on payline 56*b*. Any award symbol 100 indicated on that payline will provide a symbol combination having three identical symbols matching the award symbol 100 indicated on that payline. This occurs because two of the symbols on that payline are the wild symbols 105*a* and 105*b* as illustrated in FIG. 5C. Because only the middle reel 34*b* is re-activated or re-spun during the game to determine the award, the game is reduced to a one reel or single reel game. The player now only needs to obtain one award symbol to win an award in the award mode. More specifically, the player only has to spin one reel 34*b* to obtain the largest award such as the jackpot award in the game. Thus, because the award mode reduced the game to a one reel or single reel game, the probability of obtaining any of the awards, and specifically the largest award in the game, increases significantly.

In the award mode, when the middle reel 34*b* is re-activated and the trigger symbol or diamond symbol 102 is indicated on payline 56*b*, the gaming device re-spins or re-activates reel 34*b*. Thus in one embodiment, the trigger symbol or diamond symbol does not provide an award to the player in the game. In another embodiment, an award is associated with the trigger symbol and is provided to the player if the trigger symbol is indicated on the reel after the reel is re-activated in the award mode.

Similarly, if a non-award or null symbol (i.e., blank) 104 is indicated on payline 56*b* on reel 34*b*, the gaming device re-spins or re-activates reel 34*b*. Thus, a null symbol does not provide an award to the player; rather, the reels are re-spun to give the player another opportunity to obtain one of the awards in the game. Once an award symbol 100 is indicated on the designated payline on reel 34*b*, the gaming device provides an award associated with the award combination including those symbols. If the award symbol happens to be the jackpot symbol, the player obtains three of the jackpot symbols and therefore, the jackpot award in the game. The award received by the player in the game is transferred to the total award display 108 and provided to the player when the game ends. In one embodiment, the game ends when the player obtains an award in the game. In another embodiment, the game ends when the player runs out of spins as indicated by the spins remaining display 106.

In a further embodiment, the gaming device includes a modifier such as a multiplier which changes such as by increasing when the null symbol occurs on the reel. The modifier such as the multiplier is employed in one embodiment to increase the award determined by the generated symbol on the reel.

By effectively reducing the game to a single reel or one reel game, the present invention significantly increases the probability of obtaining an award in the game without changing the random probability of occurrence. In particular, the present invention increases the probability or the likelihood that the player will obtain the largest award such as the jackpot award in the game. For example, in a typical reel-type game, a player must obtain one of a plurality of designated symbol combinations on one or more of the paylines associated with a set of reels to obtain an award in the game. The gaming device or player spins the reels and the reels randomly indicate symbols on one or more of the paylines associated with the reels. If a winning symbol combination is indicated on one of the designated winning paylines in the game, the gaming device provides an award associated with that winning symbol combination. The probability of obtaining a particular symbol combination, however, is based on the number of reels in a game and the number of symbols included on those reels. Thus, the more reels and symbols in a game, the less likely or less probable it is that the player will obtain one of the winning symbol combinations in that game.

For example, a particular game of the gaming device may include three reels, such as reels 34*a*, 34*b* and 34*c* in FIG. 3A. In this example, each of the reels includes twenty reel positions, which include nine award symbols as symbols A, B, C, D, E, F, G, and H, one wild symbol, one trigger symbol and ten null symbols. In this example, the symbols must occur or be indicated on payline 56*b* to provide a winning symbol combination in the game. Thus, at the beginning of the game each symbol has a 5% (1/20) chance or probability of being indicated on payline 56*b* on each of the reels as illustrated in FIG. 4A. As a result, the overall probability that a particular symbol combination will occur on that payline is (1/20)×(1/20)×(1/20), which equals (1/8000) or 0.013%. Therefore, in this example, because each symbol has a 5% (1/20) chance or probability of being indicated on a single payline on the reels, the overall probability of a particular symbol combination occurring on that payline in the primary game (without the award mode) is (1/8000) or 0.013%.

Referring to FIG. 3B, an example of a payout or award table is illustrated. In this example, a winning symbol combination in the primary game includes three identical symbols. For instance, the jackpot award or largest award indicated on the table is the award of ten thousand associated with the symbol combination including three A symbols (i.e., A, A, A). The award associated with the other winning symbol combinations are also shown in the table. It should be appreciated that any suitable combination of symbols in a game may be designated as a winning symbol combination.

Referring to FIG. 4A, a probability table for a primary game or base game indicates the probability of each of the symbols being indicated on a payline for each reel in the three reel slot game shown in FIG. 3A. The table also indicates the probability of being indicated on a payline associated with each of the winning symbol combinations shown in FIG. 3B for each of the symbols on the reels and the probability of three null symbols or blanks being indicated on the payline. As illustrated in the table, the probability of each of the award symbols (i.e., A, B, C, D, E, F, G and H) being indicated on any one of the reels is (1/20). The probability of a winning symbol combination including one of the award symbols, the trigger symbol or the wild symbol, being indicated on the designated payline is (1/8000) (i.e., (1/20)×(1/20)×(1/20)). The probability of three null symbols or blanks being indicated on the payline is ((10/20)×(10/20)×(10/20)) or (1/8). Therefore, a player has a one in eight thousand chance in the primary game to obtain one of the winning symbol combinations, and specifically of obtaining the jackpot award in the game.

In the award mode of the present invention, the number of reels is effectively reduced to one reel or one active reel such as reel 34*b*. As a result, the probability of obtaining a particular symbol or a particular symbol combination increases significantly. Referring to FIG. 4B, a probability table illustrates the probabilities of each of the symbols being indicated on the reel in the award mode. Additionally, the table illustrates the probability of a winning symbol combination, which in the award mode is one award symbol, being indicated on the payline in the award mode. Because the trigger symbol and the null symbols cause the reel to re-spin in the award mode, the number of effective award symbols in the award mode is reduced to nine. Therefore, the probability of each of the award symbols or the wild symbol being indicated on the payline in the game (through the award mode) is (1/180), which is the probability of the trigger symbol being indicated on the payline in the primary game (1/20) multiplied by the probability of any one of the award symbols or the wild symbol being indicated on the payline in the award mode, which is (1/9). The probability of one of the award symbols or the wild symbol being indicated in the game (through the award mode) is therefore, (1/20)×(1/9) or (1/180) as shown in FIG. 4B. Accordingly, the overall probability of obtaining a specific symbol combination is (0.013% (1/8000)+0.56% (1/180) which equal 0.573%.

Referring to FIG. 3A, in one example of the award mode of the present invention, if a trigger symbol or diamond symbol 102 is indicated on payline 56*b* in a primary game, an award mode is initiated and the outside reels 34*a* and 34*c* are re-activated or re-spun until wild symbols are indicated on payline 56*b*. Then, the reels 34*a* and 34*c* are held stationary while the middle reel 34*b* is re-activated or re-spun until an award symbol is indicated on payline 56*b*. The probability or likelihood of obtaining a particular symbol combination on the reels has now increased because the player only has to obtain one award symbol on reel 34*b* in order to obtain an award in the game.

Figure 1C:
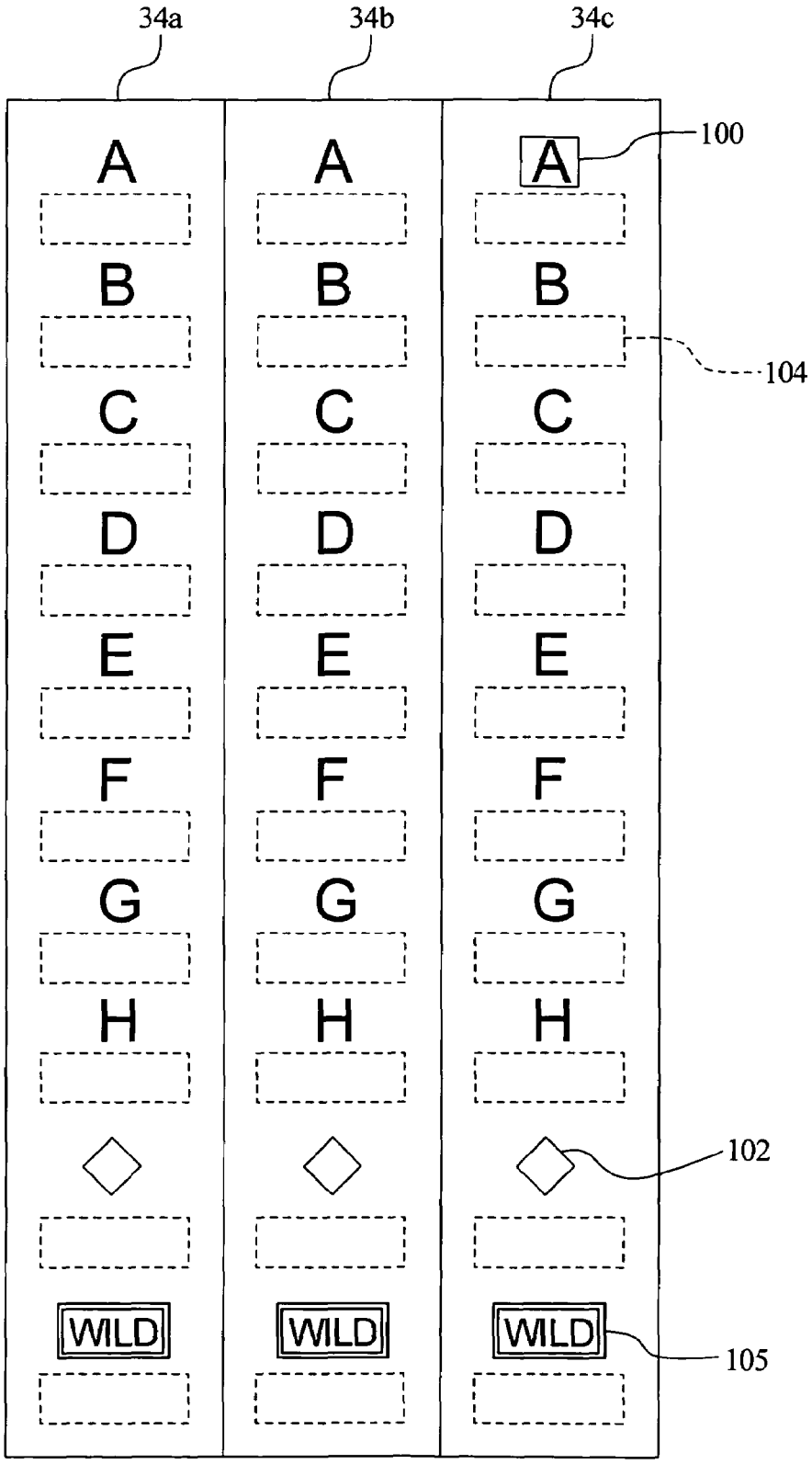
FIG. 1C is a enlarged elevation view of a set of reels and the reel stop positions included on the reels in a three reel slot game.

In this example, the middle reel 34*b* includes twenty reel positions including eight award symbols, one wild symbol, a trigger symbol or diamond symbol 102, and ten null symbols 104 as shown in FIGS. 1C and 3A. Therefore, the player initially has a one in twenty chance of obtaining the trigger symbol or diamond symbol 102 on reel 34*b* in the primary game as described above. In the award mode, if the player obtains the trigger symbol 102 or one of the null symbols 104 on payline 56*b* after the reel 34*b* is re-activated, the gaming device re-spins or re-activates reel 34*b* again until an award symbol 100 is indicated on payline 56*b*. Because the trigger symbol 102 and the null symbols 104 re-spin or re-activate the reels in the award mode, the actual number of symbols that provide an award and end the bonus mode are nine (i.e., the eight award symbols and the wild symbol). Therefore, the player has a one in nine chance of obtaining an award symbol 100 in the award mode and thereby a 11.1% chance of obtaining a winning symbol combination on payline 56*b*. As a result, the overall probability of obtaining a winning symbol combination on the reels in the award mode is determined by taking the probability of obtaining the trigger symbol or diamond symbol 102 on reel 34*b* in the initial or primary game, which is 1 in 20 (1/20), multiplied by the probability or the likelihood of one of the award symbols being indicated on payline 56*b*, which is 1 in 9 (1/9). The overall probability therefore equals (1/180) or 0.56% for obtaining any one of the winning symbol combinations on the reels in the game (through the award mode) as shown in FIG. 4B. Thus, the probability of obtaining a winning symbol combination on the reels in the primary game is 1 in 8000 or 0.013% and this probability increases to 1 in 180 or 0.56% in the award mode. This significantly increases a player's opportunities or chances of obtaining one of the awards in the game and specifically a relatively large award such as the jackpot award. This increases a player's excitement and enjoyment of the game.

Figure 5A:
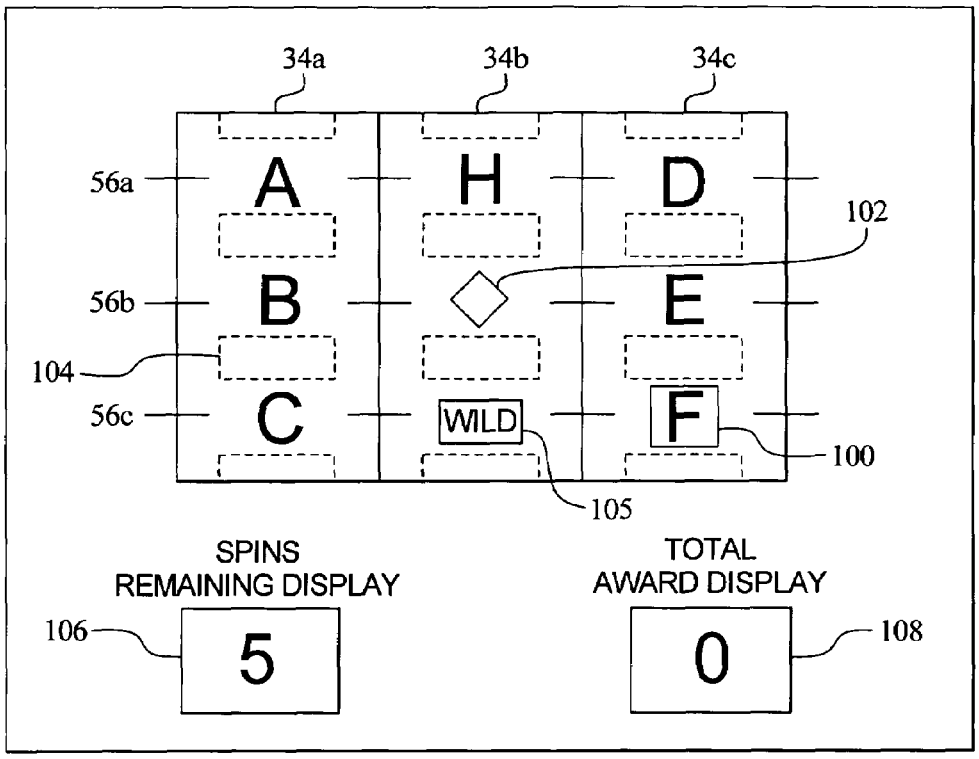
FIGS. 5A, 5B, 5C, 5D, 5E and 5F are enlarged front elevation views of an example of the embodiment shown in FIG. 3 illustrating a primary game and an award mode initiated by the occurrence of a triggering event in the primary game.
Figure 5B:
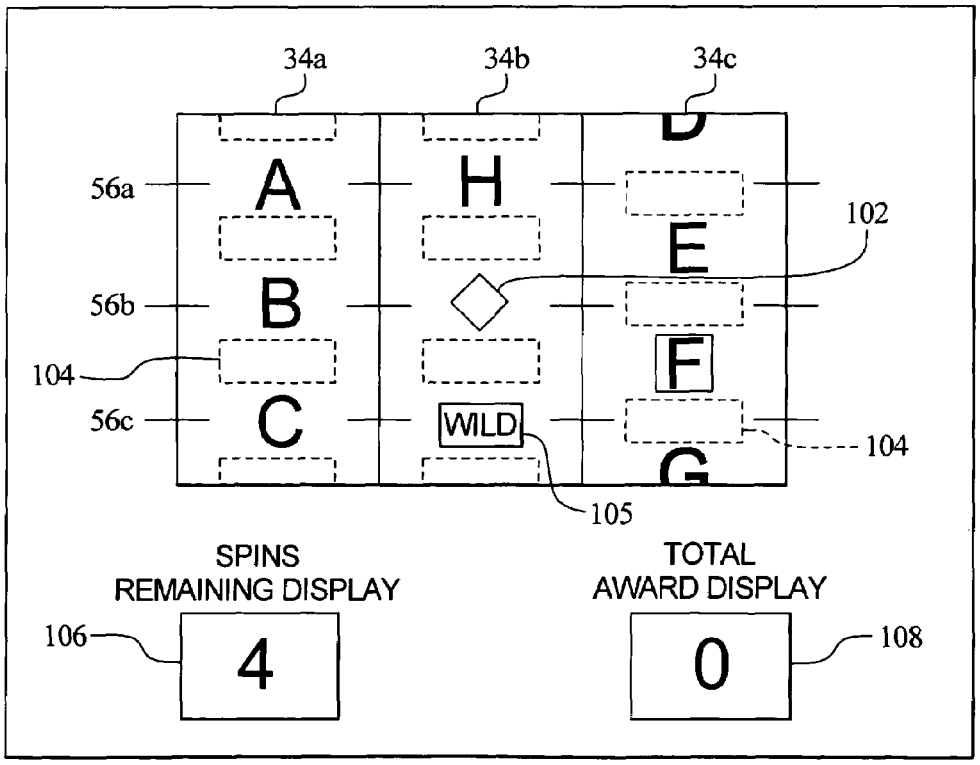
Figure 5C:
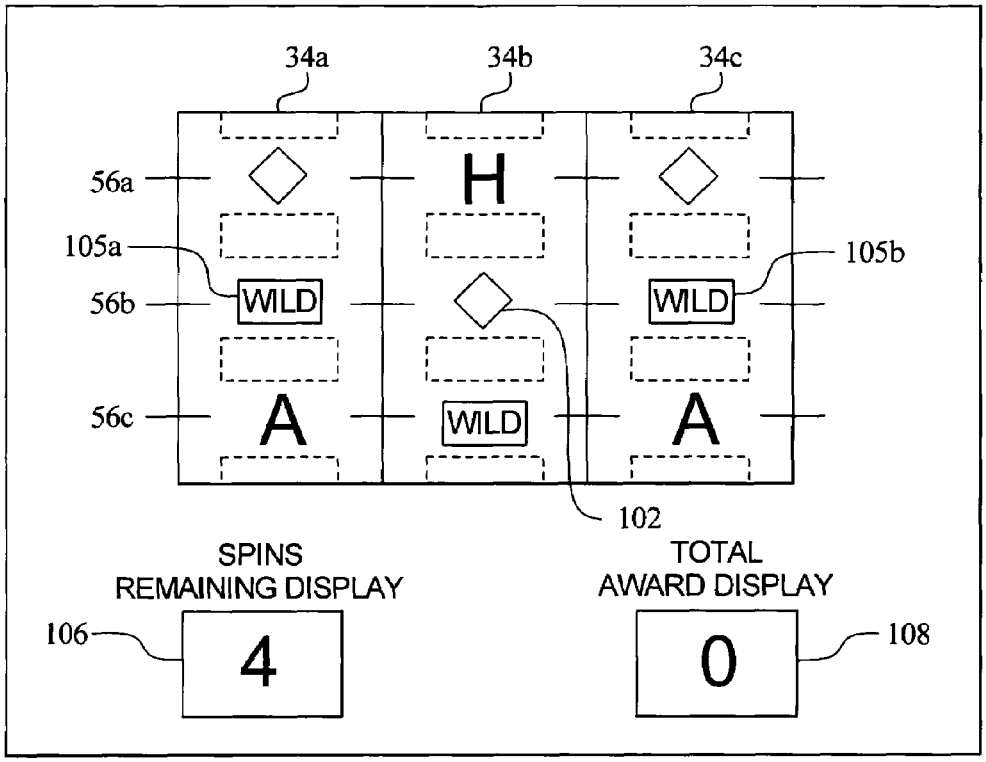

Referring to FIGS. 5A through 5F, an example of one embodiment of the present invention is illustrated where the player obtains a trigger symbol or diamond symbol 102 in the primary game or primary mode. This example includes three reels 34*a*, 34*b* and 34*c* as shown in FIG. 5A, where each reel includes a plurality of award symbols A, B, C, D, E, F, G and H, one trigger symbol designated as diamond symbol 102, one wild symbol 105 and ten null symbols 104. The player begins the game with five spins as indicated by the spins remaining display 106 as shown in FIG. 5A. Additionally, the player begins the game with an award of zero as indicated by the total award display 108. The player uses their first spin as shown in FIG. 5B to activate or spin the reels. A trigger symbol or diamond symbol 102 is indicated on payline 56*b* on reel 34*b*. The trigger symbol or diamond symbol 102 initiates the bonus mode of the present invention.

Referring to FIG. 5C, the gaming device freezes or holds reel 34*b* stationary while spinning or re-spinning the outside reels 34*a* and 34*c* until wild symbols 105*a* and 105*b*, respectively, are indicated on payline 56*b* on those reels. As indicated by the spins remaining display 106, the number of spins does not decrease when these reels are activated or re-activated to indicate the wild symbols. Additionally, the total award display 108 indicates that the player does not obtain an award for obtaining the trigger symbol (i.e., diamond symbol 102) or the wild symbols 105*a* or 105*b*. In another embodiment, the gaming device provides an award associated with the trigger symbol and/or the wild symbols.

Figure 5D:
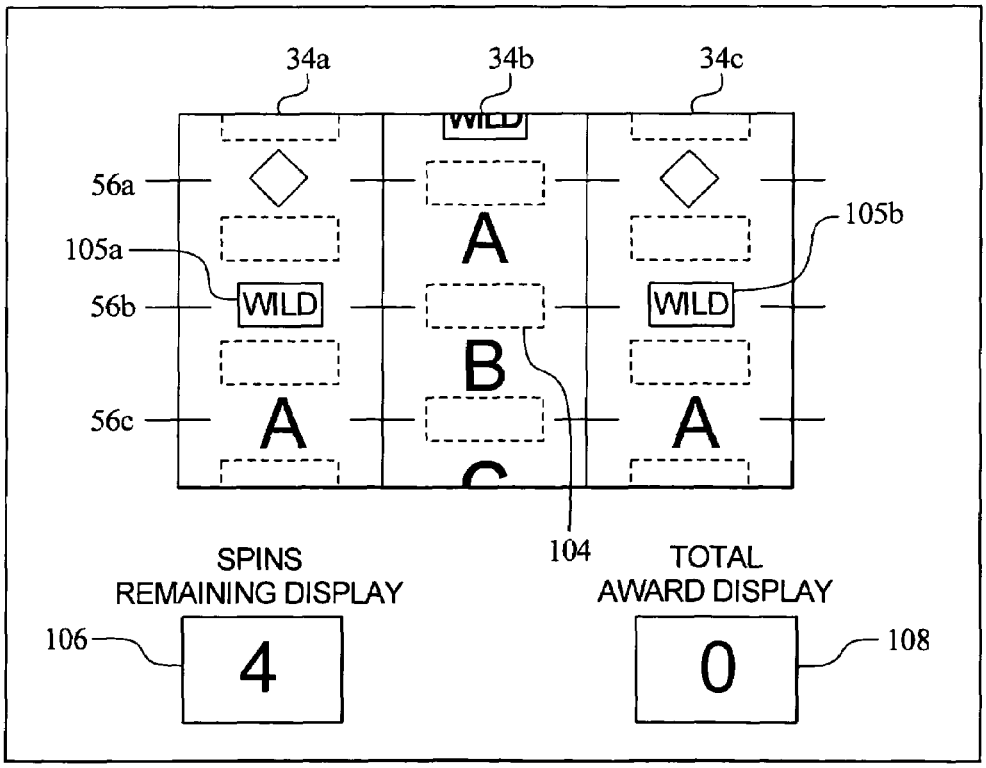

Referring to FIG. 5D, the outside reels 34*a* and 34*c* are stationary or cannot be re-activated, therefore the gaming device or player can only re-activate or re-spin reel 34*b*. In FIG. 5D the gaming device re-activates reel 34*b* and a null symbol 104 is indicated on payline 56*b*. The symbol combination of a wild symbol 105*a*, a null symbol 104 and wild symbol 105*b* on reels 34*a*, 34*b* and 34*c*, respectively, is not a winning symbol combination in the game. Therefore, the player does not receive an award for this symbol combination. However, the null symbol 104 does not end the game, but instead causes the gaming device to automatically re-spin or re-activate reel 34*b*. Thus, the null symbol 104 provides the player with another opportunity to obtain an award symbol in the game. The number of spins remaining in the award mode does not decrease as indicated by the spins remaining display 106 and the total award still remains at zero as indicated by the total award display 108.

Alternatively, as indicated above, the game upon the occurrence of the null symbol can change such as increment a modifier (such as a multiplier) which is employed to modify and preferably increase the award to the player.

Figure 5E:
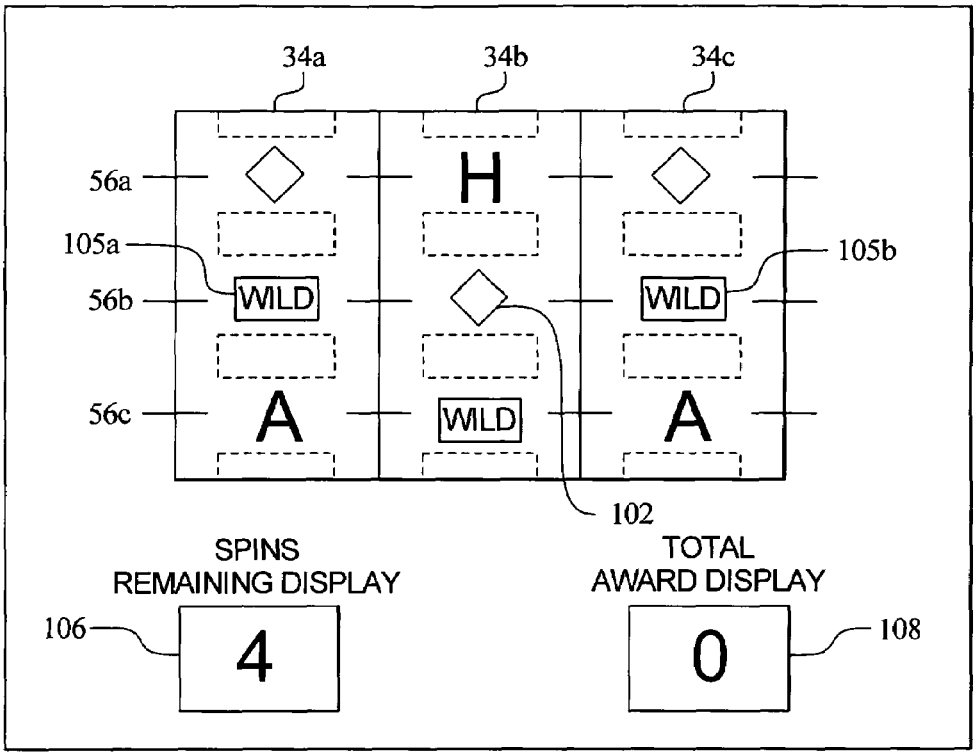

Referring to FIG. 5E, the gaming device or player re-activates reel 34*b* in the game. The trigger symbol or diamond symbol 102 is indicated on payline 56*b* on reel 34*b*. The resultant symbol combination is the wild symbol 105*a*, the trigger symbol 102 and the wild symbol 105*b*, on reels 34*a*, 34*b* and 34*c*, respectively, which is not a winning symbol combination. Similar to the null symbol 104 shown in FIG. 5D, the trigger symbol or diamond symbol 102 causes the gaming device to re-activate or re-spin reel 34*b*. Therefore, the player has another opportunity to obtain an award symbol in the game. The number of spins remaining in the bonus mode and the total award did not change in the game as indicated by the spins remaining display 106 and the total award display 108.

Figure 5F:
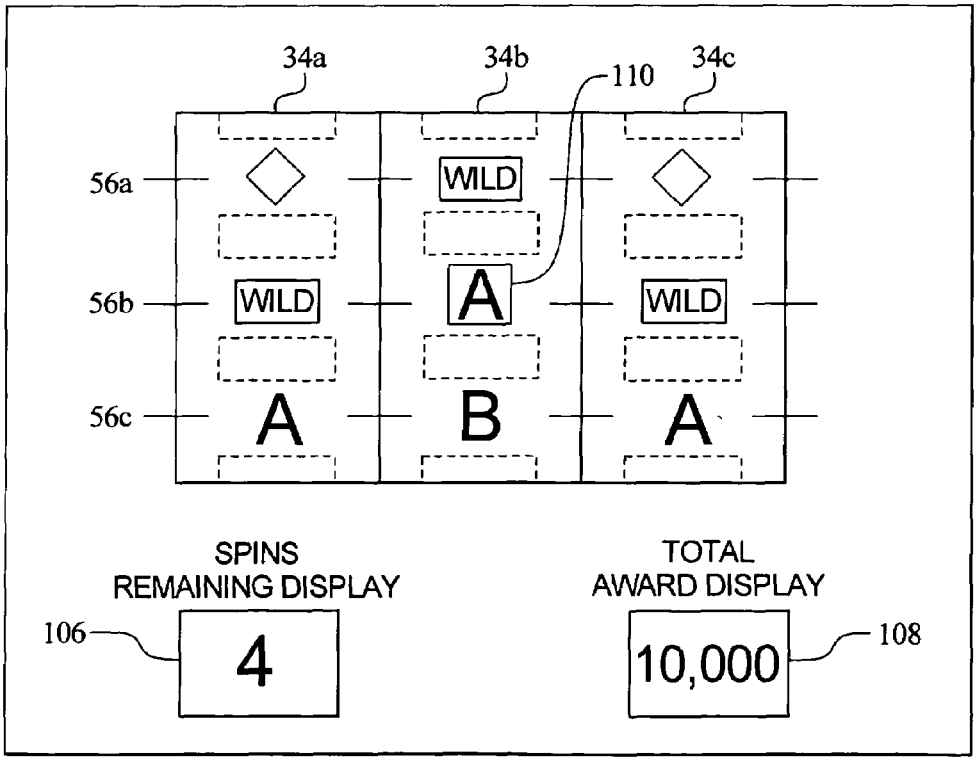

Referring to FIG. 5F, the gaming device or player re-spins and re-activates reel 34*b* in the award mode. After this spin, an award symbol designated by the letter A (110) is indicated on payline 56*b* on reel 34*b*. As a result, a winning symbol combination including wild symbol 105*a* on reel 34*a*, award symbol 110 on reel 34*b* and wild symbol 105*b* on reel 34*c* is indicated on payline 56*b*. This symbol combination provides a combination of three A symbols 110 because the wild symbols act or equal the award symbol 110. In this example, a combination including three A symbols provides the jackpot or largest award of ten thousand to the player as indicated by the total award display 108. Thus, the trigger symbol or diamond symbol 102 increases the probability or likelihood that the player will obtain an award and particularly the jackpot award in the game. The player has four spins remaining as indicated by the spins remaining display 106. In one embodiment, the player uses the remaining spins to spin the reels four more times in the award mode. In another embodiment, the game ends when the player obtains an award in the game.

Figure 6:
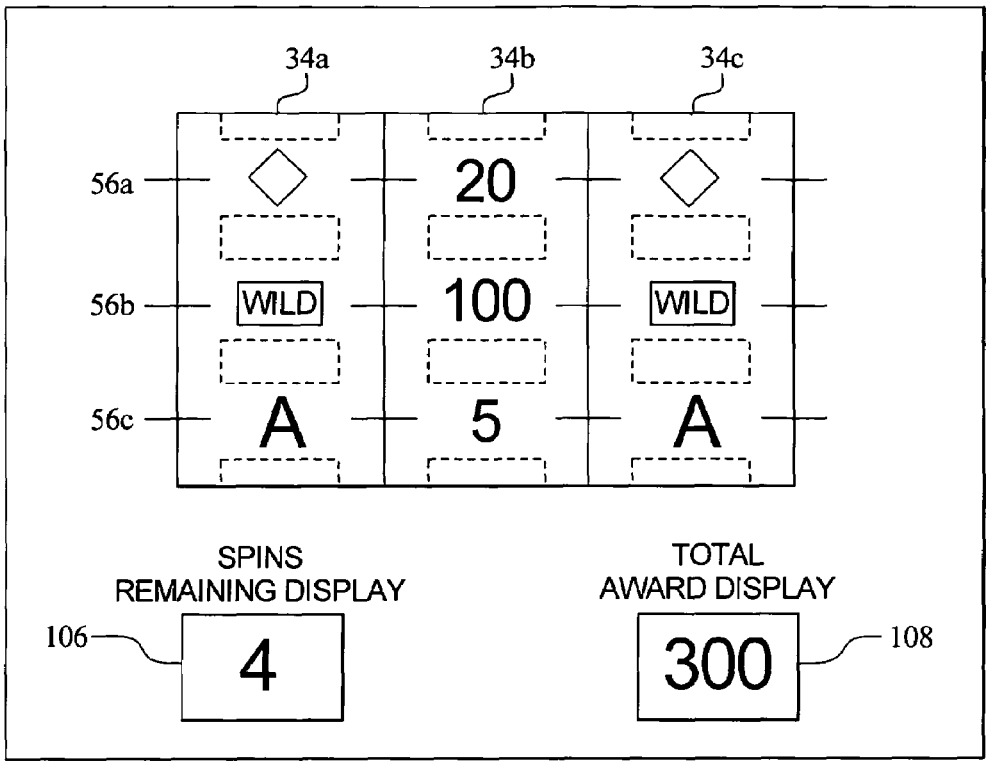
FIG. 6 is an enlarged elevation view of one of the display devices of FIGS. 1A and 1B illustrating another embodiment of the present invention.

Referring to FIG. 6, another embodiment of the present invention is illustrated where the symbols on the middle or central reel 34*b* include awards, such as the values of twenty, one hundred and five. In the award mode of this embodiment, the player re-spins or re-activates reel 34*b* until one of the award values are indicated on payline 56*b*. Instead of obtaining a winning symbol combination in the game, the player obtains three times the value of the indicated award or value on payline 56*b*. For example, in FIG. 6, the award of one hundred is indicated on payline 56*b* in the award mode. Therefore, the combination of the award of one hundred with the wild symbols 205*a* and 205*b* provide an award of three hundred because the wild symbols match the award value indicated on payline 56*b* on reel 34*b*. Thus, the player obtains an award of three hundred as indicated by the total award display 108 in the award mode. It should be appreciated that any symbols, values or any combination of symbols or values may be employed on the reels in the award mode of the game of the present invention.

Figure 7:
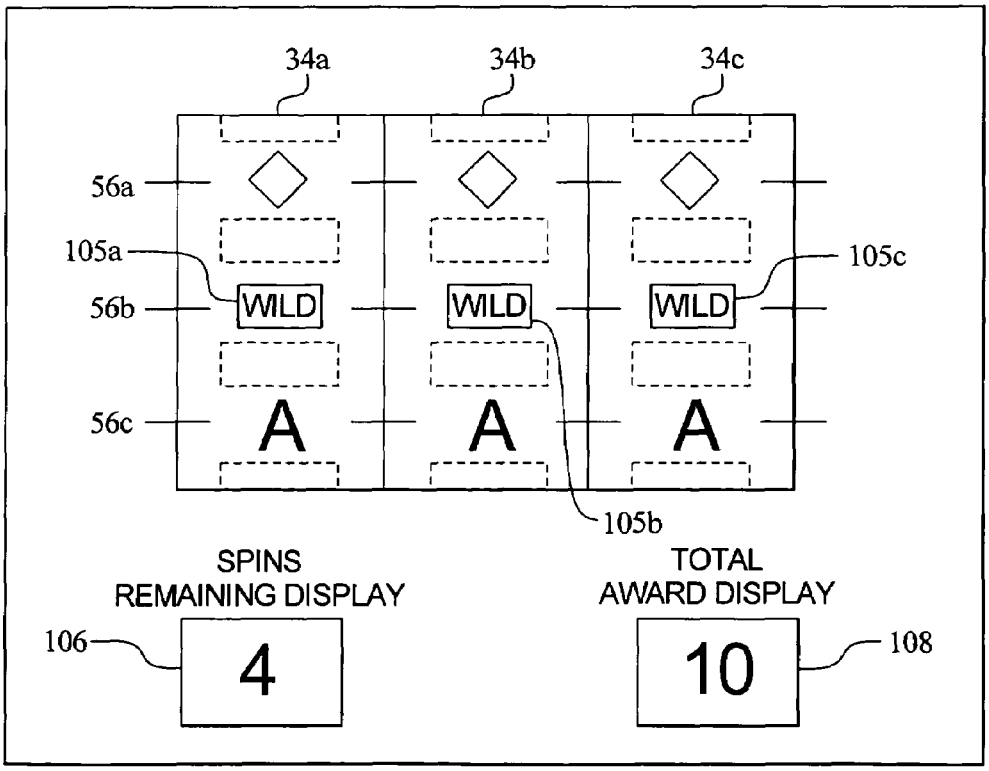
FIG. 7 is an enlarged elevation view of one of the display devices of FIGS. 1A and 1B illustrating a further embodiment of the present invention.

Referring to FIG. 7, a further embodiment of the present invention is illustrated where the middle or center reel 34*b* includes a wild symbol 105*b*. In this embodiment, the player re-spins reel 34*b* after obtaining the trigger symbol or diamond symbol 102 as described above. If the player obtains the wild symbol on payline 56*b* on reel 34*b*, the player obtains a symbol combination including three wild symbols 105*a*, 105*b* and 105*c*. Thus, the player obtains the largest award or the highest or most desirable symbol combination associated with the game such as the jackpot symbol combination because the player obtained three wild symbols on payline 56*b*. Thus, the wild symbol 105*b* increases the probability that the player will obtain the largest award such as the jackpot award in the game. In another embodiment, an award or award value is associated with the symbol combination including the wild symbol as shown in FIG. 3B.

In one alternative embodiment of the present invention, the number of spins of the reel can be limited such as to a predetermined number, a randomly determined number, or a number based on another functional game element such as the player's wager.

Free-Spin Re-Initiation Mode

In another embodiment of the present invention, the gaming device includes a primary game operable upon a wager. As discussed above, the primary game includes a plurality of symbols, and may include a plurality of reels or any other suitable presentation device such as video poker. In one embodiment, the symbols include a plurality of award symbols and at least one triggering symbol or triggering symbol combination. The triggering symbol or symbol combination enables a player to enter a free spin mode where the player will have additional opportunities to win awards without having to make any additional wagers. In an alternative embodiment, the symbols also include a plurality of wild symbols.

Figure 8:
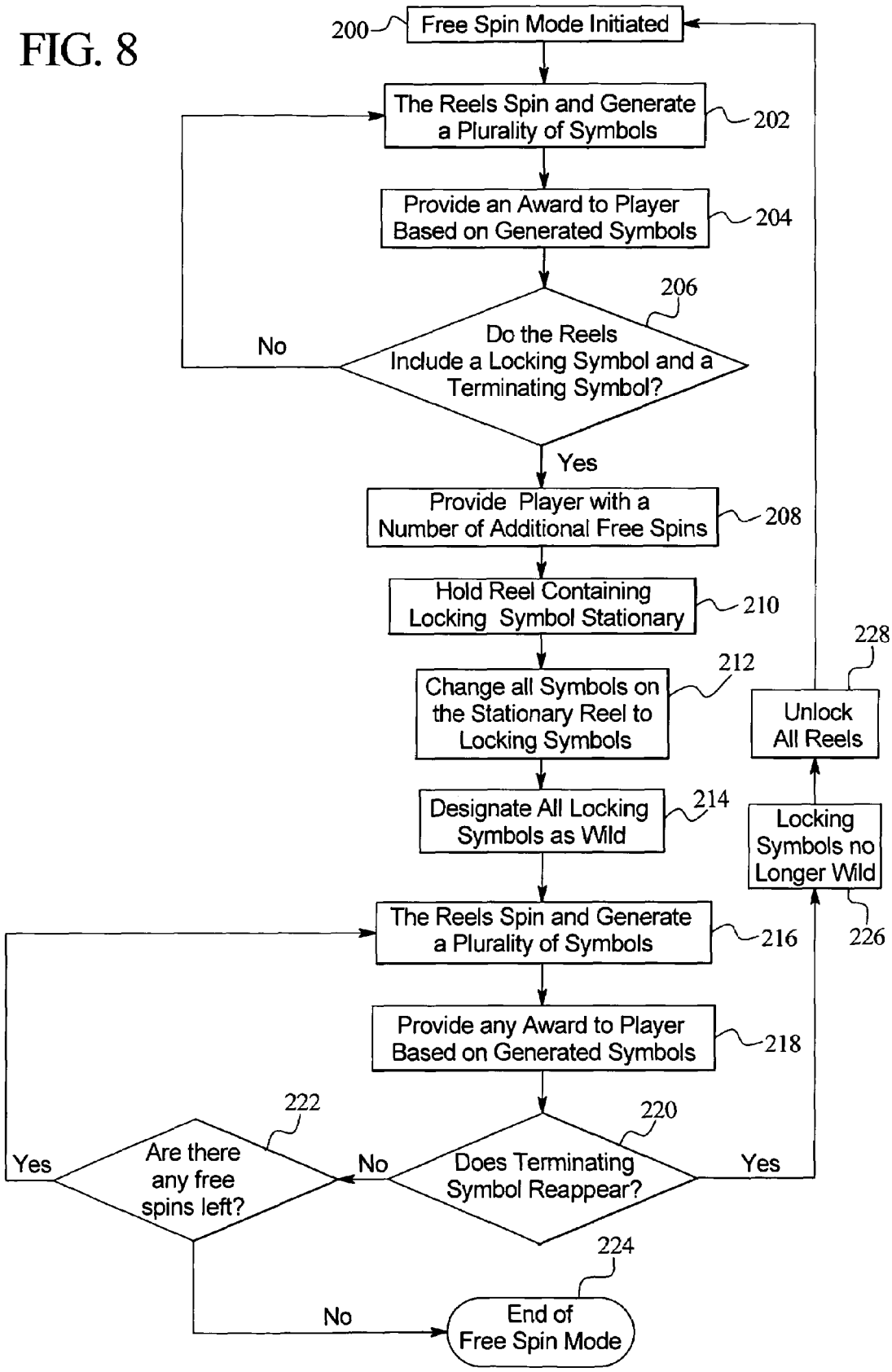
FIG. 8 is a flowchart of one of the embodiments of the present invention where a free spin mode is re-initiated.

Referring to FIG. 8, in one embodiment, the gaming device initiates the free spin mode, as indicated by block 200. The gaming device provides the player with an unlimited number of free activations or spins to re-activate the reels and obtain awards if there are any winning combinations of award symbols. The gaming device activates or spins the reels and generates a plurality of symbols as indicated by block 202. The gaming device determines if there are any winning combinations of symbols and provides any awards to the player based on the generated symbols as indicated by block 204. The plurality of symbols include at least one locking symbol and at least one terminating symbol. A terminating condition or the condition for limiting the unlimited free spins is fulfilled if both the locking symbol and the terminating symbol occur on the reels or are generated by a spin of the reels.

In an alternate embodiment, the locking symbol and the terminating symbol must occur on different reels. In a further embodiment, the locking symbol must occur on at least one of a first group of reels such as the first three reels and the terminating symbol must occur on at least one of a second group of reels such as the last two reels. In another embodiment, the locking symbol and the terminating symbol must occur on the same payline.

The free activation or free spin mode continues until the terminating condition occurs as indicated by decision diamond 206. When the terminating condition is fulfilled as indicated by decision diamond 206, the gaming device provides the player with a number of additional free spins as indicated by block 208. It should be appreciated that the number of additional free spins may be randomly determined, based on the wager in the base game, based on the number of paylines activated, predetermined, based on the result in the base game, or by any other suitable method. The gaming device then locks or holds stationary at least one, a plurality of or all of the reels with a locking symbol occurring on any payline as indicated by block 210. These reels will be held stationary or locked for the additional free spins or activations. In one embodiment, the locking symbol can function as an expanding wild symbol on the reel. The gaming device changes all symbols on the stationary reel to locking symbols as indicated by block 212. In an alternative embodiment, the gaming device changes at least one symbol on the stationary reel to a locking symbol. In a further embodiment, the gaming device changes a plurality of symbols on the stationary reel to locking symbols. The gaming device designates all locking symbols as wild as indicated by block 214. This means that for the additional free spins, the locking symbols may be used interchangeably with any other symbols on a payline. The gaming device spins or activates at least one unlocked reel and thus generates a plurality of symbols for evaluation as indicated by block 216. The gaming device determines if there are any winning combinations of symbols including the wild locking symbols and provides any awards to the player based on the generated symbols as indicated by block 218.

In one embodiment, if the terminating symbol does not reappear as indicated by decision diamond 220, the gaming device determines if there are any additional free spins remaining as indicated by decision diamond 222. If there are additional spins remaining, the gaming device spins or activates the reels to generate a plurality of symbols as indicated by block 216. In one embodiment, if the terminating symbol reappears on any payline of any reel during the additional free spins as indicated by decision diamond 220, all locking symbols are un-designated as wild as indicated by block 226. All reels are unlocked as indicated by block 228. The free spin mode with unlimited free spin is re-initiated as indicated by block 200, and the process is repeated.

Figure 9A:
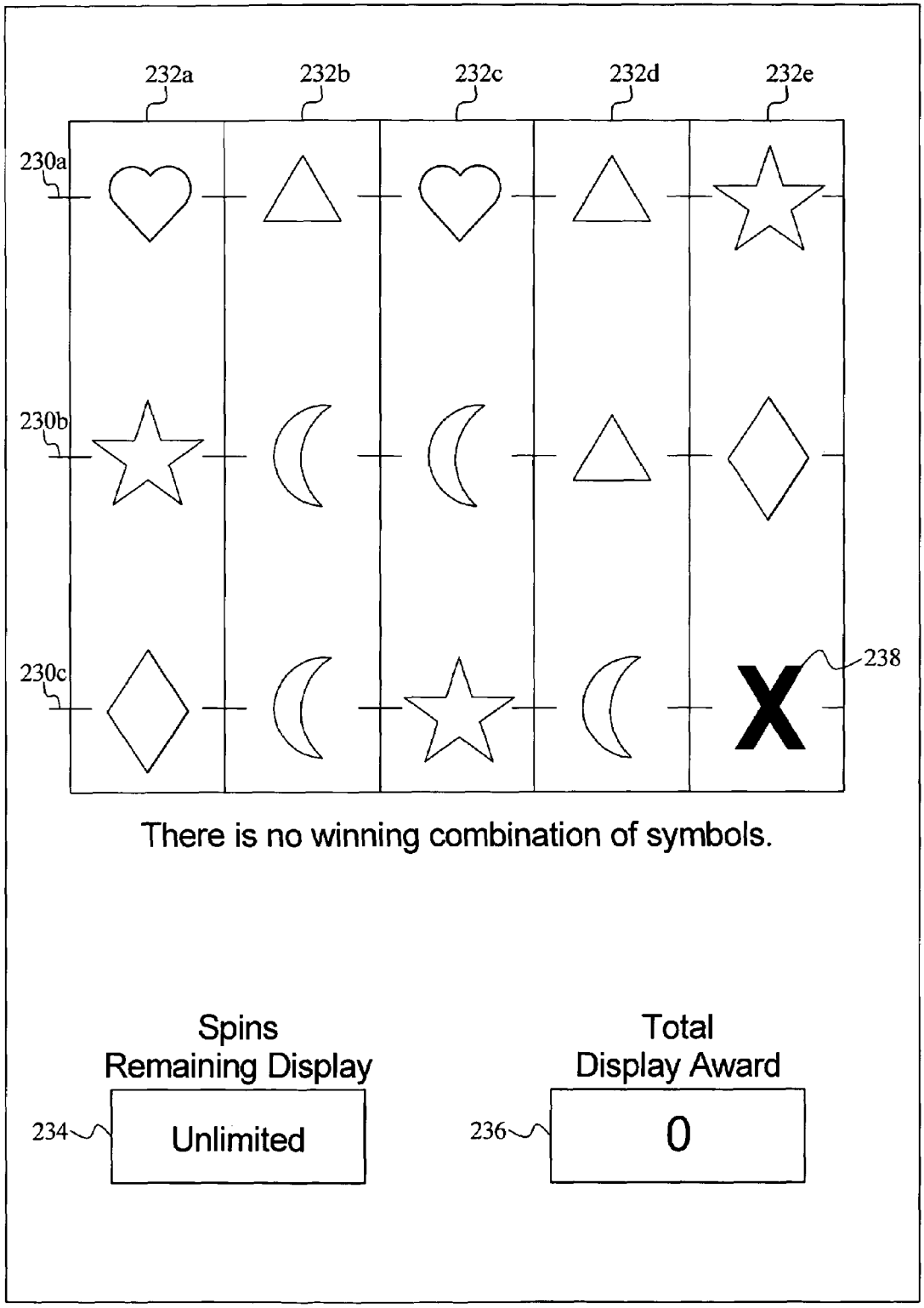
FIGS. 9A, 9B, 9C, 9D, 9E, 9F, 9G and 9H are enlarged front elevation views of one of the display devices of FIGS. 1A and 1B illustrating an example of one of the embodiments of the present invention where the free spin mode is re-initiated.

Referring now to FIG. 9A, in an example of the above embodiment, in the free spin mode, the gaming device includes or displays a plurality of reels 232*a*, 232*b*, 232*c*, 232*d* and 232*e*. In the illustrated embodiment, three paylines 230*a*, 230*b* and 230*c* are associated with the reels. The reels include a plurality of symbols. The symbols in this example are shapes such as stars, triangles, hearts, moons, and diamonds. It should be appreciated that the symbols may be shapes, numbers, letters, characters or any suitable images. The symbols also include at least one locking symbol 240 see (FIG. 9B) and at least one terminating symbol 238 (FIG. 9A). As stated above, the free spin mode termination condition is fulfilled if both the locking symbol 240 and the terminating symbol 238 are generated on the reels in an activation. The gaming device provides an award to the player if there is a winning symbol combination. In this example, four matching symbols, as indicated on any payline 230*a*, 230*b* or 230*c*, is a winning symbol combination. A spins remaining display 234 indicates the number of free activations or spins provided to the player for the free activation mode. At the initiation of the free spin mode, the number of free spins is unlimited, as indicated by the free spins display 234. A total award display 236 indicates the total award accumulated by the player in the game. At the start of the free spin mode, the total award is zero as indicated in FIG. 9A. The gaming device activates or spins the reels in the game and a symbol on each reel is indicated on each payline illustrated in FIG. 9A. Specifically, a terminating symbol 238 is indicated on reel 232*e* and payline 230*c*. In this particular free spin there is no winning combination of symbols. Also, in this embodiment, the terminating symbol 238 does not, by itself, terminate the free spin mode. The terminating condition is the occurrence of both the locking symbol 240 and the terminating symbol 238. Although the player has not won an award in the free spin in FIG. 9A, the additional free spins provide the player with other opportunities to obtain awards associated with winning symbol combinations. This increases the player's excitement and enjoyment in the game. The total award in the game is still zero as indicated by the total award display 236.

In one embodiment, the respective probabilities of occurrences associated with the terminating symbol and the locking symbol are less than at least one of the other symbols on the reels. In another embodiment, the respective probabilities associated with the terminating symbol and the locking symbol are less than the probabilities associated with a plurality of the other symbols on the reels. In a further embodiment, the respective probabilities associated with the terminating symbol and the locking symbol are less than the probabilities associated with all of the other symbols on the reels. In another embodiment, the probability associated with the terminating symbol is less than the probability associated with the locking symbol. In another embodiment they have equal or substantially equal probabilities of occurrence. In a further embodiment, the probability of occurrence associated with the locking symbol is less than the probability associated with the termination symbol.

Figure 9B:
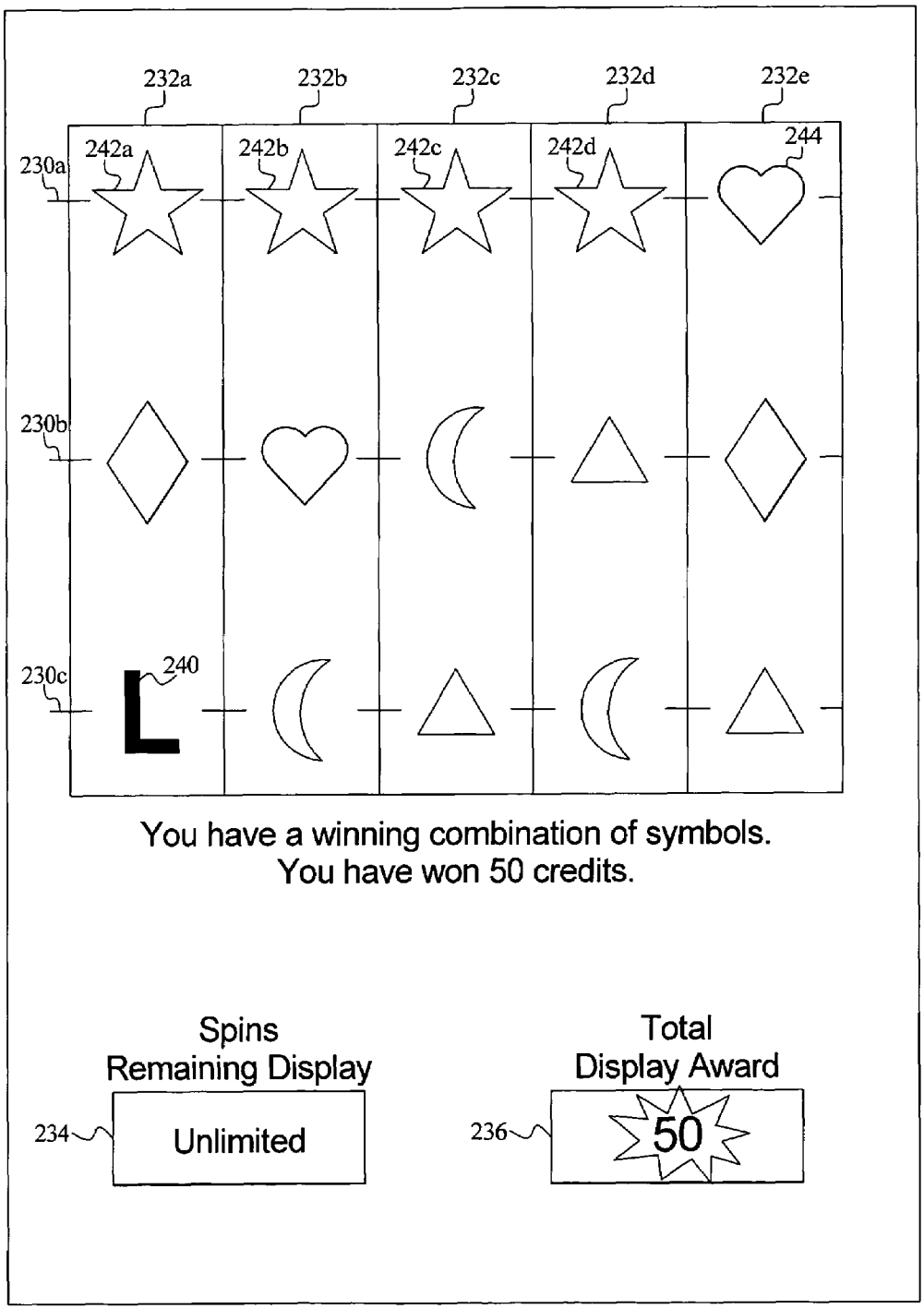

Referring to FIG. 9B, the gaming device activates or spins the reels using one of the unlimited free spins provided to the player, as indicated by the spins remaining display 234. The reels stop spinning and five symbols are indicated on payline 230*a*. The indicated symbols are four star symbols 242*a*, 242*b*, 242*c* and 242*d*, and a heart symbol 244. Thus, a symbol combination including four matching symbols, specifically four star symbols, is indicated on payline 230*a*. This is a winning symbol combination in this example. Therefore, the gaming device provides an award associated with the winning symbol combination (i.e., four star symbols), which in this example is an award of fifty. The award of fifty is added to the player's total award and the player now has a total award of fifty as indicated by the total award display 236. It should be appreciated that any award may be provided to the player and the award may be predetermined, randomly determined, based on a wager made by the player in the primary game that triggered the free spin mode, or determined by any other suitable method. Also, in this example, the locking symbol 240 does not, by itself, terminate the free spin mode. The terminating condition is the occurrence of both the locking symbol 240 and the terminating symbol 238. Therefore, the terminating condition has not occurred.

Figure 9C:
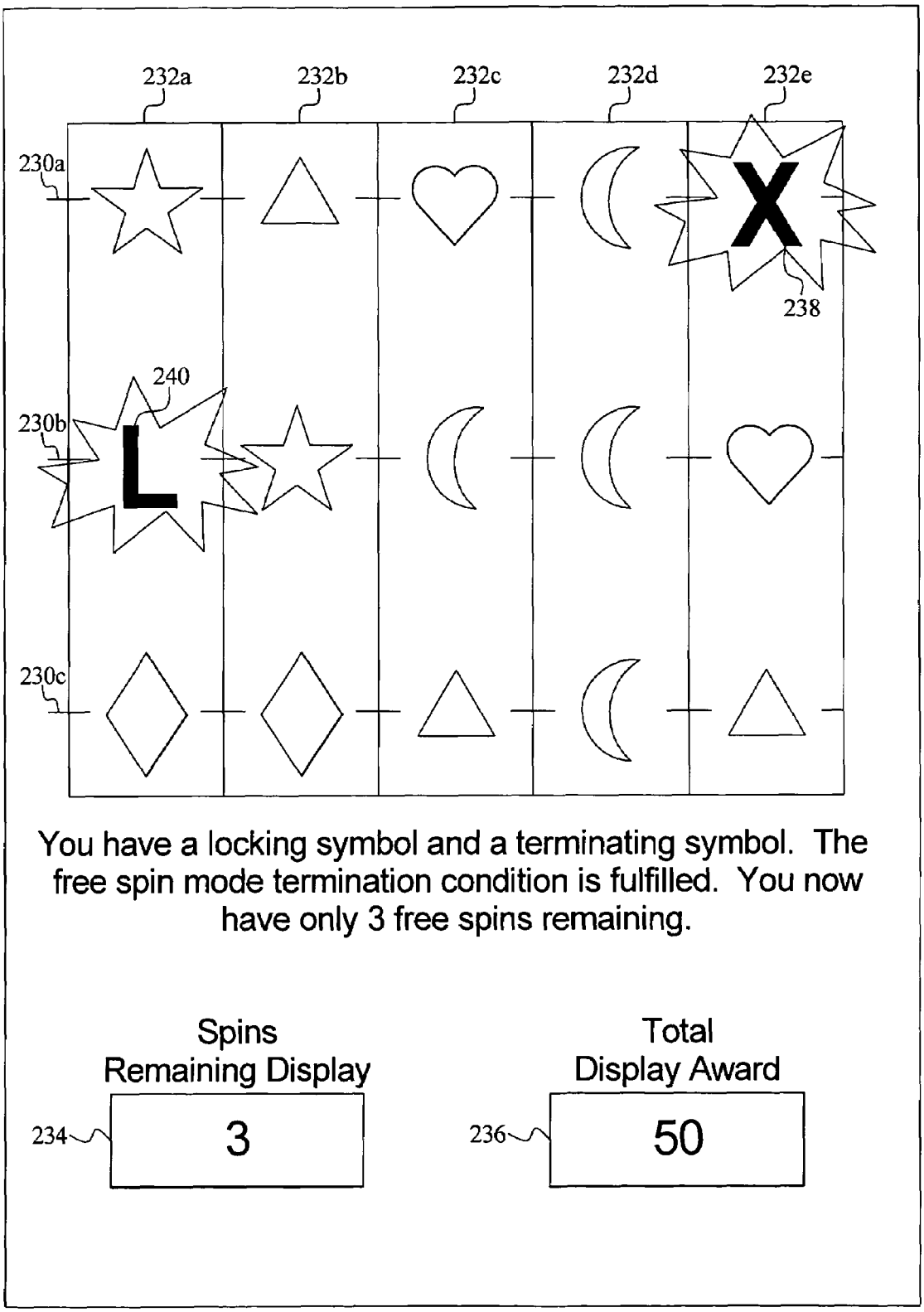

Referring now to FIG. 9C, the gaming device activates or spins the reels using one of the unlimited number of free spins provided to the player as indicated in the spins remaining display. The reels stop spinning and a locking symbol 240 is indicated on payline 230*b* and a terminating symbol 238 is indicated on payline 230*a*. Also, in this particular free spin there are no winning symbol combinations. Thus, a symbol combination that includes a locking symbol 240 and a terminating symbol 238 has been achieved, and the free spin mode termination condition has been fulfilled. The gaming device awards the player three additional free spins as indicated by the spins remaining display 234. It should be appreciated that any suitable number of free spins may be awarded and may be predetermined, randomly determined, determined based on a wager made by the player in the primary game that triggered the free spin mode, or determined by any other suitable method. The total award in the game is still fifty as indicated in the total award display 108. In an alternative embodiment, upon the occurrence of the terminating condition, a multiplier is provided to the player and applied to one, a plurality, or all awards in the free spin mode. In further embodiments, the multiplier may be predetermined, randomly determined, based on a wager by the player in the primary game that triggered the free spin mode, or determined by any other suitable method. The total award in the game is still fifty as indicated in the total award display 108.

Figure 9D:
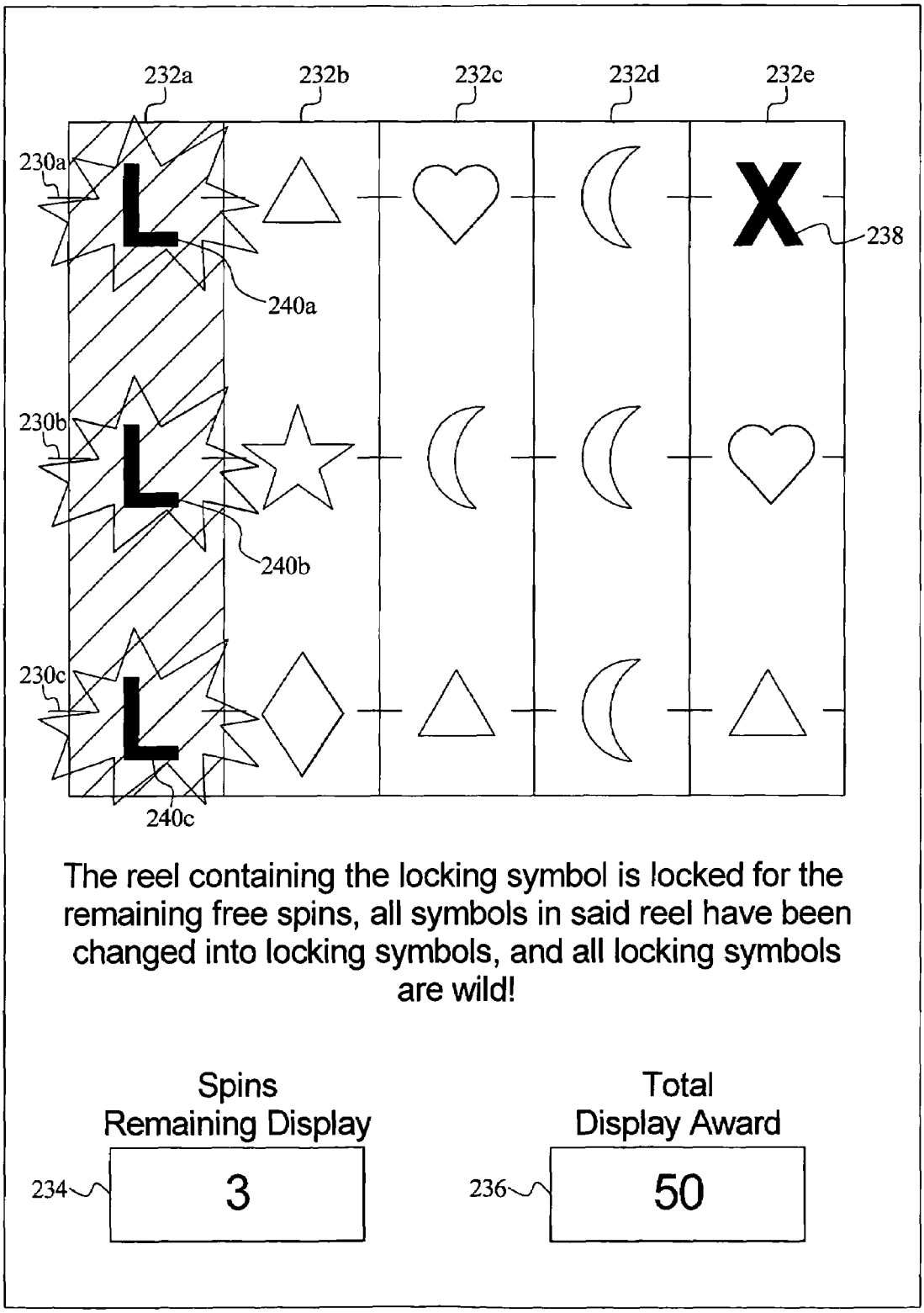

Referring now to FIG. 9D, the gaming device locks reel 232*a* including the locking symbol 240. In this example, the locking symbol 240*b* occurred on reel 232*a* and payline 230*b*. Also, in this embodiment, all of the other symbols on the reel 232*a* including the locking symbol 240*b* are changed into locking symbols 240*a* and 240*c*. Finally, all locking symbols 240*a*, 240*b* and 240*c* are designated as wild. Each locking symbol 240*a*, 240*b* and 240*c* functions as or substitutes for one of the symbols on the respective payline. Locking the reels and designating the locking symbols as wild increases the probability that on one of the remaining free spins the player will achieve a winning combination. This increases the player's excitement and enjoyment in the game. The spins remaining are three as indicated by the spins remaining display 234. The total award in the game is still fifty as indicated by the total award display 236.

Figure 9E:
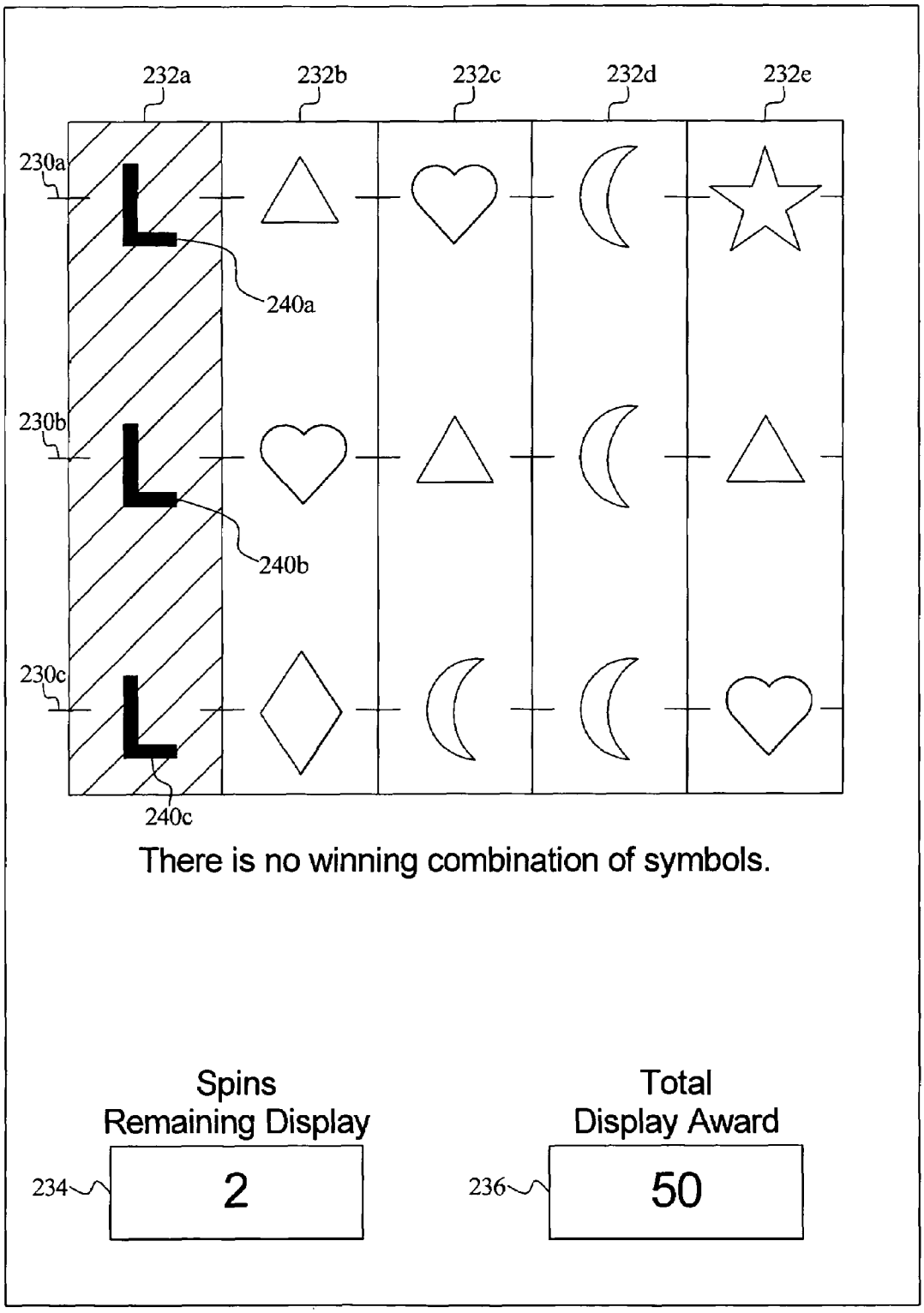

Referring now to FIG. 9E, the gaming device activates or spins the reels 232*b*, 232*c*, 232*d* and 232*e*, using one of the additional three free spins provided to the player and the number of spins remaining decreases to two as indicated by the spins remaining display 234. The reels stop spinning and no winning symbol combinations have occurred. The total award in the game is still fifty as indicated in the total award display 236.

Figure 9F:
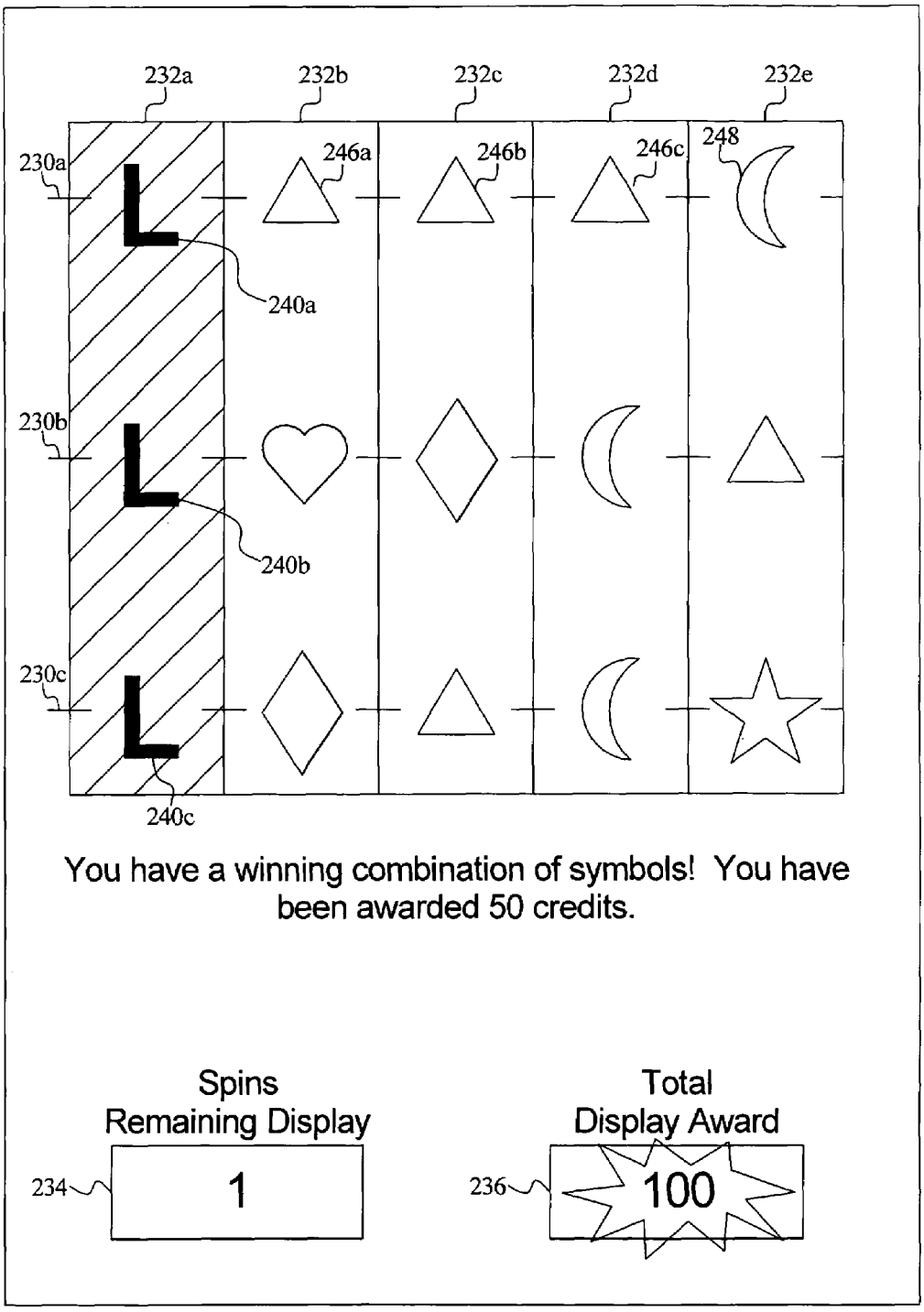

Referring now to FIG. 9F, the gaming device activates or spins the reels 232*b*, 232*c*, 232*d* and 232*e*, using one of the additional free spins provided to the player and the number of free spins decreases to one as indicated in the spins remaining display 234. The reels stop spinning and five symbols are indicated on payline 230*a*. The indicated symbols are a locking symbol 240*a*, three triangle symbols 246*a*, 246*b* and 246*c*, and a moon symbol 248. The locking symbol 240*a*, as a designated wild symbol, functions as or substitutes for one of the symbols indicated on the payline. Because there are three triangle symbols 246*a*, 246*b* and 246*c* on the payline, the locking symbol 240*a* functions as or substitutes for a triangle symbol on the payline 230*a*. Thus, a symbol combination including four matching symbols, specifically four triangle symbols, is indicated on payline 230*a*. This is a winning symbol combination in the game. Therefore, the gaming device provides an award associated with the winning symbol combination (i.e., four triangle symbols), which in this example is an award of fifty. The award of fifty is added to the player's total award and the player now has a total award of one-hundred as indicated by the total award display 236.

Figure 9G:
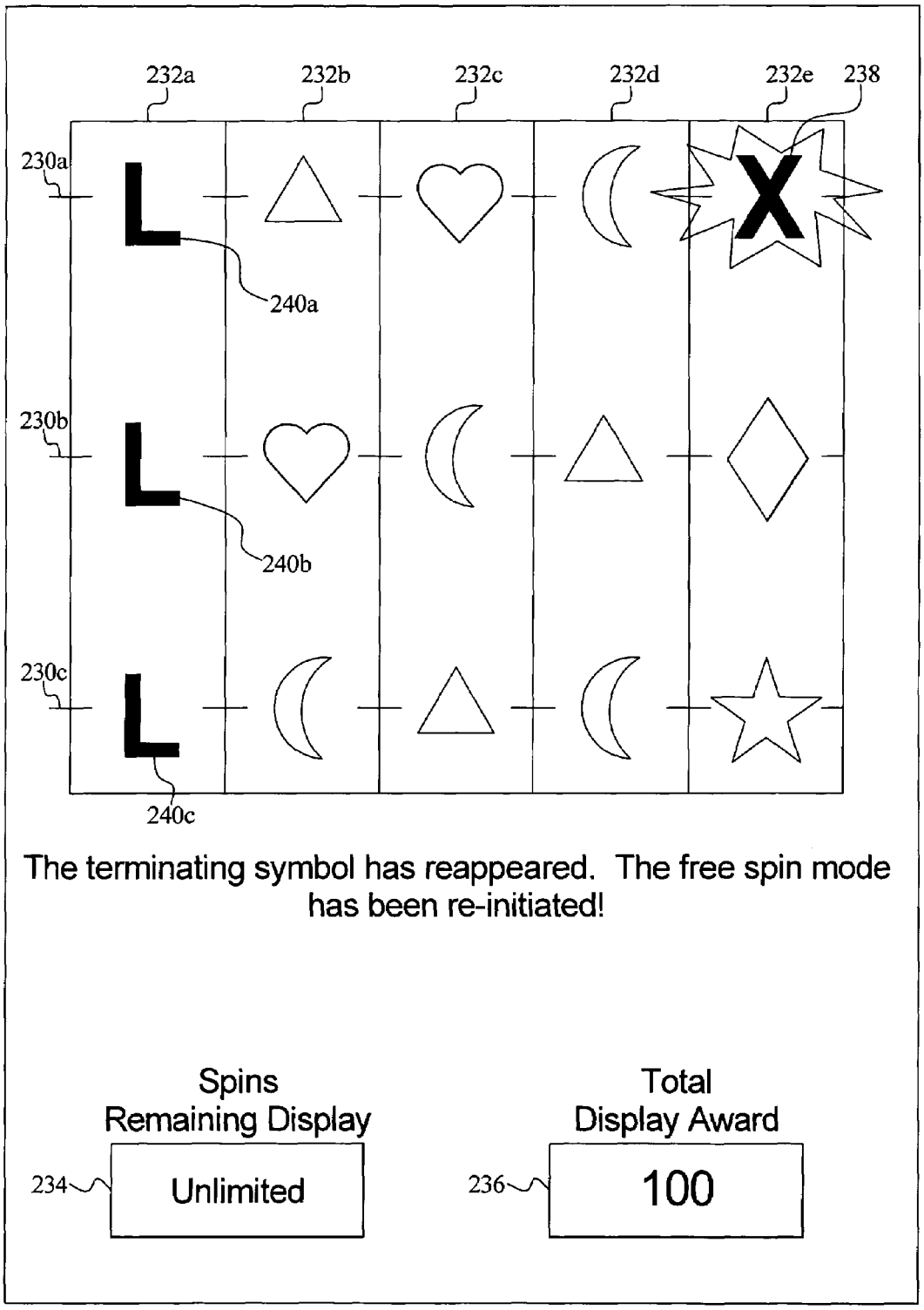

Referring now to FIG. 9G, the gaming device activates or spins the reels using one of the additional free spins provided to the player. The reels stop spinning and a terminating symbol 238 is indicated on payline 230*a*. Locking symbols 240*a*, 240*b* and 240*c* are also present on paylines 230*a*, 230*b* and 230*c* respectively. Also, in this particular free spin there are no winning symbol combinations. Thus, a symbol combination that includes a locking symbol 240 and a terminating symbol 238 has been achieved, and the free spin mode re-initiation condition has been fulfilled. In an alternate embodiment, some symbol other than a terminating symbol 240, could fulfill the free spin mode re-initiation condition. The gaming device unlocks all reels and un-designates the locking symbol as wild. Then, the gaming device re-initiates the unlimited free spin mode, and provides the player with an unlimited number of free spins as indicated by the spins remaining display 234. This allows the player to stay in the free spin mode longer and possibly earn more awards. This increases the player's excitement and enjoyment in the game. The total award in the game is still one-hundred as indicated in the total award display 236.

Figure 9H:
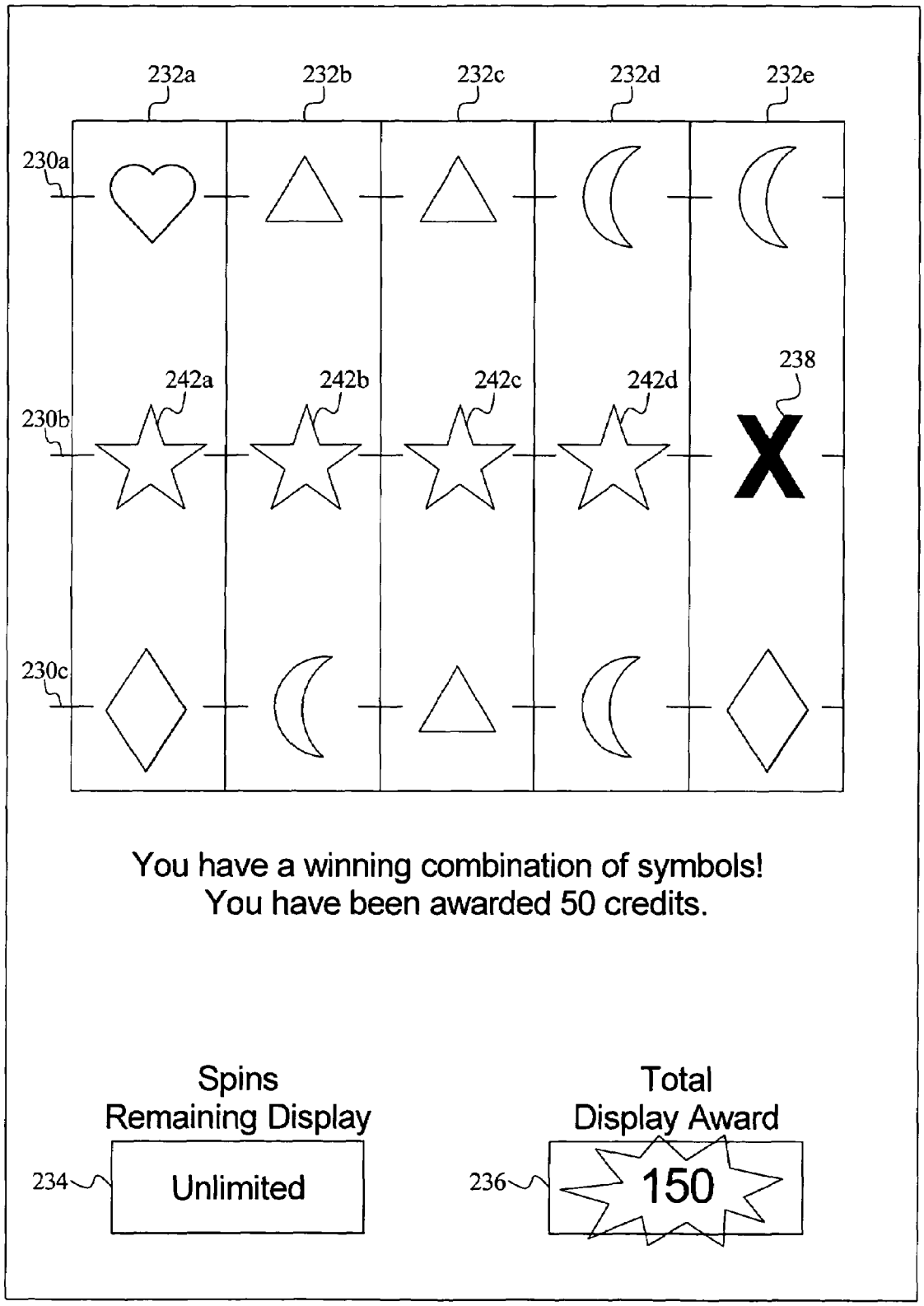

Referring now to FIG. 9H, the gaming device activates or spins the reels using one of the unlimited free spins provided to the player in the game, as indicated in the spins remaining display 234. The reels stop spinning and five symbols are indicated on payline 230*b*. The indicated symbols are four star symbols 242*a*-242*d* and a terminating symbol 238. Thus, a symbol combination including four matching symbols, specifically four star symbols, is indicated on payline 230*b*. This is a winning symbol combination in the game. Therefore, the gaming device provides an award associated with the winning symbol combination (i.e., four star symbols), which in this example is an award of fifty. The award of fifty is added to the player's total award and the player now has a total award of one-hundred fifty as indicated by the total award display 236. It should be appreciated that any award may be provided to the player and the award may be predetermined, randomly determined, based on a wager made by the player, or determined by any other suitable method. Also, in this embodiment, the terminating symbol 238 does not, by itself, terminate the free spin mode. The terminating condition is the occurrence of both the locking symbol 240 and the terminating symbol 238. Therefore, the terminating condition has not occurred.

Figure 10A:
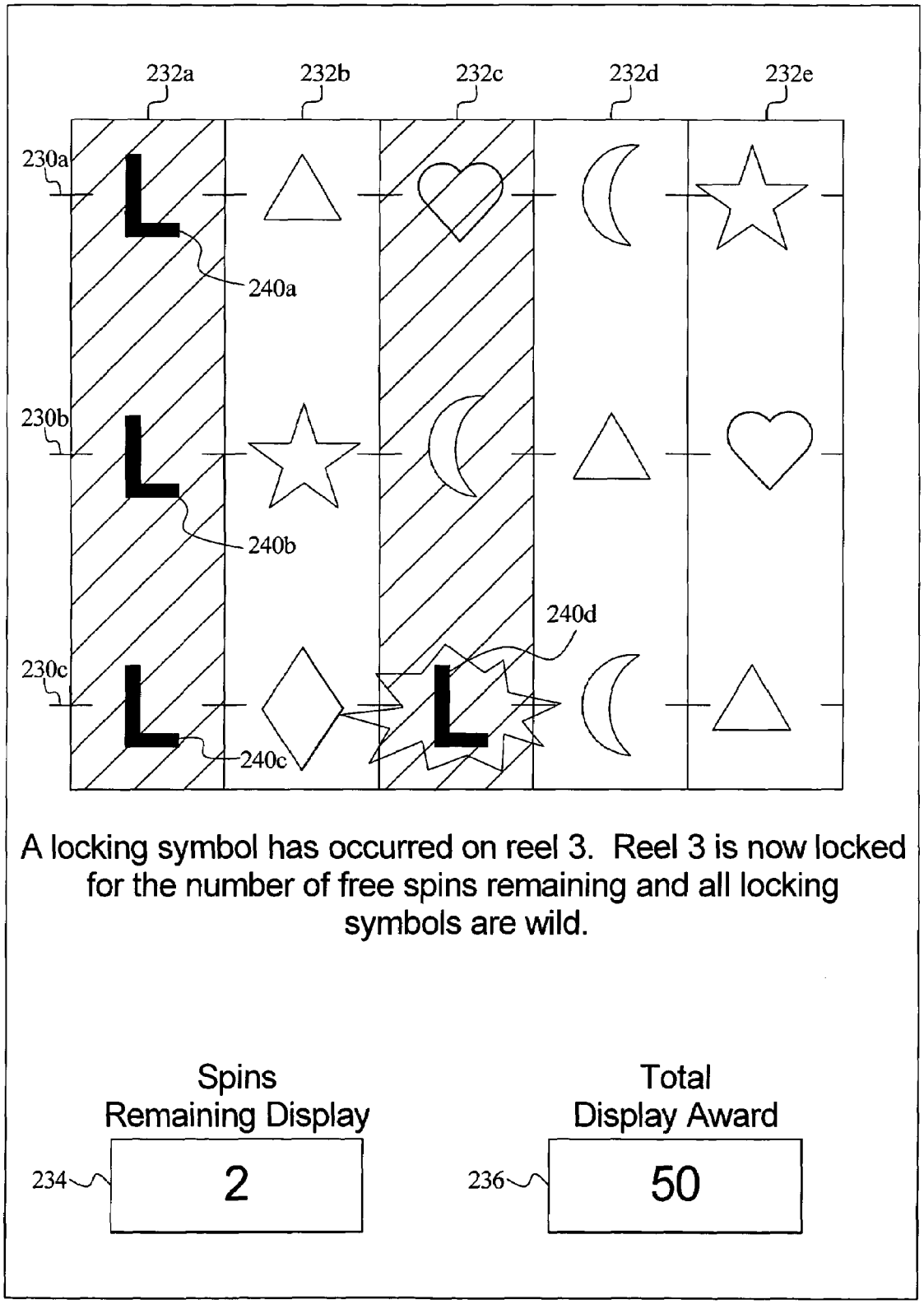
FIGS. 10A and 10B are enlarged front elevation views of one of the display devices of FIGS. 1A and 1B illustrating an example of one of the embodiments of the present invention where a locking symbol occurs on more than one reel.

In an alternative embodiment, generally illustrated in FIG. 10A, after the terminating condition has been fulfilled and the gaming device provides the player with a number of additional free spins as indicated by the spins remaining display 234, the gaming device locks all reels 232*a* containing a locking symbol 240. In this example a locking symbol 240*b* occurred on reel 232*a* and payline 230*b*. Also, in this embodiment, the locking symbol can function as an expanding wild symbol on the reel. All other symbols on the reel 232*a* containing the locking symbol 240*b* have been changed into locking symbols 240*a* and 240*c*, and all of the locking symbols 240*a*, 240*b* and 240*c* are designated as wild. The locking symbols function as or substitute for one of the symbols on the payline. Locking the reels, designating the locking symbols as wild, and changing all of the symbols on a reel to a locking symbol, increases the probability that on one of the remaining free spins, the player will achieve a winning combination. Furthermore, in this embodiment, if upon any of the remaining free spins a locking symbol appears on any other reel, that reel will also be locked for the number of free spins remaining. In this example, a locking symbol 240*d* has occurred on reel 232*c*. The gaming device holds reels 232*a* and 232*c* stationary for the remaining number of free spins, or until the re-initiation condition has been fulfilled.

Figure 10B:
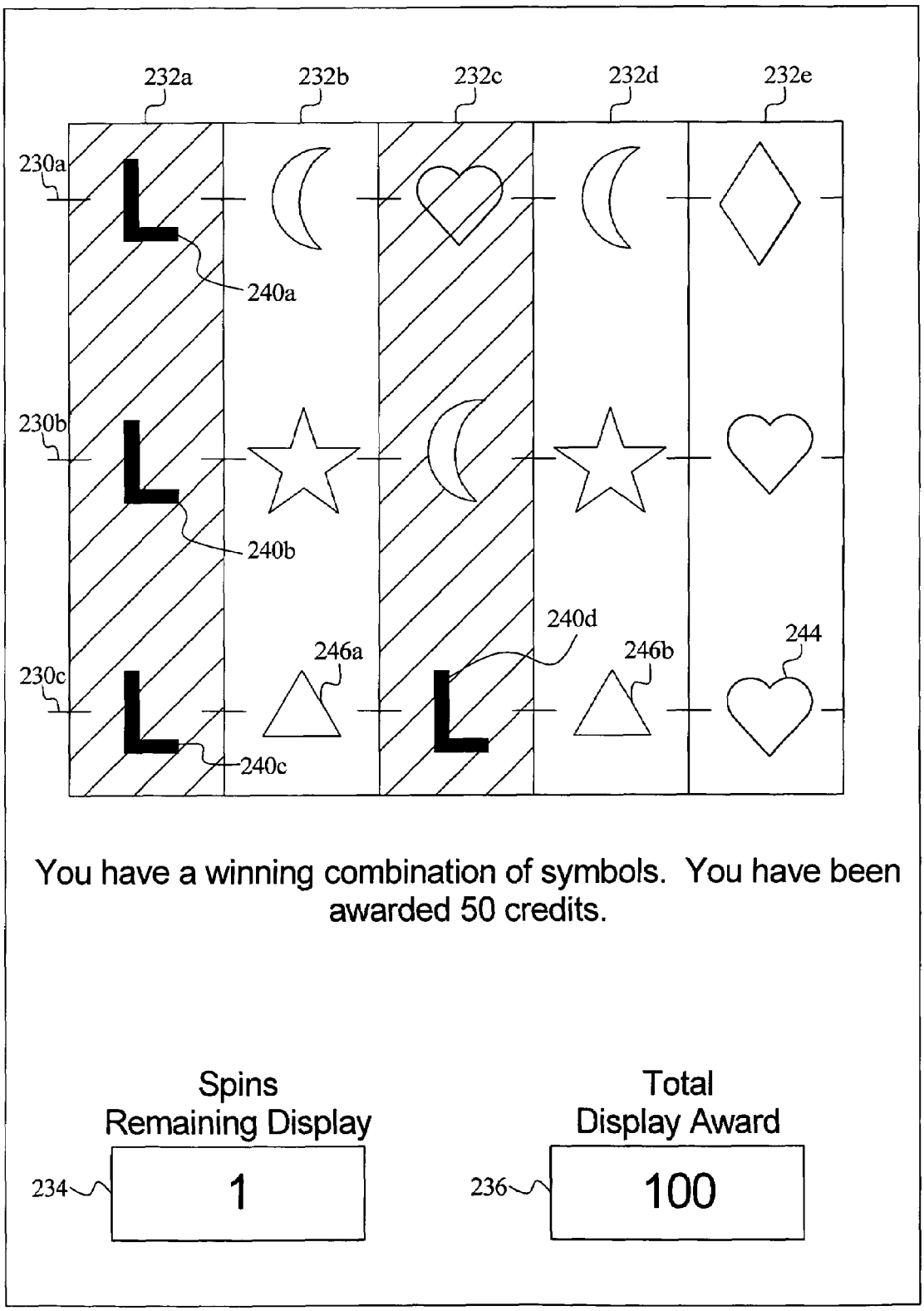

Referring now to FIG. 10B, the gaming device activates or spins the reels using one of the additional free spins provided to the player and the number of free spins decreases to one as indicated by the spins remaining display 234. The reels stop spinning and five symbols are indicated on payline 230*c*. The indicated symbols are two locking symbols 240*c* and 240*d*, two triangle symbols 246*a* and 246*b*, and one heart symbol 244. The two locking symbols 240*c* and 240*d*, as designated wild symbols, function as or substitute for one of the symbols indicated on the payline 230*c*. Because there are two triangle symbols 246*a* and 246*b* on the payline, the locking symbols 240*c* and 240*d* function as or substitute for a triangle symbol on payline 230*c*. Thus, a symbol combination including four matching symbols, specifically four triangle symbols, is indicated on payline 230*c*. This is a winning symbol combination in the game. Therefore, the gaming device provides an award associated with the winning symbol combination (i.e., four triangle symbols), which in this example is an award of fifty. The award of fifty is added to the player's total award and the player now has a total award of one-hundred as indicated by the total award display 236.

Referring now to FIGS. 11A to 11H, an alternative embodiment of the present invention is illustrated, where upon the occurrence of an unlimited free spin mode terminating event in the unlimited free spin mode, the gaming device provides a number of additional free spins or free activations to a player and enables the player to obtain a modifier based on an accumulation of one or more distinct or designated symbols on the reels in the additional free spins.

In the illustrated embodiment, the gaming device displays a plurality of reels 300*a*, 300*b*, 300*c* 300*d* and 300*e* to a player where the reels include a plurality of symbols 304. It should be appreciated that the gaming device may employ or display any suitable symbol generator or generators to the player. In this embodiment, the symbols include letters such as A, B, C, D, E, F, G and H. It should be appreciated that the symbols may be numbers, letters, shapes, characters or any other suitable image or images. In one embodiment, the symbols include at least one locking symbol such as locking symbol 306 displayed on the first reel 300*a*. It should be appreciated that one, a plurality or all the reels may include one or more locking symbols. In the illustrated embodiment, a plurality of paylines 302*a*, 302*b* and 302*c* are associated with the reels. It should be appreciated that any suitable number of paylines may be associated with the reels. In one embodiment, the unlimited free spin mode terminating event is triggered upon the occurrence of the locking symbol on one of the reels. In other embodiments, the unlimited free spin mode terminating event is triggered by a plurality of locking symbols occurring on the reels, one or more locking symbols occurring on one or more designated reels, any suitable combination of locking symbols on the reels or in any other suitable manner.

In the unlimited free spin mode, when the locking symbol occurs on one of the reels, the gaming device terminates the unlimited free spin mode and locks the reel indicating the locking symbol (i.e, the designated reel) in place or holds this reel stationary for a number of additional free spins or free activations of the reels. In an alternative embodiment, one or more of the other reels (other than the reel indicating the locking symbol) may be locked or held stationary in one or more free spins or free activations of the reels. In the illustrated embodiment, the locking symbol is represented by a circle including the letter "L." It should be appreciated that the locking symbol may be any suitable shape, number, letter, character or image.

In one embodiment, the locking symbol 306 acts as or functions as an expanding wild symbol which changes the other symbols indicated on or displayed by reel 300*a* to locking symbols. Accordingly, each of the locking symbols on reel 300*a* functions as or acts as a wild symbol or substitutes for at least one of the other symbols indicated by the reels in each additional free spins of the reels. In one embodiment, the gaming device provides an award or awards to a player for any winning symbol combination indicated by the reels (including the locking symbols which act as wild symbols) in an additional free spin or additional free activation of the reels. It should be appreciated that the gaming device may provide any number of awards or any suitable award or awards to a player in the additional free spins.

In the illustrated embodiment, one of the symbols 304 is associated with each of the non-locked reels 300*b*, 300*c*, 300*d* and 300*e*. For example, symbol A (307*a*) is associated with reel 300*b*; the symbol B (307*b*) is associated with reel 300*c*; the symbol C (307*c*) is associated with reel 300*d* and the symbol D (307*d*) is associated with reel 300*e*. It should be appreciated that any of the symbols on the reels may be associated with one or more of the reels. It should also be appreciated that any suitable letter, number, shape, character or image may be associated with one or more of the reels 300. In the illustrated embodiment, the gaming device enables the player to select or pick one of the symbols or images 307*a*, 307*b*, 307*c* and 307*d* to be the designated symbol or selected symbol in a number of the additional free spins of the reels such as the total number of additional free spins of the reels. In an alternative embodiment, the gaming device may include a separate display which indicates or displays a plurality of inputs which enable the player to select one or more of the symbols associated with the reels. In the illustrated embodiment, the selected symbol 307 (i.e., the symbol picked by the player) becomes the designated or selected symbol and the reel associated with the selected symbol is the designated reel. In an alternative embodiment, the gaming device enables the player to select one of the non-locked reels and thereby select the symbol associated with the picked non-locked reel. In one embodiment, the gaming device provides a modifier such as a multiplier to the player in the additional free spins or free activations of the reels where the modifier modifies the total award obtained by the player in the additional free spins. The modifier is based on the number of occurrences of the selected symbol on the designated reel in the additional free spins as described in detail below.

In the illustrated embodiment, the gaming device includes a message area or message display 308 which indicates or displays messages or instructions to a player in a game. It should be appreciated that the message display 308 may be located at any suitable location on the display device and may also indicate any suitable message or instruction to a player. The gaming device also includes a spins remaining display 310 which displays a number of the additional free spins or free activations of the unlocked reels in a game. The gaming device includes an award display 312 which indicates or displays an award or awards obtained by the player in one or more of the additional free spins. A modifier display 314 indicates a modifier provided to the player in the game wherein the modifier is used to modify any awards obtained by the player in the additional free spins of the reels. The gaming device also includes a total award display 316 which displays the total award obtained by the player in one or more games.

Figure 11A:
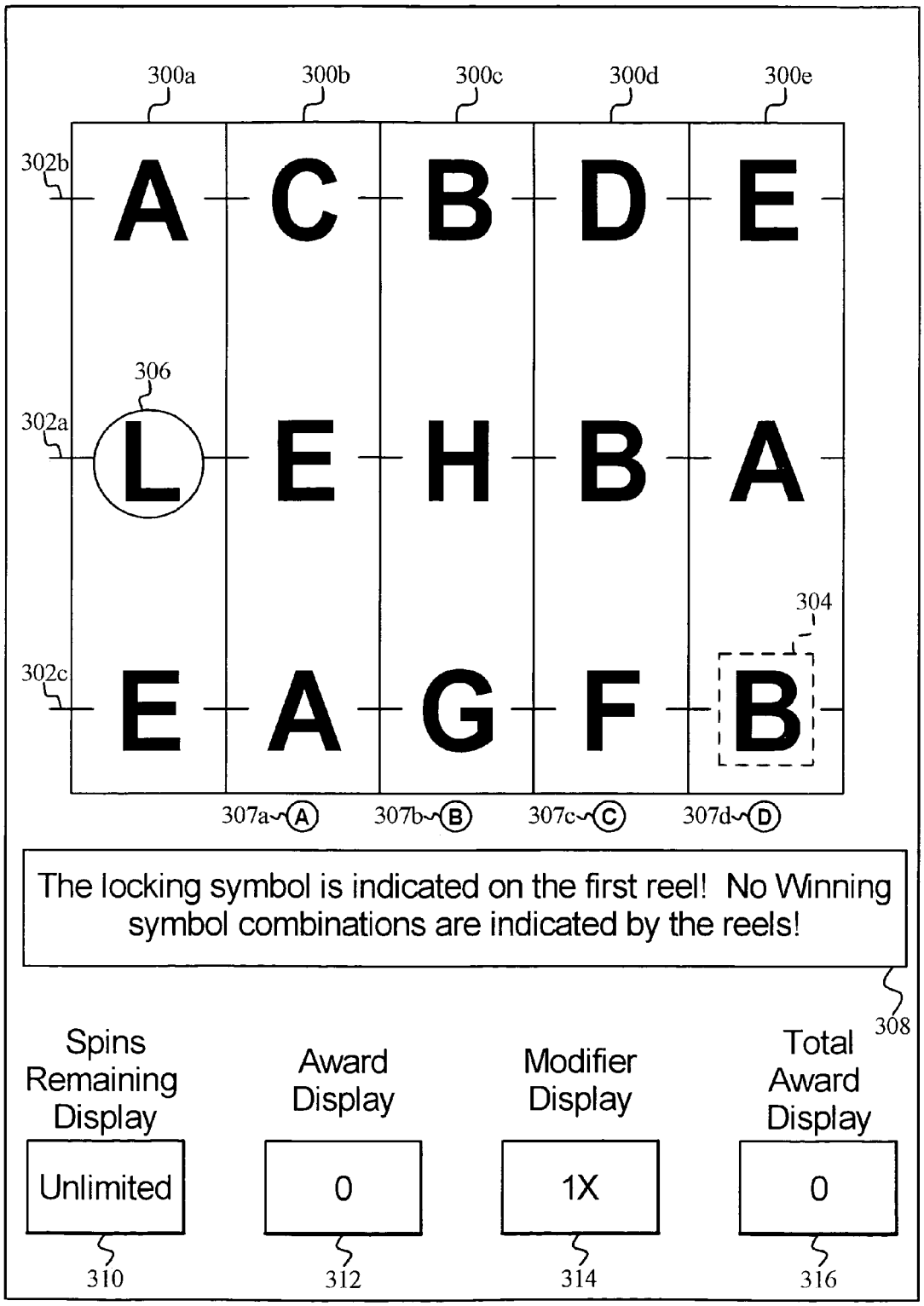
FIGS. 11A, 11B, 11C, 11D, 11E, 11F, 11G and 11H are enlarged front elevation views of one of the display devices of FIGS. 1A and 1B illustrating an example of an alternative embodiment of the present invention where a locking symbol occurs on one of a plurality of reels.

In the unlimited free spin mode, the gaming device provides the player with an initially unlimited number of free spins or free activations as indicated by the spins remaining display 310 in FIG. 11A. The gaming device or player continues to activate or spin the reels until a triggering event (i.e., the unlimited free spin terminating event) occurs in the game. For example in the illustrated embodiment, the triggering event occurs when a locking symbol 306 appears or occurs on reel 300*a*. It should be appreciated that the triggering event may occur when one or more locking symbols occur on one or more of the reels or when any other suitable triggering event occurs in the game.

Referring now to FIG. 11A, an example of the above embodiment is illustrated where the unlimited free spin mode terminating event occurs in the unlimited free spin mode. Specifically, a locking symbol 306 is indicated by payline 302*a* in one of the unlimited number of free spins in the unlimited free spin mode. The message or instruction display 308 indicates that the locking symbol is indicated on the first reel. The message display 308 also indicates that no winning symbol combinations are indicated by the reels in that spin. Because the unlimited free spin mode terminating event occurred, the gaming device provides the player with a designated number of additional free spins (e.g., five free spins) of the reels. Also, the occurrence of the locking symbol 306 causes reel 300*a* to be locked or held stationary for the additional free spins. As the player did not obtain any awards in this free spin, the awards display 312 indicates an award of zero. Furthermore, the modifier display starts with a value or multiplier of 1× as indicated by the modifier display 314. The total award display 316 indicates a total award of zero.

As described above, the gaming device enables the player to select one of the symbols associated with one of the reels. The player hopes to accumulate as many of the selected symbols as possible on the designated reel in the additional free spins to obtain a relatively large modifier in the game. For example, if the player picks modifier symbol or symbol 307*a* associated with reel 300*b*, the gaming device accumulates any A symbols (or symbols 307*a*) occurring on or indicated by reel 300*b* in one or more of the designated number of additional free spins of the reels. In this embodiment, the selected symbol is not accumulated when the selected symbol occurs on a different reel other than the designated reel or the reel associated with the selected symbol. It should be appreciated that the gaming device may accumulate the selected symbol on one specific reel, a plurality of reels or all of the reels in the free spins. Thus, in the illustrated embodiment, the gaming device does not accumulate any of the other non-selected symbols associated with the reels in the additional free spins. In another embodiment discussed in detail below, the gaming device accumulates the non-picked or non-selected symbols on each of the non-locked reels and displays the accumulated number of the those symbols for at least one of the other reels.

Figure 11B:
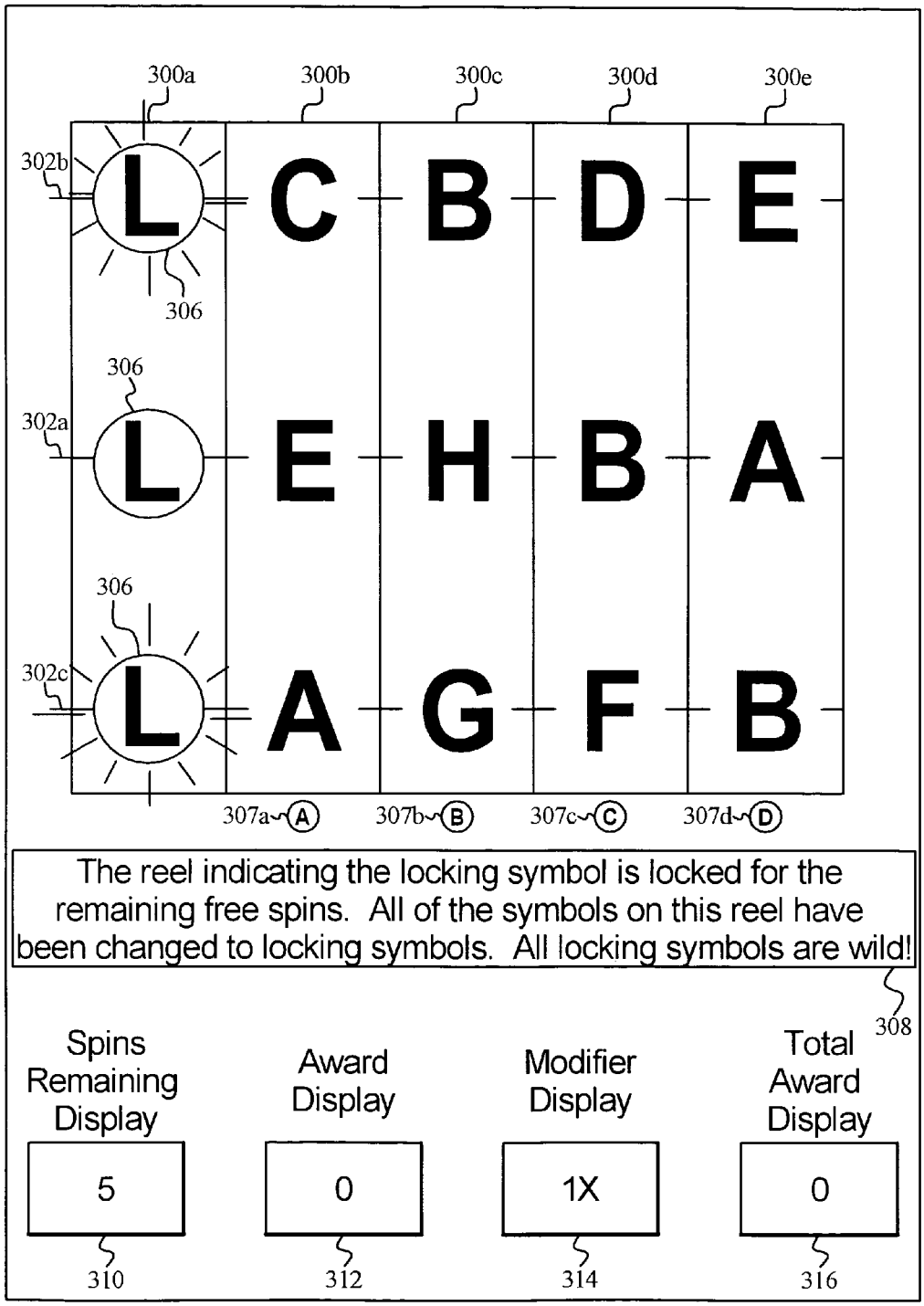

Referring now to FIG. 11B, after the locking symbol is indicated by reel 300*a* as described above, the gaming device converts or changes each of the other symbols on reel 300*a* to a locking symbol 306. As indicated by the message display 308, the reel indicating the locking symbol is locked or held stationary. All of the locking symbols on reel 300*a* also act as wild symbols to substitute for one or more of the symbols on the reels. The gaming device also provides a number of or plurality of additional free spins or free activations to the player such as the five additional free spins of the reels provided to the player and indicated by the spins remaining display 310. It should be appreciated that any suitable number of additional free spins or free activations of the reels may be provided to the player. The award display 312 and total award display 316 each indicate an award of zero. The modifier display 314 indicates a modifier of 1×. It should be appreciated that the modifier may be a randomly determined modifier, a predetermined modifier, a modifier based on a wager made by the player, based on the player's status (such as determined from a player tracking card) or any suitable modifier.

Figure 11C:
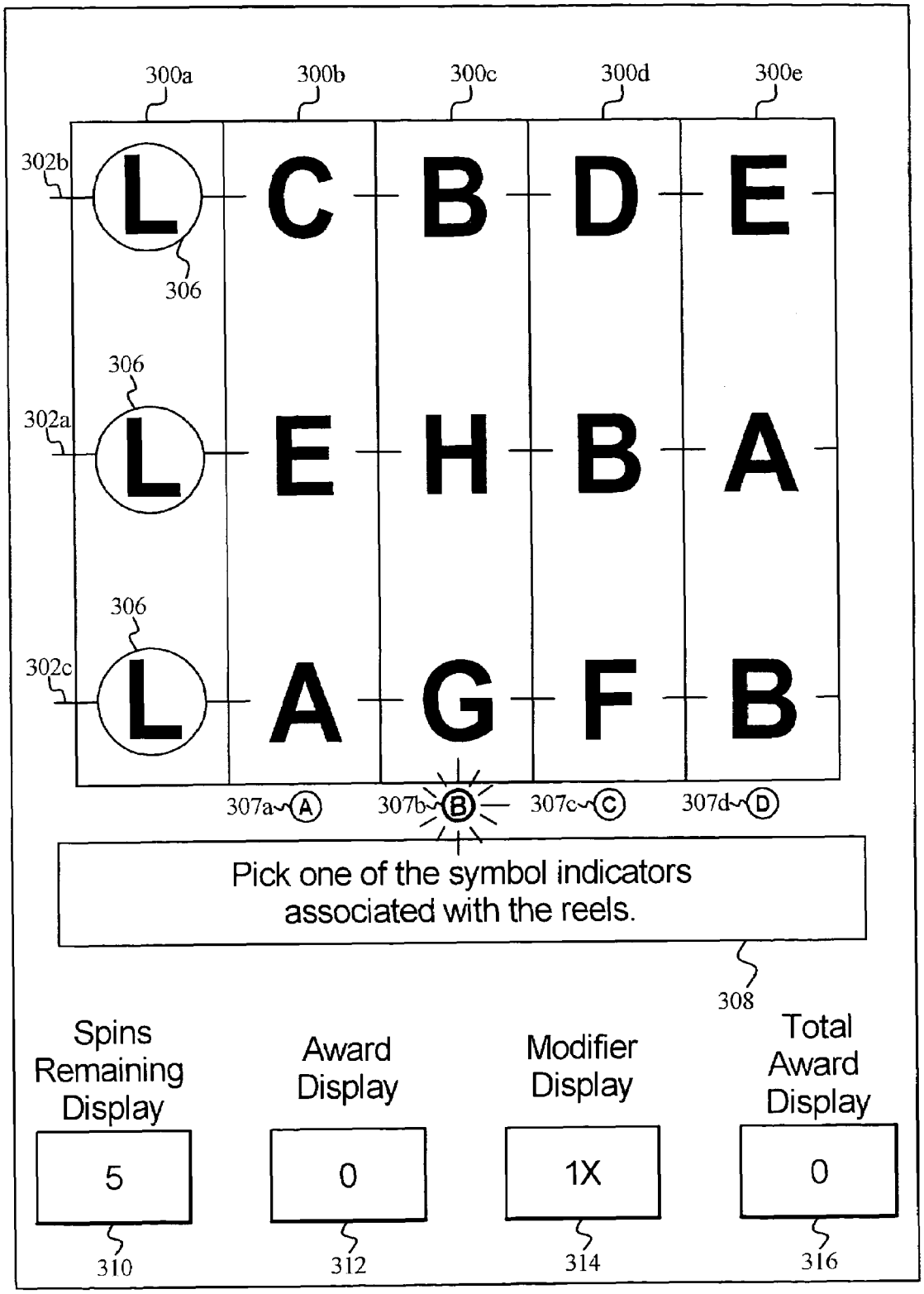

Referring now to FIG. 11C, the gaming device prompts or instructs the player to select one of the symbols associated with the reels by selecting one of the symbol indicators or modifier symbols 307 associated with the reels as indicated by message display 308. In this example, the player picks or selects the B symbol by picking or selecting modifier symbol 307*b* which is associated with that reel. Accordingly, the modifier indicated by the modifier display 314 will be determined by the number of B symbols that are indicated by or occur on reel 300*c* in the five additional free spins of the reels provided to the player.

In this embodiment, each B symbol indicated by reel 300*c* in the additional free spins causes the gaming device to increment or increase the modifier by one. For example, the gaming device causes the modifier to change from 1× to 2× when one B symbol is indicated by reel 300*c* in the first additional free spin of the reels. The gaming device causes the modifier to change or increment from 1× to 3× when two B symbols are indicated by reel 300*c* in one or more of the additional free spins. It should be appreciated that the modifier may increment or change by any suitable amount or amounts. It should also be appreciated that the incremented amount, value or values may be a predetermined or designated amount, a randomly determined amount, an amount based on a wager made by the player, based on the player's status (such as determined from a player tracking card) or any suitable amount. The awards indicated by the award display 312 and the total award display 316 remain at zero.

Figure 11D:
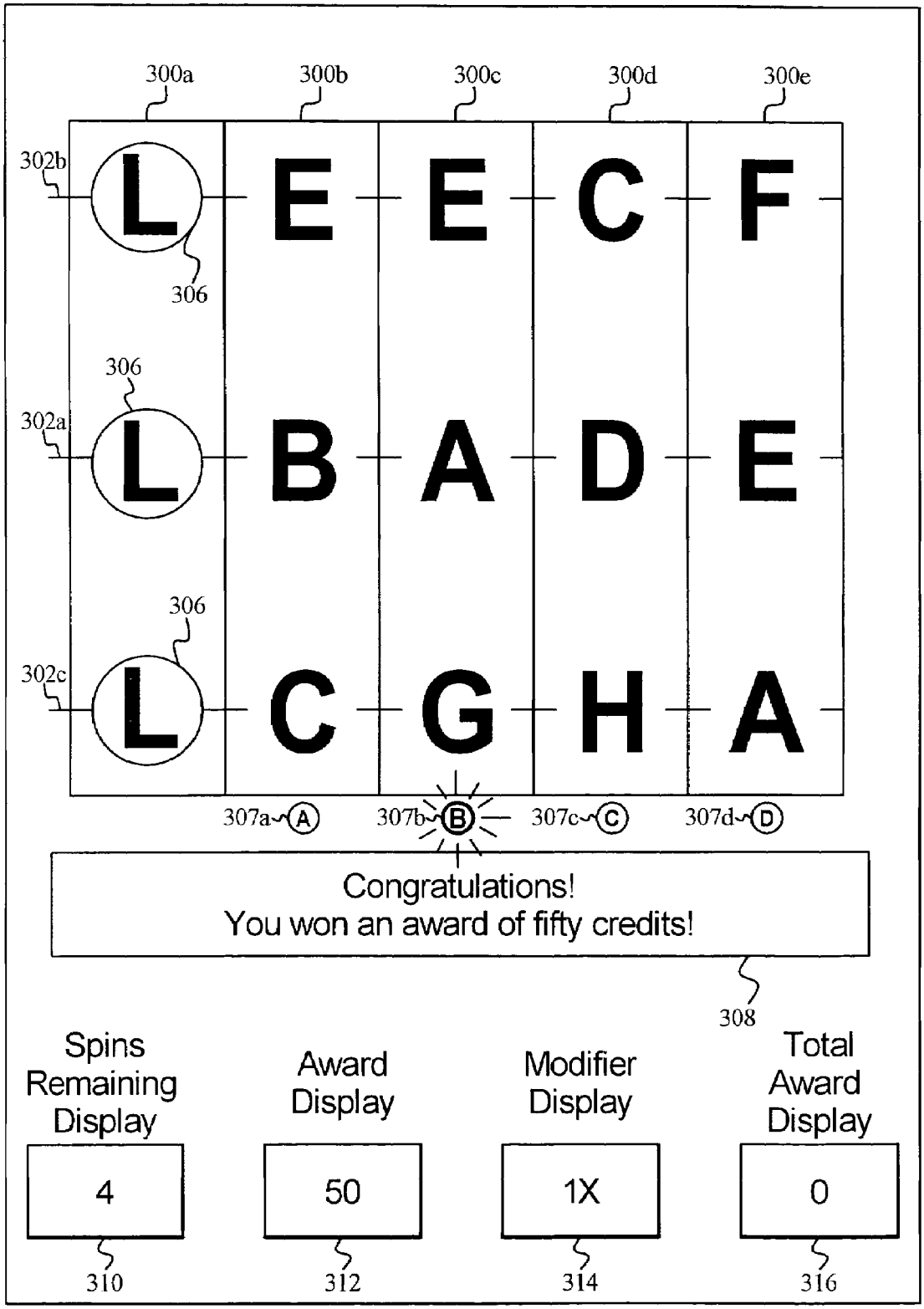

Referring now to FIG. 11D, the gaming device or player activates the reels in the first additional free spin. In the illustrated embodiment, winning symbol combinations include three of the same symbols such as A-A-A. Therefore, in the first additional free spin, payline 302*b* indicates an E symbol on reels 300*b* and 300*c*. Also, the locking symbol 306 indicated by payline 302*b* acts as a wild symbol. Therefore, locking symbol 306 substitutes for one of the E symbols. As a result, a wining symbol combination including three E symbols is indicated by payline 302*b* in this additional free spin. A winning symbol combination including three E symbols provides an award of fifty such as fifty credits to the player as indicated by the award display 312. The message display 308 indicates that the player won an award of fifty credits in that additional free spin of the game. No B symbols were indicated by the designated reel 300*c* (i.e., the reel associated with the selected symbol) in that additional free spin. Therefore, the gaming device does not increment or change the modifier displayed by modifier display 314. The number of remaining additional free spins in the game is now four as indicated by the spins remaining display 310. The total award remains at zero as indicated by the total award display 316.

Figure 11E:
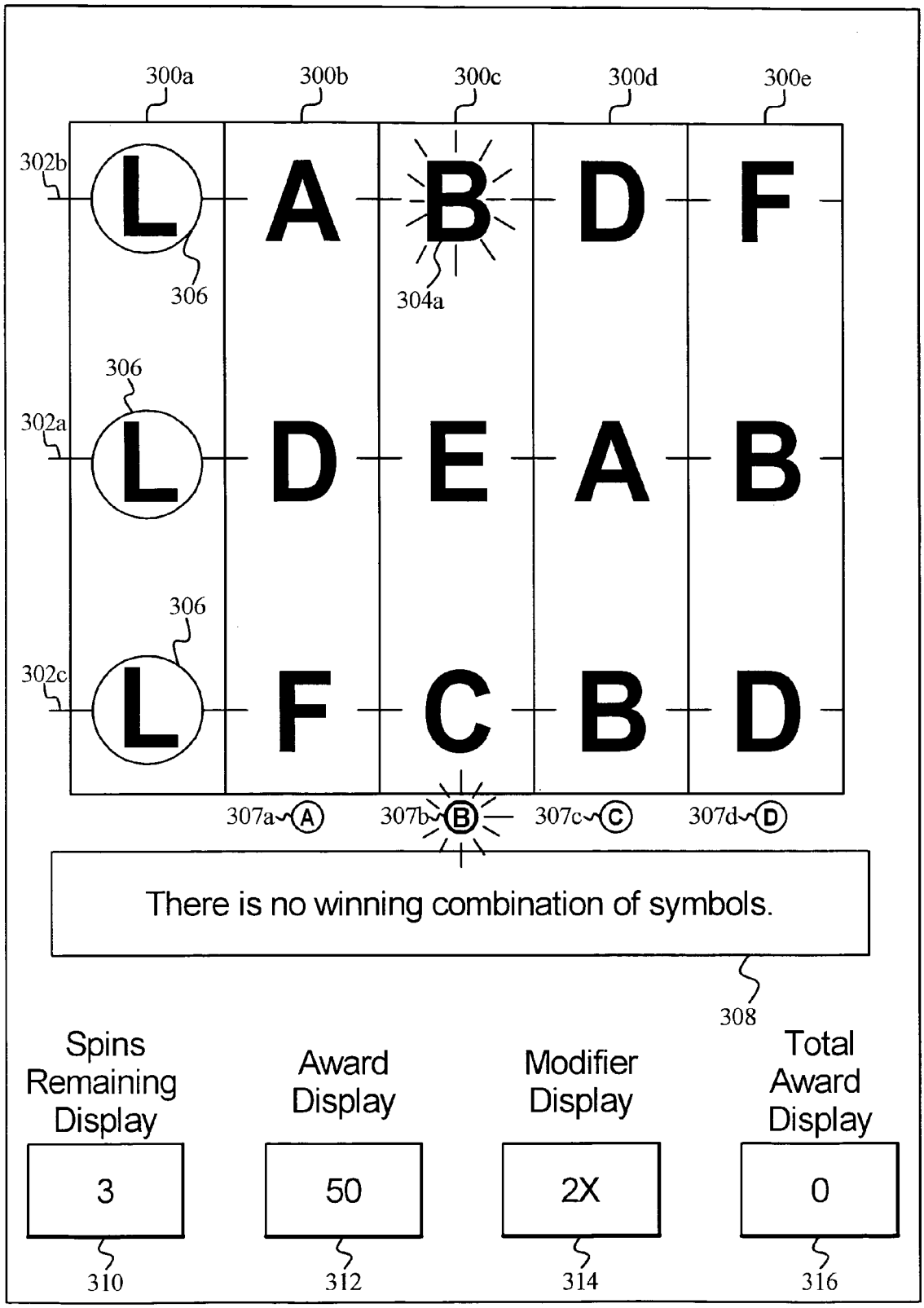

Referring now to FIG. 11E, the gaming device or player activates the reels for a second additional free spin in the game. In this additional free spin, the symbols indicated by the reels do not indicate a winning symbol combination. The message display 308 indicates or displays that there was no winning symbol combinations on the reels. One B symbol 304*a* is indicated by reel 300*c* in this additional free spin. Because the symbol B is the selected symbol in the additional free spins, the gaming device increments or changes the modifier by one or from 1× to 2× as indicated by the modifier display 314. The award obtained in the additional free spins remains at fifty as indicated by the award display 312. The total award remains at zero as indicated by the total award display 316. Also, the spins remaining display indicates that the player has three additional free spins remaining. Thus, the player hopes to accumulate or obtain additional B symbols on reel 300*c* to increment or increase the modifier provided to the player in the additional free spins of the game.

Figure 11F:
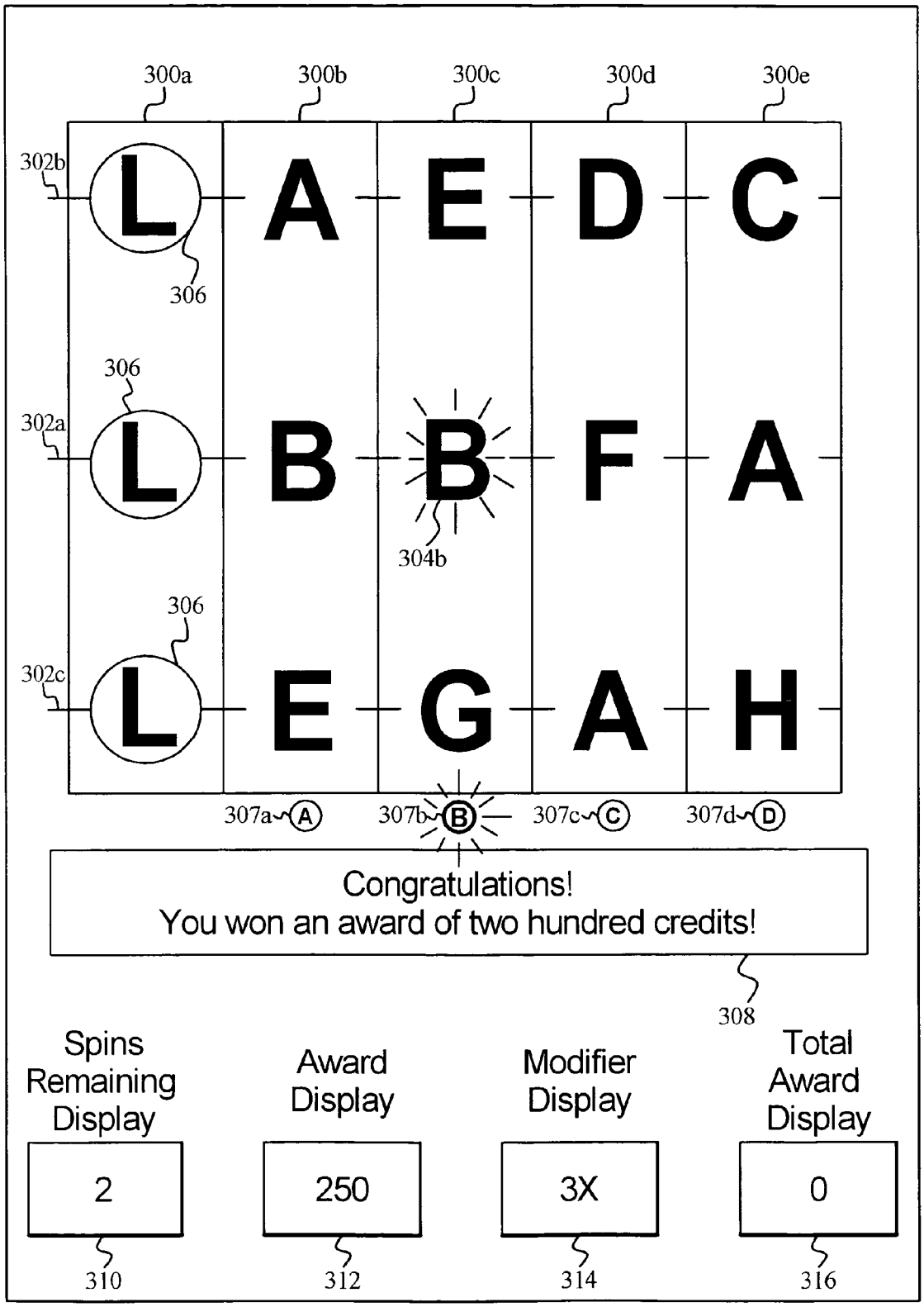

Referring now to FIG. 11F, the gaming device or player activates or spins the reels for another time in the game. After this additional free spin, a winning symbol combination including three B symbols is indicated by payline 302*a*. Specifically, a locking symbol 306, which acts as a wild symbol, is indicated by reel 300*a*, a B symbol is indicated by reel 300*b* and another B symbol is indicated by reel 300*c*. A winning symbol combination including three B symbols provides an award of two hundred credits as indicated by the message display 308. Also, the gaming device accumulates or collects the B symbol 304*b* indicated by the designated reel 300*c*. Therefore, the gaming device increments or changes the modifier by one or from 2× to 3× as indicated by the modifier display 314. The player now has a larger modifier or multiplier which will enable the player to obtain a larger award in the game. The gaming device adds the award of two hundred to the player's current award of fifty to give the player an award of two hundred fifty credits in the additional free spins as indicated by the award display 312. The total award remains at zero as indicated by the total display 316. The player now has two additional free spins remaining in the game as indicated by the spins remaining display 310.

Figure 11G:
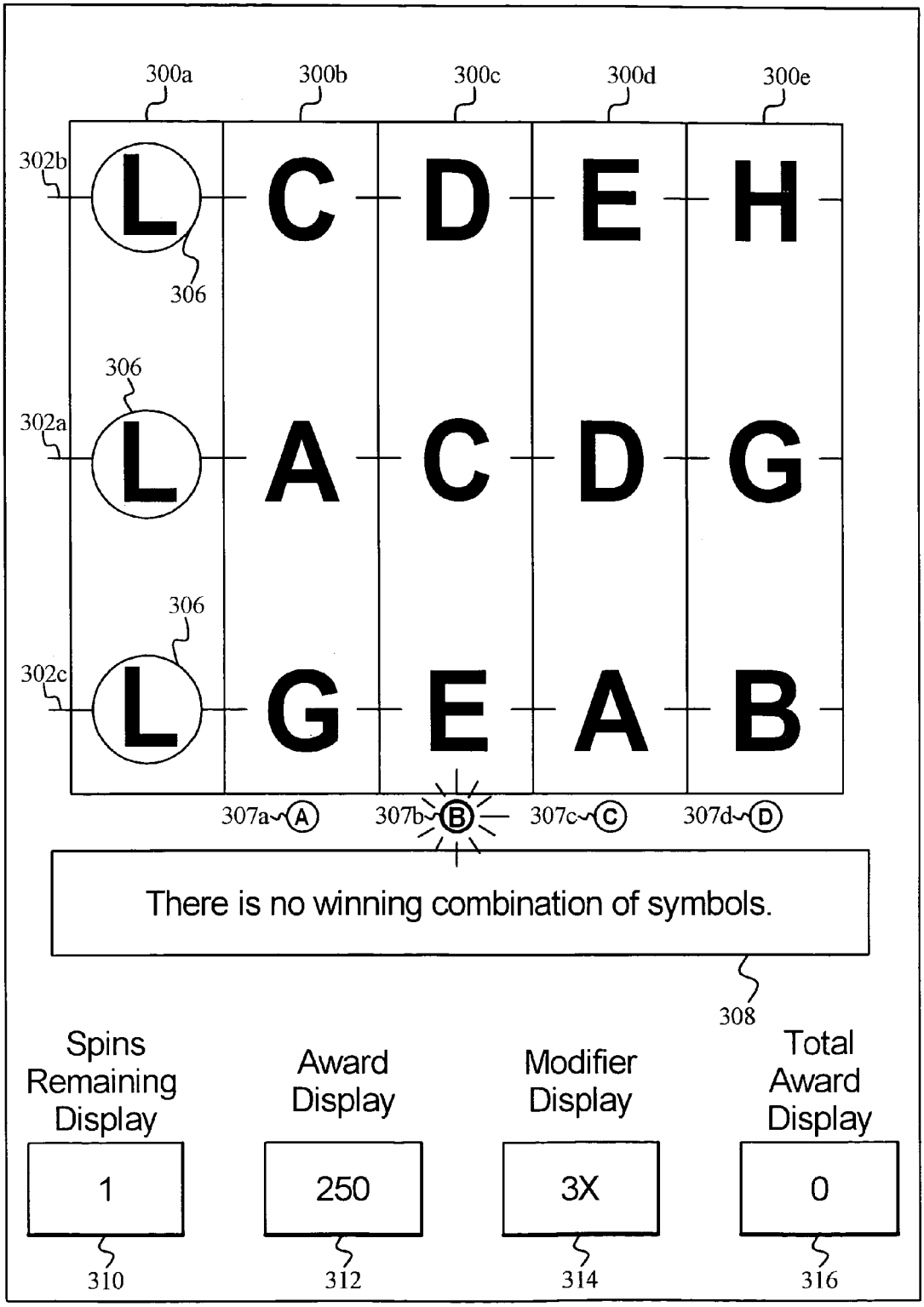

Referring now to FIG. 11G, the gaming device or player activates the reels for a fourth time in the game (i.e., the fourth additional free spin of the five additional free spins initially provided to the player). The symbols indicated by reels 300*b*, 300*c*, 300*d* and 300*e* do not indicate any winning symbol combinations in this additional free spin as indicated by the message display 308. Also, no B symbols (i.e, the selected symbol) are indicated or displayed by the designated reel 300*c*. Therefore, the modifier remains at 3× as indicated by the modifier display 314. The player now has one additional free spin remaining as indicated by the spins remaining display 310.

Figure 11H:
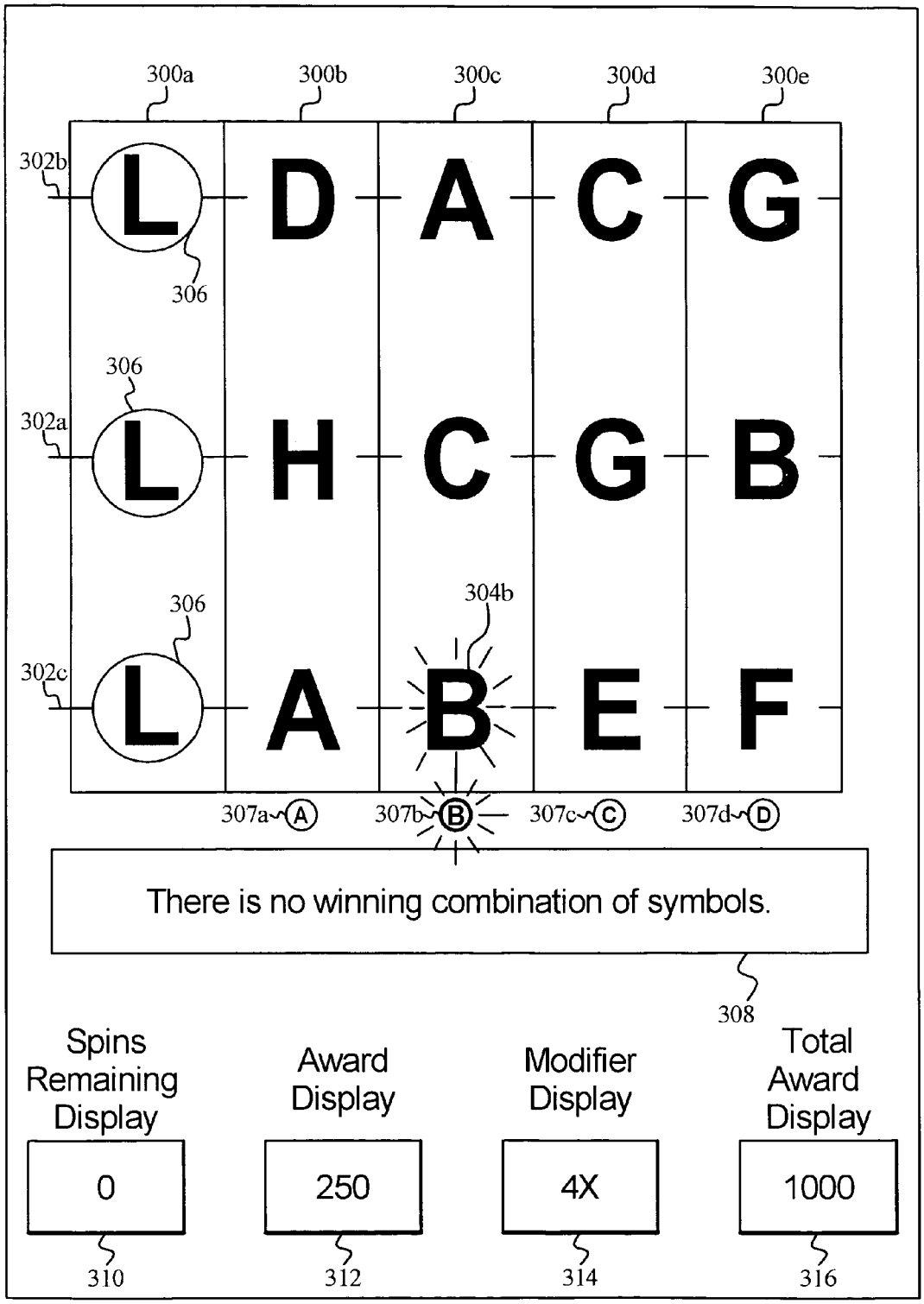

Referring now to FIG. 11H, the gaming device or player activates the reels for the final time in the game (i.e., none of the designated number of additional free spins remain). No winning symbol combinations are indicated by the symbols on the reels in this additional free spin as indicated by the message display 308. One B symbol is indicated by reel 300*c*. The gaming device therefore increments or changes the modifier from 3× to 4× as indicated by the modifier display 314. Because the player does not have any additional free spins remaining as indicated by the spins remaining display 310, the gaming device modifies the accumulated award obtained in the additional free spins to determine the total award for the additional free spins. The total award accumulated in the additional free spins is two hundred fifty credits as indicated by the award display 312. The accumulated award is modified by the accumulated modifier of 4× as indicated by the modifier display 314. The total award provided to the player in the additional free spins of the game is therefore the accumulated award of two hundred fifty credits multiplied by the accumulated modifier of 4× to provide a total award of one thousand credits as indicated by the total award display 316.

Figure 12:
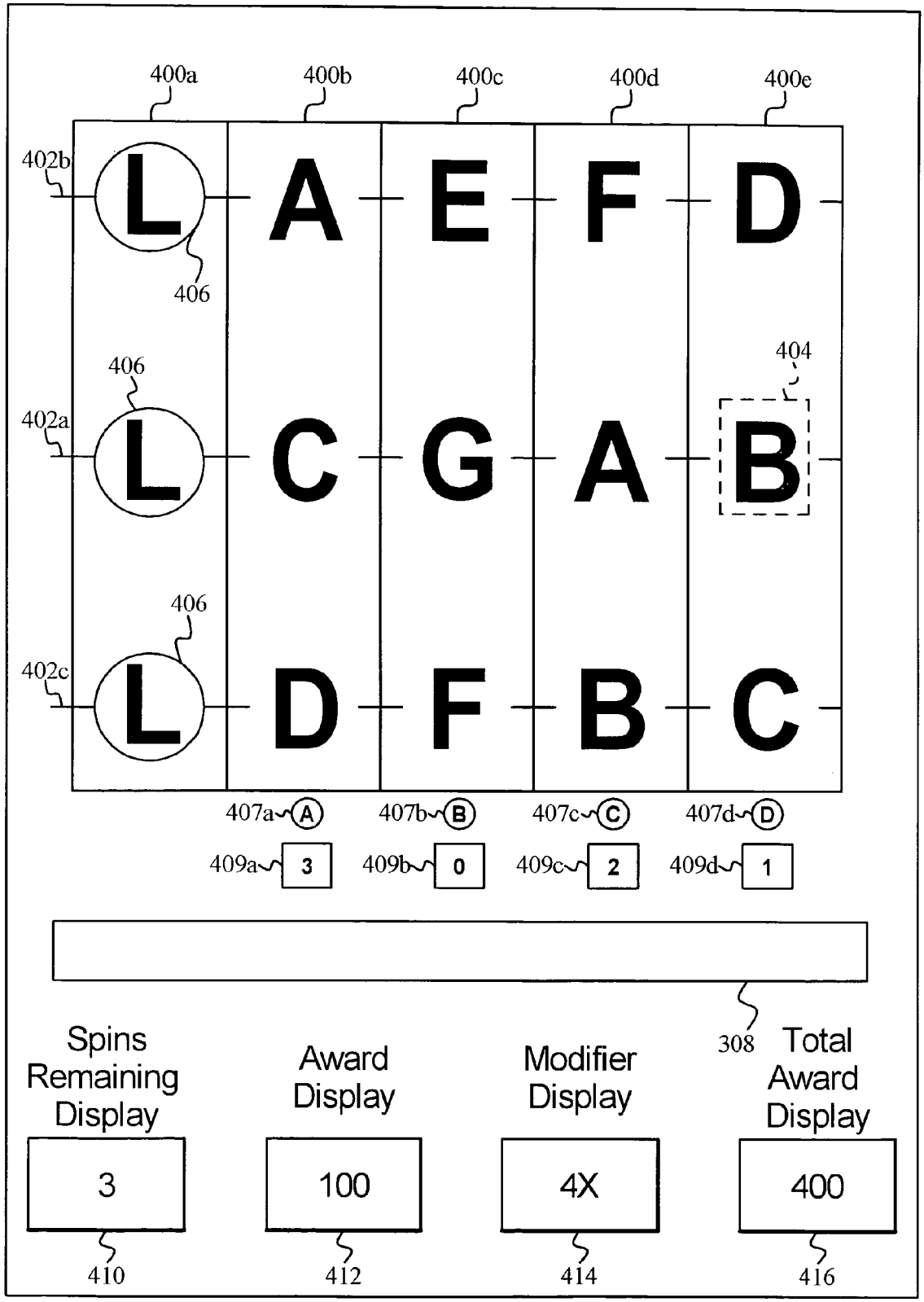
FIG. 12 is an enlarged front elevation view of one of the display devices of FIGS. 1A and 1B illustrating an alternative embodiment of the present invention where a display is associated with each of the non-locking reels and indicates the total number of occurrences of a specific symbol on each reel in the free spins.

Referring now to FIG. 12, an alternative embodiment of the present invention is illustrated where the gaming device displays a plurality of reels 400*a*, 400*b*, 400*c*, 400*d* and 400*e*. A plurality of paylines 402*a*, 402*b* and 402*c* are associated with the reels. Each of the reels includes a plurality of symbols 404 where the first reel 400*a* includes at least one locking symbol 406. At least one of the symbols displayed by the reels is associated with each of the non-locked or unlocked reels. For example, the symbols represented by symbol indicators 407*a*, 407*b*, 407*c* and 407*d* are associated with non-locked reels 400*b*, 400*c*, 400*d* and 400*e*, respectively. In this embodiment, an accumulated symbol display or accumulator display 409*a*, 409*b*, 409*c*, and 409*d* is associated with each of the reels 400*b*, 400*c*, 400*d* and 400*e*, respectively. Each of the accumulated symbol displays indicate or display the total number of the selected symbols associated with each reel that are occurred on each of the reels in one or more of the additional free spins or free activations of the game. For example, the A symbol is associated with reel 400*b*. The accumulated symbol display or accumulator display 409*a* associated with reel 400*b* indicates the number three. This means that three of the A symbols occurred on or were otherwise displayed by reel 400*b* in the designated additional free spins. Similarly, accumulated symbol displays 409*b*, 409*c* and 409*d* each indicate the numbers zero, two and one, respectively. This means that no B symbols occurred on reel 400*c* in the additional free spins of the game. Furthermore, two of the C symbols occurred on reel 400*d* in the additional free spins of the game as indicated by accumulated symbol display 409*c*. Also, one D symbol occurred on reel 400*e* in the additional free spins of the game as indicated by accumulated symbol display 409*d*.

The accumulated symbol displays 409 therefore enable a player to determine the number of symbols 407 that have been accumulated on a specific reel in the additional free spins of the game. The accumulated symbol displays 409 also enable the player to see or view the number of symbols accumulated on the other reels so that the player can compare the accumulated symbols on each of the reels and analyze and evaluate their selection. In this embodiment, the gaming device also includes a message or instruction display 408, a spins remaining display 410, an award display 412, a modifier display 414 and a total award display 416 as described above. It should be appreciated that any suitable number of displays may be associated with one or more of the reels to display the accumulated number of symbols on those reels.

In alternative embodiments a graduated locking of the reels is provided. In one such embodiment, a designated number of reels can lock during the unlimited free spin or activations. After the designated number are locked, the next locking symbol which occurs causes that reel to lock and the limited number of remaining activations to be provided on the unlocked reels. In one example after the first reel locks the unlimited free spins continue; upon the locking of the second reel, the limited free spins are provided.

It should also be appreciated that the present invention may be employed in a primary game, a bonus game, a sub-game or in any suitable game.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is claimed as follows:

1. A gaming device comprising:

at least one display device;

at least one input device;

at least one processor; and at least one memory device which stores a plurality of instructions, which when executed by the at least one processor, cause the at least one processor to operate with the at least one display device and the at least one input device to:

(a) display a play of a primary game upon a wager by a player; and (b) if a triggering event occurs:

(I) initiate an unlimited free spin mode, said unlimited free spin mode including an unlimited number of free spins of a plurality of reels without an additional wager, said reels including a plurality of symbols including at least one locking symbol, wherein one of a plurality of awards is provided for each winning symbol combination indicated by the reels in said unlimited number of free spins, and (II) if the locking symbol is generated by one of said reels in the unlimited free spin mode:

(i) hold at least one of the reels stationary for a number of additional free spins, said number being at least one;

(ii) prior to activating the reels for any of said number of additional free spins, enable a selection of one of a plurality of designated symbols associated with the non-held reels;

(iii) activate at least one of the non-held reels for one of said number of additional free spins;

(iv) reduce the number of additional free spins remaining;

(v) increment a modifier for each occurrence of the selected symbol on the reels during said additional free spin;

(vi) repeat (iii) to (v) until no additional free spins remain;

(vii) modify any awards obtained in said additional free spins using the modifier; and (viii) display any modified awards.

2. The gaming device of claim 1, wherein the plurality of instructions, when executed by the at least one processor, cause the at least one processor to increment the modifier for each occurrence of the selected symbol on the reel having said selected symbol.

3. The gaming device of claim 1, wherein the symbols include a plurality of locking symbols.

4. The gaming device of claim 3, wherein the plurality of instructions, when executed by the at least one processor, cause the at least one processor to, if one of said locking symbols is indicated on a plurality of the reels, hold each of said reels stationary.

5. The gaming device of claim 1, wherein the number of additional free spins is selected from the group consisting of being: randomly determined, pre-determined, and determined based on the wager.

6. The gaming device of claim 1, wherein the plurality of instructions, when executed by the at least one processor, cause the at least one processor to cause said locking symbols and a plurality of the other symbols on said reel indicating said locking symbol to functions as wild symbols.

7. The gaming device of claim 1, wherein the plurality of instructions, when executed by the at least one processor, cause the at least one processor to cause said locking symbols and all of the other symbols on said reel indicating said locking symbol to function as wild symbols.

8. The gaming device of claim 1, wherein the plurality of instructions, when executed by the at least one processor, cause the at least one processor to increment the modifier by a randomly determined amount, a predetermined amount or an amount based on the wager.

9. The gaming device of claim 1, which includes at least one accumulated symbol display associated with one of reels other than the reel indicating the locking symbol.

10. The gaming device of claim 1, which includes at least one accumulated symbol display associated with a plurality of the reels other than the reel indicating the locking symbol.

11. The gaming device of claim 1, which includes at least one accumulated symbol display associated with all of the reels other than the reel indicating the locking symbol.

12. The gaming device of claim 1, which includes at least one payline associated with the reels, wherein at least one of said reels is held stationary if the locking symbol occurs on said payline.

13. The gaming device of claim 1, wherein the plurality of instructions, when executed by the at least one processor, cause the at least one processor to terminate the unlimited free spin mode if the locking symbol is generated.

14. The gaming device of claim 1, wherein the primary game includes said plurality of reels.

15. The gaming device of claim 1, wherein the primary game includes a plurality of secondary reels different from said plurality of reels.

16. A gaming device comprising:

at least one display device;

at least one input device;

at least one processor; and at least one memory device which stores a plurality of instructions, which when executed by the at least one processor, cause the at least one processor to operate with the at least one display device and the at least one input device to:

(a) display a game, said game associated with a plurality of reels, a plurality of symbols on said reels, said symbols including at least one locking symbol;

(b) display an unlimited number of free spins of the plurality of reels, wherein in each unlimited free spin of the reels, one of a plurality of awards is provided if one of a plurality of winning symbol combinations is indicated on said reels; and (c) if an unlimited free spin terminating event occurs, said unlimited free spin terminating event triggered upon a generation of said locking symbol on one of said reels in one of said unlimited free spins:

(i) lock said reel indicating said locking symbol in place for a number of additional free spins of the reels, said number being at least one; (ii) prior to activating the reels for any of said number of additional free spins, cause a selection of one of a plurality of designated symbols associated with said non-locked reels;

(iii) activate the non-locked reels for one of said number of additional free spins;

(iv) reduce the number of additional free spins of the reels remaining;

(v) increment a modifier for each occurrence of the selected symbol on the non-locked reel associated with said selected symbol for said additional free spin;

(vi) repeat (iii) to (v) until no additional free spins remain;

(vii) modify any awards in the additional free spins by the modifier; and (viii) display any modified awards.

17. The gaming device of claim 16, wherein said symbols include a plurality of locking symbols.

18. The gaming device of claim 16, wherein the plurality of instructions, when executed by the at least one processor, cause the at least one processor to, if one of said locking symbols is indicated on a plurality of said reels, lock each of said reels indicating said locking symbol in place.

19. The gaming device of claim 16, wherein the plurality of instructions, when executed by the at least one processor, cause the at least one processor to cause said locking symbols and at least one of the other symbols on said reel indicating said locking symbol to be wild symbols.

20. The gaming device of claim 16, wherein the plurality of instructions, when executed by the at least one processor, cause the at least one processor to cause said locking symbols and a plurality of the other symbols on said reel indicating said locking symbol to be wild symbols.

21. The gaming device of claim 16, wherein the plurality of instructions, when executed by the at least one processor, cause the at least one processor to cause said locking symbols and all of the other symbols on said reel indicating said locking symbol to be wild symbols.

22. The gaming device of claim 16, which includes at least one accumulated symbol display associated with one of the non-locked reels.

23. The gaming device of claim 16, which includes at least one accumulated symbol display associated with a plurality of the non-locked reels.

24. The gaming device of claim 16, which includes at least one accumulated symbol display associated with all of the non-locked reels.

25. The gaming device of claim 16, which includes at least one payline associated with the reels, wherein at least one of said reels is locked in place when the locking symbol occurs on said payline.

26. A method of operating a gaming device including a plurality of instructions, said method comprising:

(a) causing at least one display device to display a primary game upon a wager; and (b) if a triggering event occurs:

(I) causing the at least one display device to display an unlimited free spin mode said unlimited free spin mode including an unlimited number of free spins of a plurality of reels without an additional wager, wherein one of the awards is provided for each winning symbol combination indicated by the reels in said unlimited number of free spins; and (II) if a locking symbol is generated by one of said reels in the unlimited free spin mode:

(i) causing at least one processor to execute the plurality of instructions to hold at least one of the reels stationary for a number of additional free spins, said number being at least one;

(ii) prior to activating the reels for any of said number of additional free spins, causing the at least one processor to execute the plurality of instructions to cause a selection of one of a plurality of designated symbols associated with the non-held reels;

(iii) causing the at least one processor to execute the plurality of instructions to activate at least one of the non-held reels for one of said number of additional free spins;

(iv) causing the at least one processor to execute the plurality of instructions to reduce the number of additional free spins remaining;

(v) causing the at least one processor to execute the plurality of instructions to increment a modifier for each occurrence of the selected symbol on the reels in said additional free spin;

(vi) causing the at least one processor to execute the plurality of instructions to repeat (iii) to (v) until no additional free spins remain;

(vii) causing at least one processor to execute the plurality of instructions to modify any awards obtained in said additional free spins using the modifier; and (viii) causing the at least one display device to display any modified awards.

27. The method of claim 26, which includes causing the at least one processor to execute the plurality of instructions to increment the modifier for each occurrence of the selected symbol on the reel having said selected symbol.

28. The method of claim 26, wherein the symbols include a plurality of locking symbols.

29. The method of claim 28, which includes, if one of said locking symbols is indicated on a plurality of the reels, causing the at least one processor to execute the plurality of instructions to hold each of said reels stationary.

30. The method of claim 26, wherein the number of additional free spins is selected from the group consisting of being: randomly determined, pre-determined, and determined based on the wager.

31. The method of claim 26, which includes causing the at least one processor to execute the plurality of instructions to cause the locking symbols and a plurality of the other symbols on said reel indicating said locking symbol to functions as wild symbols.

32. The method of claim 26, which includes causing the at least one processor to execute the plurality of instructions to cause said locking symbols and all of the other symbols on said reel indicating said locking symbol to function as wild symbols.

33. The method of claim 26, which includes causing the at least one processor to execute the plurality of instructions to increment the modifier by a randomly determined amount, a predetermined amount or an amount based on the wager.

34. The method of claim 26, which includes causing the at least one processor to execute the plurality of instructions to terminate the unlimited free spin mode if the locking symbol is generated.

35. The method of claim 26, wherein the primary game includes said plurality of reels.

36. The method of claim 26, wherein the primary game includes a plurality of secondary reels different from said plurality of reels.

37. The method of claim 26, which is operated through a data network.

38. The method of claim 37, wherein the data network is an internet.

39. A method of operating a gaming device including a plurality of instructions, said method comprising:

(a) causing at least one display device to display an unlimited number of free spins of a plurality of reels, wherein in each unlimited free spin of the reels, one of a plurality of awards is provided if one of the winning symbol combination is indicated on said reels; and (b) upon an occurrence of an unlimited free spin terminating event, said unlimited free spin terminating event triggered upon a generation of a locking symbol on one of said reels in one of said unlimited free spins:

(i) causing at least one processor to execute the plurality of instructions to lock said reel indicating said locking symbol in place for a number of additional free spins of the reels, said number being at least one;

(ii) prior to activating the reels for any of said number of additional free spins, causing the at least one processor to execute the plurality of instructions to cause a selection of one of a plurality of designated symbols associated with said non-locked reels;

(iii) causing the at least one processor to execute the plurality of instructions to activate the non-locked reels for one of said number of additional free spins;

(iv) causing the at least one processor to execute the plurality of instructions to reduce the number of additional free spins of the reels remaining;

(v) causing the at least one processor to execute the plurality of instructions to increment a modifier for each occurrence of the selected symbol on the non-locked reel associated with said selected symbol in said additional free spin;

(vi) causing the at least one processor to execute the plurality of instructions to repeat (iii) to (v) until no additional free spins remain;

(vii) causing the at least one processor to execute the plurality of instructions to modify any awards in the additional free spins by the modifier; and (viii) causing the at least one display device to display any modified awards.

40. The method of claim 39, wherein the symbols include a plurality of locking symbols.

41. The method of claim 40, which includes, if one of said locking symbols is indicated on a plurality of the reels, causing the at least one processor to execute the plurality of instructions to hold each of said reels stationary.

42. The method of claim 39, wherein the number of additional free spins is selected from the group consisting of being: randomly determined, pre-determined, and determined based on the wager.

43. The method of claim 39, which includes causing the at least one processor to execute the plurality of instructions to cause the locking symbols and a plurality of the other symbols on said reel indicating said locking symbol to functions as wild symbols.

44. The method of claim 39, which includes causing the at least one processor to execute the plurality of instructions to cause said locking symbols and all of the other symbols on said reel indicating said locking symbol to function as wild symbols.

45. The method of claim 39, which includes causing the at least one processor to execute the plurality of instructions to increment the modifier by a randomly determined amount, a predetermined amount or an amount based on the wager.

46. The method of claim 39, which includes causing the at least one processor to execute the plurality of instructions to terminate the unlimited free spin mode if the locking symbol is generated.

47. The method of claim 39, which is operated through a data network.

48. The method of claim 47, wherein the data network is an internet.

* * * * *

UNITED STATES PATENT AND TRADEMARK OFFICE

CERTIFICATE OF CORRECTION

PATENT NO. : 7,666,083 B2
APPLICATION NO. : 11/216323
DATED : February 23, 2010
INVENTOR(S) : Baerlocher et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1116 days.

Signed and Sealed this

Seventh Day of December, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,666,083 B2
APPLICATION NO. : 11/216323
DATED : February 23, 2010
INVENTOR(S) : Anthony J. Baerlocher et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1116 days.

In Claim 9, Column 32, Line 4, insert --the-- between the terms “of” and “reels”.

In Claim 26, Column 33, Line 43, replace “the” with --a plurality of--.

In Claim 39, Column 34, Line 56, replace “the” with --a plurality of--.

In Claim 39, Column 34, Line 57, replace “combination” with --combinations--.

Signed and Sealed this

Twenty-first Day of December, 2010

David J. Kappos

David J. Kappos
*Director of the United States Patent and Trademark Office*